US006130022A

United States Patent [19]

Naruse

[11] Patent Number: 6,130,022

[45] Date of Patent: Oct. 10, 2000

[54] HEAT DEVELOPABLE COLOR PHOTOGRAPHIC LIGHT-SENSITIVE MATERIAL

[75] Inventor: Hideaki Naruse, Minami-ashigara, Japan

[73] Assignee: Fuji Photo Film Co., Ltd., Kanagawa-ken, Japan

[21] Appl. No.: 09/390,366

[22] Filed: Sep. 7, 1999

[30] Foreign Application Priority Data

Sep. 8, 1998 [JP] Japan ..... 10-269053

[51] Int. Cl.[7] ..... G03C 8/40; G03C 8/18; G03C 7/413

[52] U.S. Cl. ..... 430/203; 430/216; 430/226; 430/380; 430/467; 430/483; 430/484

[58] Field of Search ..... 430/203, 218, 430/226, 380, 467, 483, 484

[56] References Cited

U.S. PATENT DOCUMENTS 5,716,722 2/1998 Taguchi ..... 430/543
5,780,210 7/1998 Takeuchi et al. ..... 430/435
5,976,756 11/1999 Nakamura et al. ..... 430/218

FOREIGN PATENT DOCUMENTS 9-152705 10/1997 Japan .

*Primary Examiner*—Thorl Chea
*Attorney, Agent, or Firm*—Sughrue, Mion, Zinn, Macpeak & Seas, PLLC

[57] ABSTRACT

There is disclosed a heat-developable color photographic light-sensitive material having on a base at least a light-sensitive silver halide, a binder, a coupler, and a reducing agent, wherein, as the reducing agent, a co-emulsion comprising at least one silver-developing reducing agent and at least one color-image-forming reducing agent is contained, and the silver-developing reducing agent is a specific sulfonamidophenol compound, and wherein the coupler forms a diffusion dye by reaction with an oxidized product of the color-image-forming reducing agent. The light-sensitive material can secure good discrimination by rapid processing and it is excellent in raw stock storability.

9 Claims, No Drawings

HEAT DEVELOPABLE COLOR PHOTOGRAPHIC LIGHT-SENSITIVE MATERIAL

FIELD OF THE INVENTION

The present invention relates to a heat-developable color photographic light-sensitive material, and particularly to a heat-developable color diffusion transfer light-sensitive material.

BACKGROUND OF THE INVENTION

It is known that a silver halide photographic light-sensitive material is subjected to heat-development to form an image, which is described, for example, in "Shashin Kogaku no Kiso," Hi-ginen Shashin-hen, (1982, published by Korona-sha), pages 242 to 255, and in U.S. Pat. No. 4,500,626.

Further, heat-developable light-sensitive materials wherein use is made of silver halides are a conventionally widely practiced photographic means, because they are excellent in photographic properties, such as sensitivity and gradation, in comparison with the electrophotographic technique, the diazo photographic technique, and the like. For the method of obtaining a color image by subjecting to heat-development a silver halide light-sensitive material, many proposals are made, one of which is a color-development system of forming a dye image by the coupling reaction of the oxidized product of a developing agent and a coupler. With respect to the developing agent and the coupler that can be used in this color-development system, for example, a combination of a p-phenylenediamine-series reducing agent with a phenol or with an active methylene coupler is proposed in U.S. Pat. No. 3,531,256, a p-aminophenol-series reducing agent is proposed in U.S. Pat. No. 3,761,270, and a combination of a sulfonamidophenol-series reducing agent with a four-equivalent coupler is proposed in U.S. Pat. No. 4,021,240.

This method is, however, accompanied by such defects as that color formation at the undeveloped part of undeveloped silver halides remaining after the processing occurs at the time of printing out or with the lapse of time, and that color contamination occurs due to the simultaneous presence of reduced silver and a dye image at the exposed part. To solve these defects, a dye transfer system is proposed, wherein a diffusion dye is formed by heat development and is transferred to an image-receiving layer.

In such a diffusion transfer-type heat-developable light-sensitive material, there are a case wherein an image-receiving layer capable of receiving a dye is formed on the base of the light-sensitive material, and a case wherein an image-receiving layer is formed on a base different from that of the light-sensitive material.

Particularly when use is made of a heat-developable color light-sensitive material, for the purpose of obtaining a dye image high in color purity, it is desirable to use an image-receiving material having a dye image-receiving layer formed on a separate base, to cause the dye to be diffused and transferred, either simultaneously with the formation of the diffusion dye by the color development, or after the formation of the diffusion dye.

The method wherein a diffusible dye is released or formed imagewise by heat development and the resultant diffusible dye is transferred to a dye-fixing element is proposed. In this method, by changing the type of the dye-providing compound to be used or the type of the silver halide to be used, a negative dye image, as well as a positive dye image, can be obtained. More details are described, for example, in U.S. Pat. No. 4,500,625, U.S. Pat. No. 4,483,914, U.S. Pat. No. 4,503,137, U.S. Pat. No. 4,559,290, JP-A-58-149046 ("JP-A" means unexamined published Japanese patent application), JP-A-60-133449, JP-A-59-218443, JP-A-61-238056, EP-A-220 746 (A2), Kokai-giho No. 87-6199, EP-A-210 660 (A2), and the like. These are accompanied by the problem that the sensitivity of the light-sensitive material is lowered, because a color-formed dye has previously been fixed in a dye- providing substance, and it therefore is preferable to realize a system wherein an originally colorless coupler and a developing agent are reacted, to allow the intended dye to diffuse.

As means of forming an image by the above coupling system, heat-developable light-sensitive materials containing a coupler and a color-developing agent precursor capable of releasing a p-phenylenediamine are disclosed, for example, in JP-B-63-36487 ("JP-B" means examined Japanese patent publication), JP-A-5-224381, and JP-A-6-83005; a combination of a ureidoanilin-series reducing agent with an active methylene-type coupler is disclosed in JP-A-59-111148; a light-sensitive material, wherein use is made of a coupler that has a coupling split-off group with a polymer chain and that can release a diffusion dye by color development, is disclosed in JP-A-58-149047; and a technique wherein a combination of a carbamoylhydrazine-series developing agent with an active methylene-type coupler produces/releases a dye, is disclosed in JP-A-09-152705.

However, the color-developing agents or precursors of color-developing agents used in these documents have such problems that the dye image density after transfer is unsatisfactory, and that the development-processing-time dependency is unpreferably large.

As a means of solving these problems, a technique wherein a hydrophilic reducing agent is used as an auxiliary developing agent in combination with a lipophilic reducing agent, and electrons are moved between them, to increase the rate of development, is known, like a method disclosed in JP-A-1-138556. However, this technique has the problem that the development acceleration effect and raw stock storability of the light-sensitive material (the presence or absence of an influence of storage of the unexposed light-sensitive material on the photographic performance) are difficult to secure at the same time. In this respect, the advent of a technique wherein the development acceleration effect and the raw stock storability are secured at the same time has been desired.

SUMMARY OF THE INVENTION

An object of the present invention is to provide a silver halide photographic light-sensitive material that can secure good discrimination by rapid processing and that is excellent in raw stock storability.

Other and further objects, features, and advantages of the invention will appear more fully from the following description.

DETAILED DESCRIPTION OF THE INVENTION

The object of the present invention has been attained by the following means:

(1) A heat-developable color photographic light-sensitive material having on a base at least a light-sensitive silver halide, a binder, a coupler, and a reducing agent, wherein, as the reducing agent, a co-emulsion comprising at least one silver-developing reducing agent and at least one color-image-forming reducing agent is contained, and the silver-developing reducing agent is at least one compound represented by the following formula (1) or (2):

formula (1)

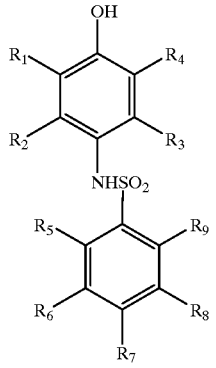

formula (2)

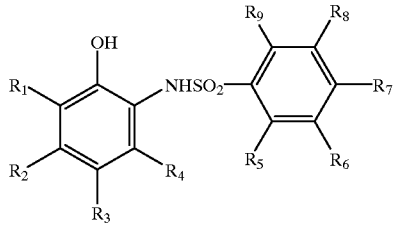

wherein $R_1$ to $R_9$ each represent a hydrogen atom, a halogen atom, a cyano group, or a substituent having 4 or less carbon atoms or an I/O value of 1 or more, with the proviso that, in formula (1), $R_2$ and/or $R_4$, and $R_5$ and/or $R_9$, each represent a halogen atom or a substituent having 4 or less carbon atoms or an I/O value of 1 or more, and that, in formula (2), $R_4$, and $R_5$ and/or $R_9$ each represent a halogen atom or a substituent having 4 or less carbon atoms or an I/O value of 1 or more; or when $R_1$ and $R_2$, $R_3$ and $R_4$, $R_5$ and $R_6$, $R_6$ and $R_7$, $R_7$ and $R_8$, and $R_8$ and $R_9$ each represent a substituent other than a hydrogen atom, each combination of the groups may independently bond together to form a ring, and wherein the coupler forms a diffusion dye by the reaction with an oxidized product of the color-image-forming reducing agent; and (2) The light-sensitive material as stated in the above (1), wherein the heat-developable color photographic light-sensitive material is a diffusion transfer light-sensitive material.

Hereinbelow, the present invention are described in detail.

First, the compounds represented by formula (1) or (2) are described in detail.

The compounds represented by formula (1) or (2) represent reducing agents collectively called sulfonamidophenols, and in the present invention they are used as a silver-developing reducing agent. In formulas, $R_1$ to $R_9$ each represent a hydrogen atom, a halogen atom, or a substituent having 4 or less carbon atoms or an I/O value of 1 or more. The term I/O value means a parameter representing the scale of the lipophilicity/hydrophilicity of a compound or a substituent, and it is described in detail in "Yuki Gainen-zu" (written by Koda Yoshiki; published by Sankyo Shuppan, issued on May 10, 1984). "I" denotes inorganic nature, and "O" denotes organic nature. The larger the I/O value is, the higher the inorganic nature is. Here, specific examples of I/O values are described. Representative examples of the I value are 200 for an —NHCO— group, 240 for an —$NHSO_2$— group, and 60 for a —COO— group. For instance, in the case of —$NHCOC_5H_{11}$, the number of carbon atoms is 6, the 0 value is 20×6=120 since the O value per carbon atom is 20, and I×200, so that I/O ≈1.67, and therefore I/O >1. The compound for use in the present invention is a compound substituted by a substituent whose I/O value is 1 or more or the number of carbon atoms is 4 or less, and it is characterized by hydrophilicity. A specific example of the substituent is, for example, a halogen atom (e.g. chlorine and bromine), an alkyl group (e.g. methyl, ethyl, isopropyl, n-butyl, and t-butyl), an aryl group (e.g. 3-methanesulfonylamynophenyl), an alkylcarbonamido group (e.g. acetylamino, propionylamino, and butyroylamino), an arylcarbonamido group (e.g. benzoylamino), an alkylsulfonamido group (e.g. methanesulfonylamino and ethanesulfonylamino), an arylsulfonamido group (e.g. benzenesulfonylamino and toluenesulfonylamino), an alkoxy group (e.g. methoxy and ethoxy), an aryloxy group (e.g. 4-methanesulfonylaminophenoxy), an alkylthio group (e.g. methylthio, ethylthio, and butylthio), an arylthio group (e.g. 4-methanesulfonylaminophenylthio), an alkylcarbamoyl group (e.g. methylcarbamoyl, dimethylcarbamoyl, ethylcarbamoyl, diethylcarbamoyl, dibutylcarbamoyl, piperidinocarbamoyl, and morpholinocarbamoyl), an arylcarbamoyl group (e.g. phenylcarbamoyl, methylphenylcarbamoyl, ethylphenylcarbamoyl, and benzylphenylcarbamoyl), a carbamoyl group, an alkylsulfamoyl group (e.g. methylsulfamoyl, dimethylsulfamoyl, ethylsulfamoyl, diethylsulfamoyl, dibutylsulfamoyl, piperidinosulfamoyl, and morpholinosulfamoyl), an arylsulfamoyl group (e.g. phenylsulfamoyl, methylphenylsulfamoyl, ethylphenylsulfamoyl, and benzylphenylsulfamoyl), a sulfamoyl group, a cyano group, an alkylsulfonyl group (e.g. methanesulfonyl and ethanesulfonyl), an arylsulfonyl group (e.g. phenylsulfonyl, 4-chlorophenylsulfonyl, and p-toluenesulfonyl), an alkoxycarbonyl group (e.g. methoxycarbonyl, ethoxycarbonyl, and butoxycarbonyl), an aryloxycarbonyl group (e.g. phenoxycarbonyl), an alkylcarbonyl group (e.g. acetyl, propionyl, and butyloyl), an arylcarbonyl group (e.g. benzoyl and alkylbenzoyl), or an acyloxy group (e.g. acetyloxy, propionyloxy, and butyloyloxy). In formulas when $R_1$ and $R_2$, $R_3$ and $R_4$, $R_6$ and $R_7$, $R_7$ and $R_8$, and $R_8$ and $R_9$ each represent a substituent other than a hydrogen atom, the two of each of the combinations of groups may independently bond together to form a ring, within the above I/O value condition.

The amount of the silver-developing reducing agent to be used is preferably 1 to 100 mol % and more preferably 10 to 50 mol % of the color-developing agent to be used.

The compounds represented by formula (1) or (2) can be synthesized by combining, stepwise, methods widely known in the field of organic synthesis chemistry. Examples of the stepwise synthetic method are described below with synthesis schemes shown below.

Synthesis Route of Exemplified Compounds

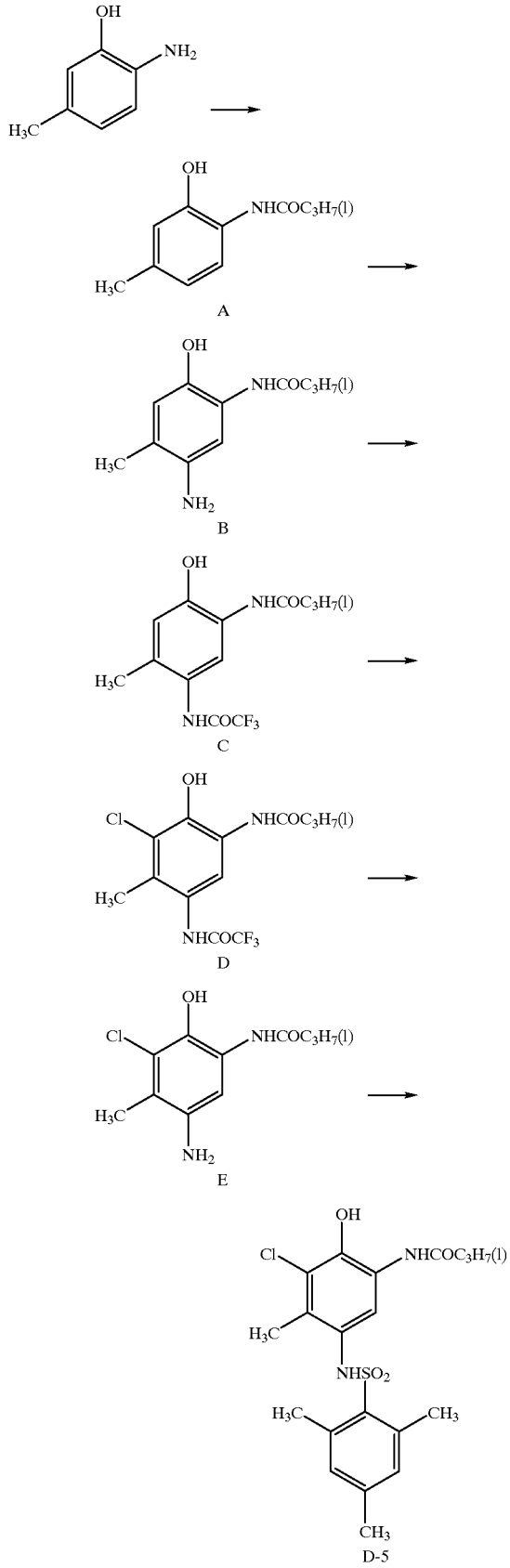

-continued

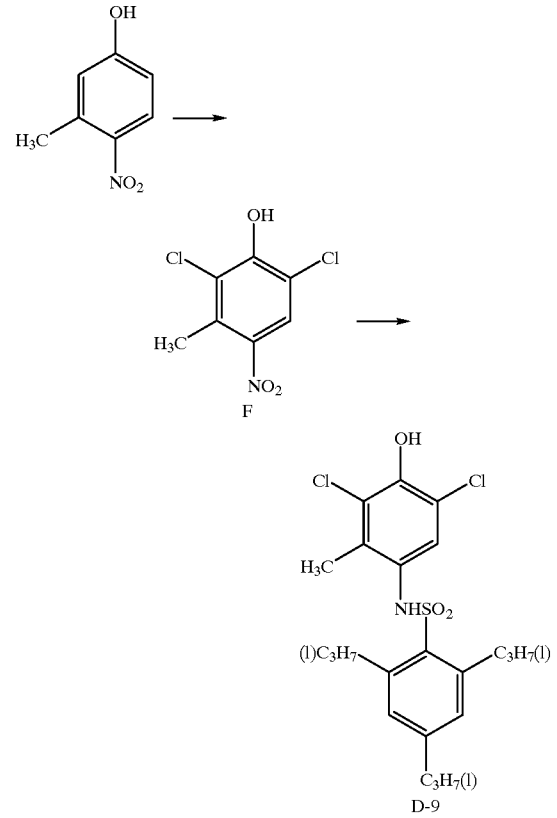

Synthesis of Exemplified Compound D-5

1) Synthesis of Compound A 766 g (5 mol) of 6-amino-m-cresol and 2,000 ml of acetonitrile were charged into a 5-liter three-necked flask equipped with a condenser, a thermometer, a dropping funnel, and a mechanical agitator, and they were stirred at room temperature. At that time, the solution was in the form of a non-uniform slurry. When 791 g (5 mol) of isobutyric anhydride was added thereto over 30 min, the temperature rose gradually until it reached 60° C., finally, and the solution became uniform, finally. When the rising of the temperature stopped, crystals of the product began to precipitate in the flask. After stirring for one hour further, the contents were poured into 15 liters of a 10% brine, and the precipitated crystals were filtered through a Nutsche, under reduced pressure. After the crystals were washed with 2 liters of distilled water, they were dried. The crystals were so pure that they could be used in the next step as they were. Thus, 928 g of crystals of Compound A were obtained (yield: 96%).

2) Synthesis of Compound B 193 g (1 mol) of Compound A was charged into a 10-liter beaker, and 500 ml of methanol and an aqueous solution of 120 g (30 mol) of sodium hydroxide dissolved in 500 ml of water were added thereto. This solution was continually stirred with the temperature kept at 0° C. or less. On the other hand, 216 g (1.25 mol) of sulfanilic acid was dissolved completely in an aqueous solution of 50 g of sodium hydroxide dissolved in 400 ml of water. 300 ml of concentrated hydrochloric acid was added thereto, to form a solution in the form of a slurry. While this liquid was stirred vigorously with the temperature kept at 0° C. or less, a solution of 93 g (1.35 mol) of sodium nitrite dissolved in 200 ml of water was added gradually thereto, to produce a diazonium salt. At that time, the reaction was allowed to take place while ice was added appropriately, so that the temperature would be kept at 0° C. or less. The diazonium salt prepared in this way was added gradually to the above solution of Compound A that was kept stirred. At that time, again, the reaction was allowed to take place while ice was added appropriately, so that the temperature would be kept at 0° C. or less. With the addition, the solution assumed the red color of an azo dye. After completion of the addition, the reaction was allowed to proceed for 30 min further at 0° C. or less, and upon recognition of the disappearance of the raw material, 750 g (4.5 mol) of a powder of sodium hydrosulfite was added thereto. When this solution was heated to 50° C., reduction of the azo group took place, with vigorous bubbling. When the bubbling subsided and the liquid was decolored, to become a yellowish transparent liquid, the solution was cooled gradually to 10° C. From the time of about the start of the cooling, crystals began to deposit gradually. The deposited crystals were filtered, and the crude crystals were recrystallized from a mixed solvent of methanol and water, to obtain 162 g of crystals of Compound B (yield: 78%).

3) Synthesis of Compound C 833 g (4 mol) of Compound B and 2,000 ml of acetonitrile were charged into a 5-liter three-necked flask equipped with a condenser, a thermometer, a dropping funnel, and a mechanical agitator, and they were stirred at room temperature. At that time, the solution was in the form of a non-uniform slurry. When 840 g (4 mol) of trifluoroacetic anhydride was added thereto over 30 min, the temperature rose gradually. It was cooled appropriately with an ice bath, so that the rise in the temperature would be up to 45° C. After completion of the dropwise addition, the solution became uniform. When the rise of the temperature stopped, crystals of the product began to precipitate in the flask. After stirring for one hour further, the contents were poured into 15 liters of a 10% brine, and the deposited crystals were filtered through a Nutsche, under reduced pressure. After the crystals were washed with 2 liters of distilled water, they were dried. The crystals were so pure that they could be used in the next step as they were. Thus, 1,132 g of crystals of Compound C were obtained (yield: 93%).

4) Synthesis of Compound D 913 g (3 mol) of Compound C and 2,500 ml of dichloromethane were charged into a 5-liter three-necked flask equipped with a condenser, a thermometer, a dropping funnel, and a mechanical agitator, and they were stirred at room temperature. At that time, the solution was in the form of a non-uniform slurry. When 540 g (4 mol) of sulfuryl chloride was added thereto over 30 min, the temperature rose gradually; then a gas was given off, and at the same time reflux was started. After completion of the dropwise addition, when the reaction was allowed to proceed for 2 hours further under reflux, the generation of the gas stopped. At that time the solution remained in the non-uniform state. After stirring for one hour further, the internal temperature was lowered to room temperature, and the contents were poured into 10 liters of n-hexane. The deposited crystals were filtered through a Nutsche, under reduced pressure, and after the crystals were washed with 2 liters of n-hexane, they were dried. The crystals were so pure that they could be used in the next step as they were. Thus, 904 g of crystals of Compound D were obtained (yield: 89%).

5) Synthesis of Compound E 224 g of potassium hydroxide and 1,200 ml of water were charged into a 3-liter three-necked flask equipped with a condenser, a thermometer, a dropping funnel, a nitrogen introduction tube, and a mechanical agitator, and the potassium hydroxide was dissolved completely. While nitrogen was passed through the solution, 678 g (2 mol) of Compound D, in the form of a powder, was added gradually thereto, and after completion of the addition, the internal temperature was elevated to 60° C. At that time, the solution changed from a non-uniform slurry to a uniform solution. After stirring for 2 hours further, the internal temperature was lowered to room temperature, and, when 200 ml of acetic acid was added, crystals deposited. The deposited crystals were filtered through a Nutsche, under reduced pressure. After the crystals were washed with cold distilled water, they were recrystallized from a methanol/water mixed solvent, to obtain 403 g of crystals of Compound E (yield: 83%).

6) Synthesis of Exemplified Compound D-5

971 g (4 mol) of Compound E and 2,800 ml of acetonitrile were charged into a 5-liter three-necked flask equipped with a condenser, a thermometer, a dropping funnel, and a mechanical agitator, and they were stirred at room temperature. At that time, the solution was in the form of a non-uniform slurry. When 875 g (4 mol) of a powder of mesitylenesulfonyl chloride was added thereto over 10 min, the temperature rose gradually. It was cooled appropriately with an ice bath, so that the rise in the temperature would be up to 30° C. After completion of the addition, it was cooled with an ice bath, so that the internal temperature would be 15° C. or less, and then 324 ml (4 mol) of pyridine was added, dropwise, thereto over 10 min. After completion of the dropwise addition, the reaction was allowed to proceed for 2 hours at room temperature, with stirring. After a while, crystals of the product began to deposit in the flask. After completion of the reaction, the contents were poured into 20 liters of a 3% aqueous hydrochloric acid solution, and the deposited crystals were filtered through a Nutsche, under reduced pressure. After the crystals were washed with 4 liters of distilled water, they were recrystallized from an acetonitrile/water mixed solvent, to obtain 1,564 g of crystals of Exemplified Compound D-5 (yield: 92%).

Synthesis of Exemplified Compound D-9

1) Synthesis of Compound F 153 g (1 mol) of 4-nitro-m-cresol and 1,000 ml of methanol were charged into a 5-liter three-necked flask equipped with a condenser, a thermometer, a dropping funnel, and a mechanical agitator, and they were stirred at room temperature. At that time, the solution was in the form of a non-uniform slurry. 2 liters of an aqueous sodium hypochlorite solution (available chlorine: 5%) was added thereto, dropwise, with care taken so that the internal temperature did not exceed 50° C. At the time of the dropwise addition, the color of the solution turned reddish-brown. After completion of the dropwise addition, when 500 g (3 mol) of a powder of sodium hydrosulfite was added thereto gradually, reduction of the nitro group took place, with vigorous bubbling. At that time, care had to be taken that the internal temperature did not exceed 60° C. and bubbling did not become too vigorous. When the bubbling stopped and the liquid was decolored, to become a yellowish transparent liquid, the solution was cooled gradually to 10°

C. From about the time of the start of the cooling, crystals deposited gradually. The deposited crystals were filtered, and the crude crystals were recrystallized from a mixed solvent of methanol and water, to obtain 142 g of crystals of Compound F (yield: 74%).

2) Synthesis of Exemplified Compound D-9

768 g (4 mol) of Compound F, 1,500 ml of acetonitrile, and 1,100 ml of N,N-dimethylacetamide (DMAc) were charged into a 5-liter three-necked flask equipped with a condenser, a thermometer, a dropping funnel, and a mechanical agitator, and they were stirred at room temperature. At that time, the solution became uniform. When 1,212 g (4 mol) of a powder of triisopropylbenzenesulfonyl chloride was added thereto over 10 min, the temperature rose gradually. It was cooled appropriately with an ice bath, so that the rise in the temperature would be up to 30° C. After completion of the addition, it was cooled with an ice bath, so that the internal temperature would be 15° C. or less, and then 324 ml (4 mol) of pyridine was added, dropwise, thereto over 10 min. After completion of the dropwise addition, the reaction was allowed to proceed for 2 hours at room temperature, with stirring. After completion of the reaction, the contents were poured into 20 liters of a 3% aqueous hydrochloric acid solution, and the deposited crystals were filtered through a Nutsche, under reduced pressure. After the crystals were washed with 4 liters of distilled water, they were recrystallized from a mixed solvent of methanol and water, to obtain 1,669 g of crystals of Exemplified Compound D-9 (yield: 91%).

Specific examples of the compounds represented by formula (1) or (2) are shown below, which of course are not meant to limit the present invention.

D-1

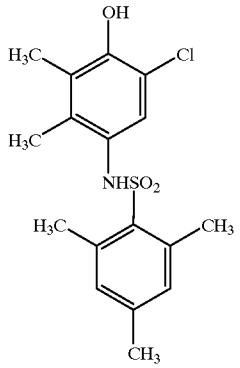

D-2

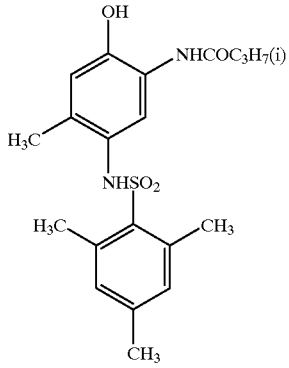

-continued

D-3

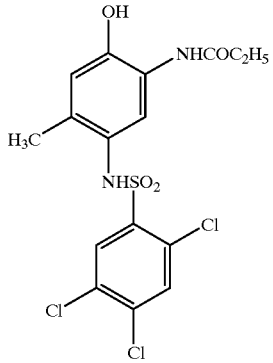

D-4

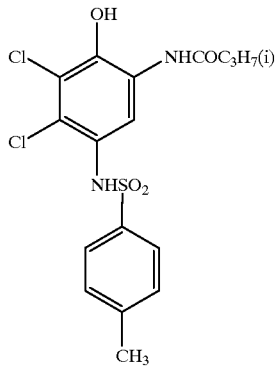

D-5

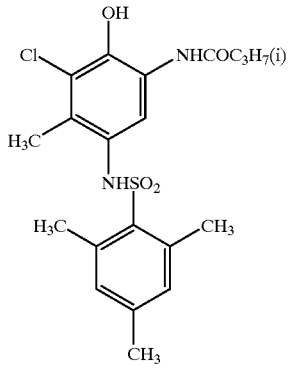

D-6

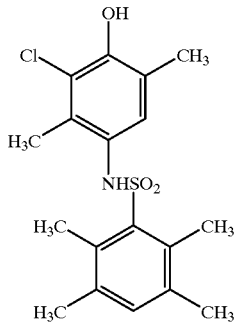

-continued
D-7
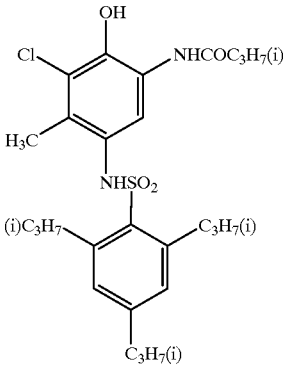
D-8
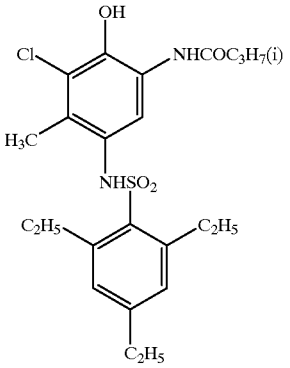
D-9
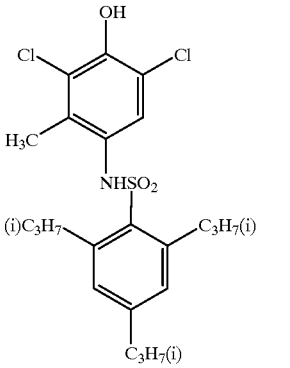
D-10
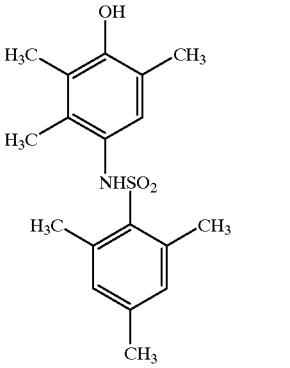
-continued
D-11
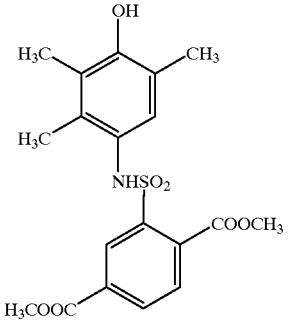
D-12
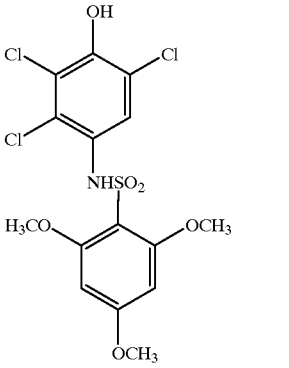
D-13
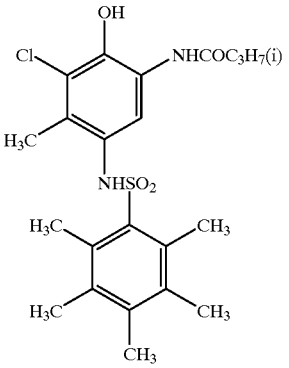
D-14
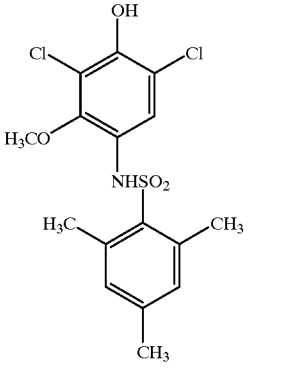

-continued
D-15
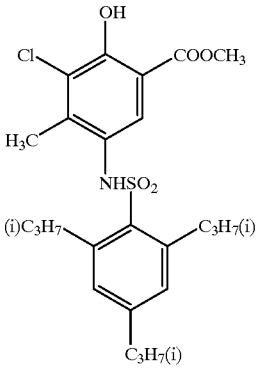
D-16
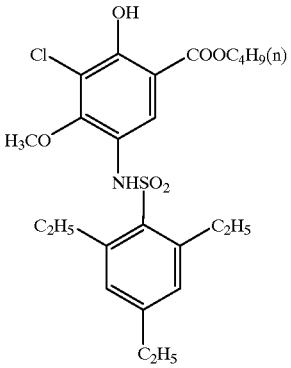
D-17
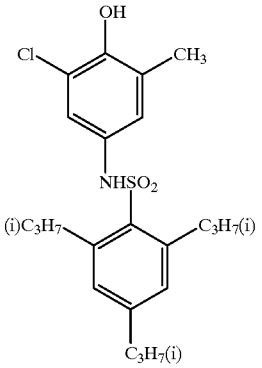
D-18
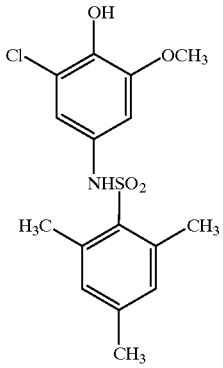
-continued
D-19
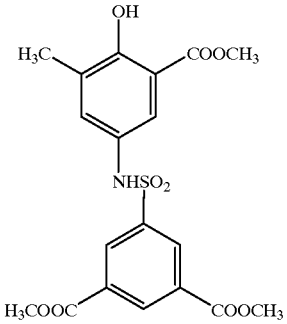
D-20
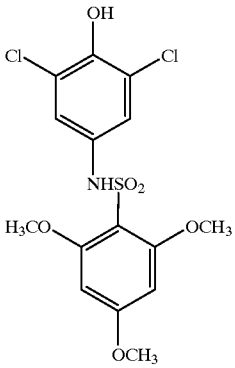
D-21
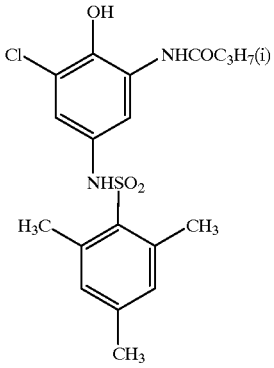
D-22
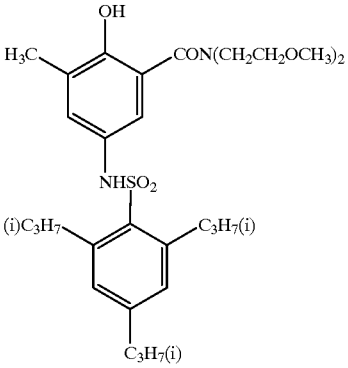

-continued
D-23
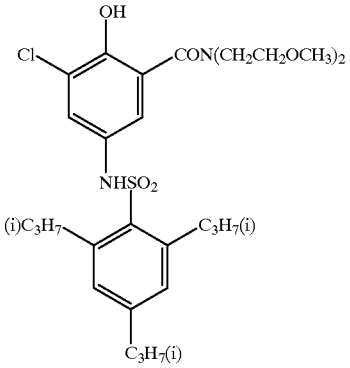
D-24
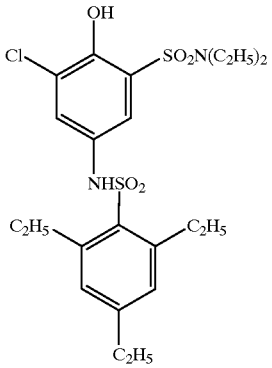
D-25
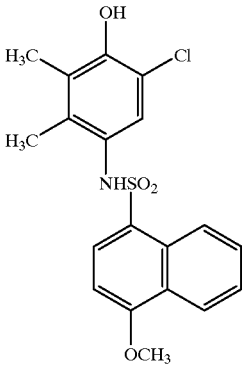
D-26
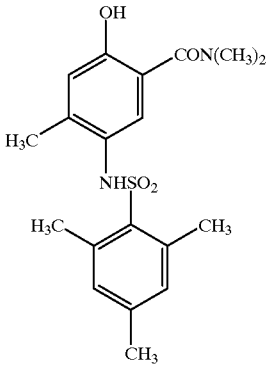
-continued
D-27
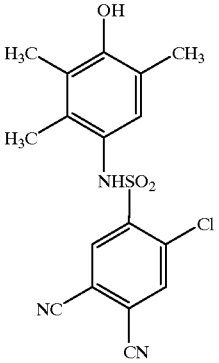
D-28
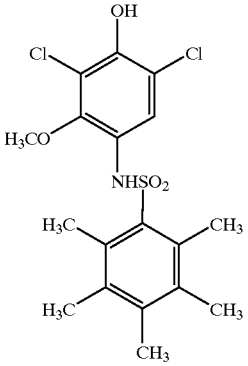
D-29
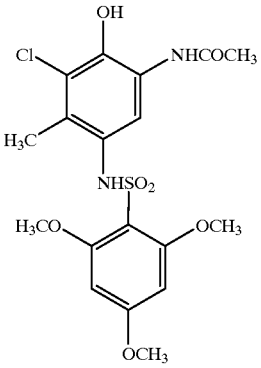
D-30
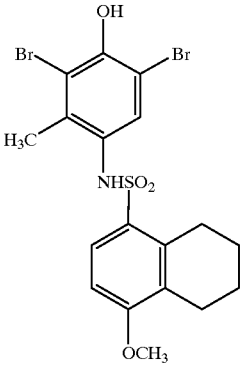

-continued
D-31
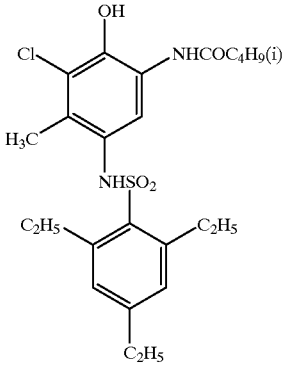
D-32
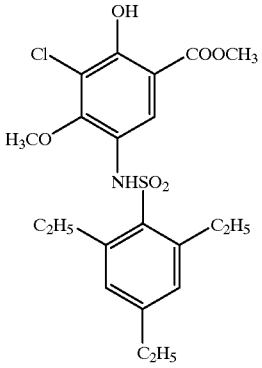
D-33
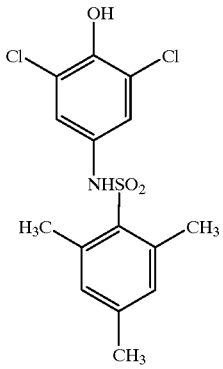
D-34
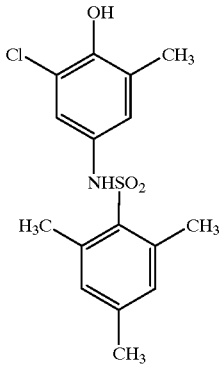
-continued
D-35
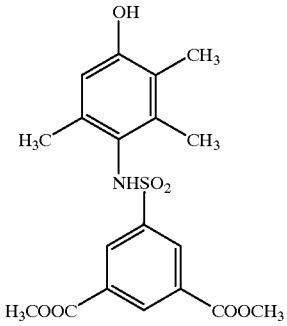
D-36
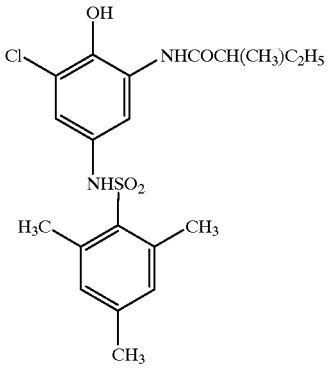
D-37
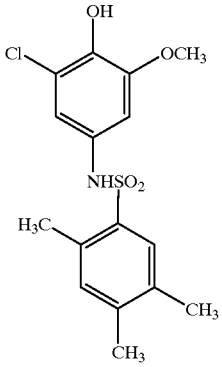
D-38
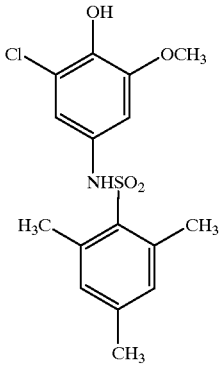

-continued
D-39
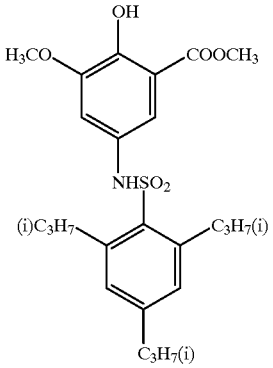
D-40
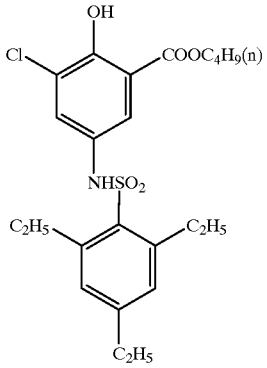
D-41
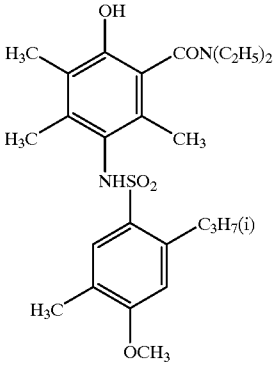
D-42
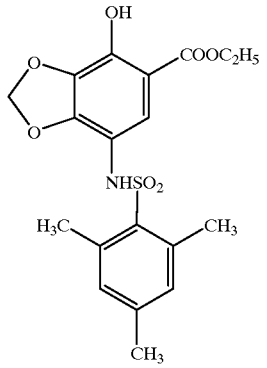
-continued
D-43
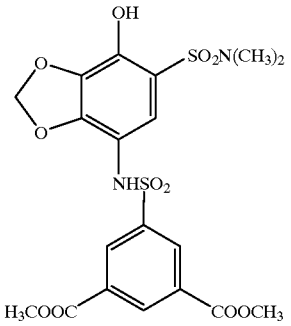
D-44
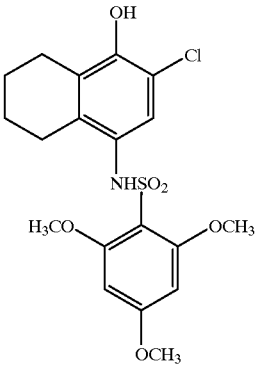
D-45
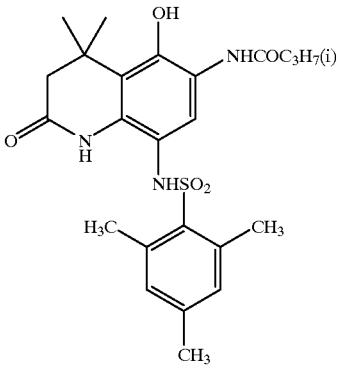
D-46
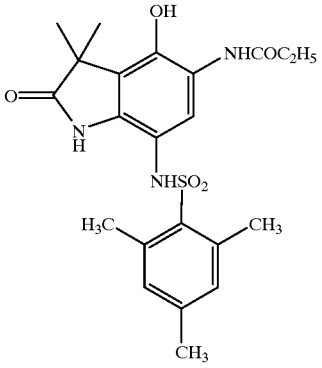

-continued
D-47
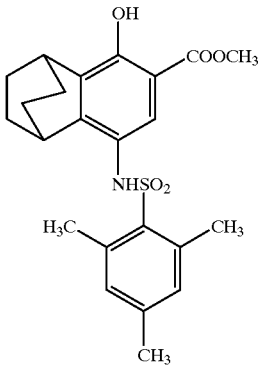
D-48
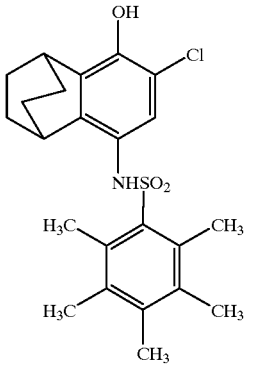
D-49
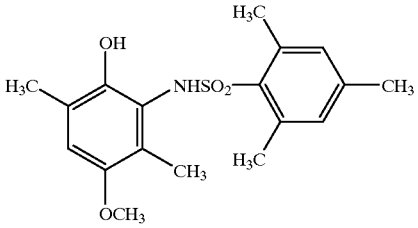
D-50
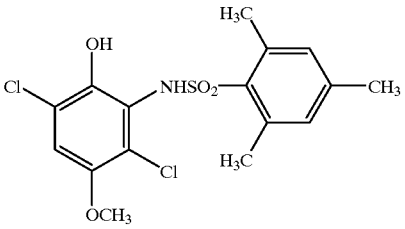
D-51
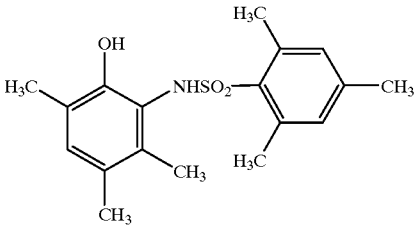
-continued
D-52
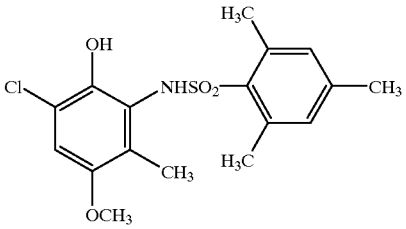
D-53
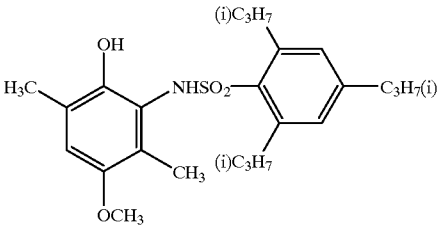
D-54
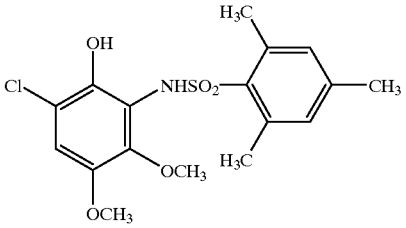
D-55
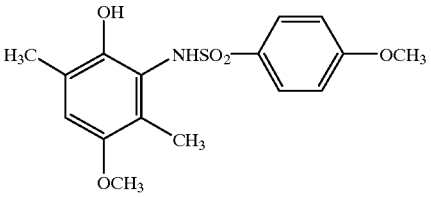
D-56
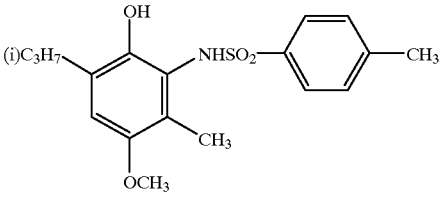
D-57
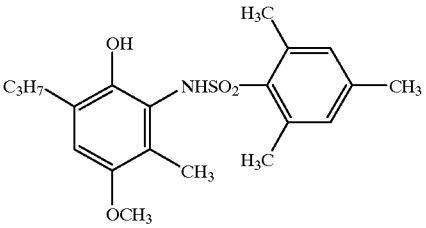
D-58
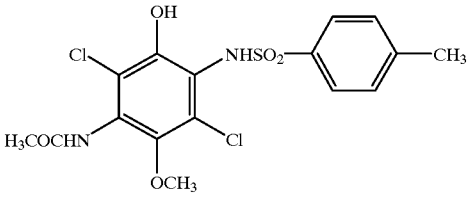

-continued

D-59

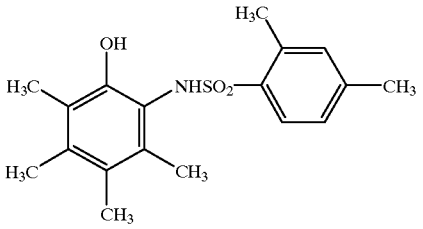

D-60

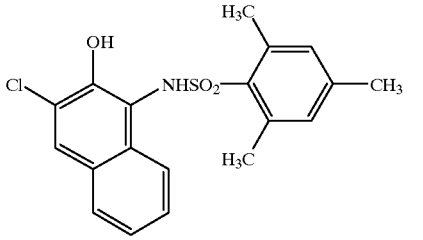

D-61

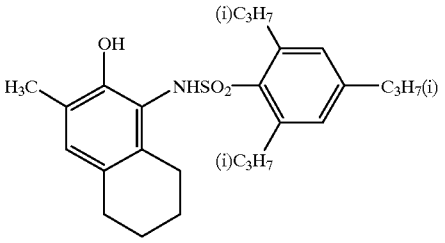

D-62

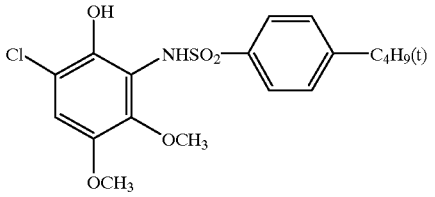

D-63

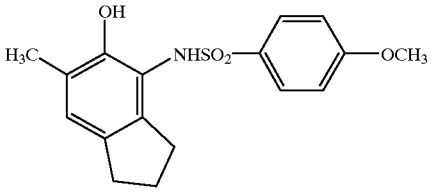

D-64

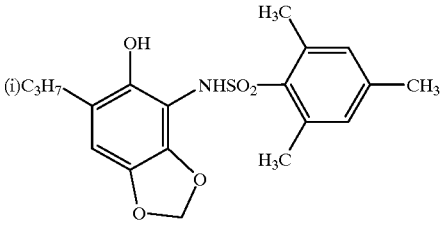

As the color-image-forming reducing agent used in the present invention, for example, an aromatic primary amine-series color developing agent and a hydrazine-series color developing agent can be used. In the present invention, since the color developing agent is built in the light-sensitive material and the oxidized product thereof is coupled with the coupler to form a color, high color formability and excellent stock stability are required, and because of the formation of a diffusion dye that will be formed by the oxidation coupling reaction and because of the relation to the silver-developing reducing agent, a carbamoylhydrazine-series color developing agent having a structure as described in JP-A-8-286340 is preferably used.

Namely, that is a compound represented by the following formula (D-I) or (D-II):

formula (D-1)

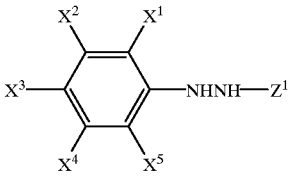

$R^3$—NHNH—$Z^2$ formula (D-II)

wherein $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$, and $X^5$, which may be the same or different, each represent a hydrogen atom or a substituent, with the proviso that the total of Hammett substituent constant σp values of $X^1$, $X^3$, and $X^5$, and Hammett substituent constant σm values of $X^2$ and $X^4$, is from 0.80 to 3.80; and $R^3$ represents a heterocyclic group.

The compound represented by formula (D-I) or (D-II), the color-developing agent, is preferably a compound represented by the following formula (D-III) or (D-IV), respectively:

formula (D-III)

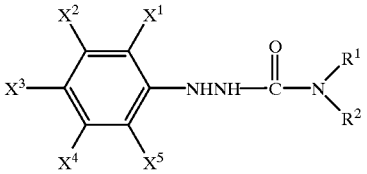

formula (D-IV)

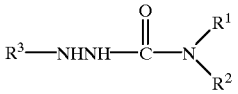

wherein $R^1$ and $R^2$ each represent a hydrogen atom or a substituent; $X^1$, $X^2$, $X^3$, $X^4$, and $X^5$, which may be the same or different, each represent a hydrogen atom or a substituent, with the proviso that the total of Hammett substituent constant σp values of $X^1$, $X^3$, and X5, and Hammett substituent constant σm values of $X^2$ and $X^4$, is from 0.80 to 3.80; and $R^3$ represents a heterocyclic group.

The color-developing agent represented by formula (D-III) is more preferably a compound represented by formula (D-V), and the color-developing agent represented by formula (D-IV) is more preferably a compound represented by formula (D-VI) or (D-VII):

formula (D-V)

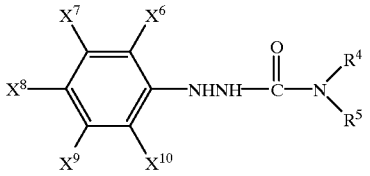

formula (D-VI)

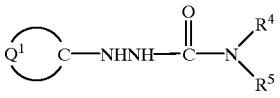

formula (D-VII)

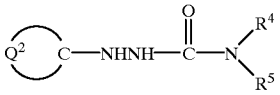

wherein $R^4$ and $R^5$ each represent a hydrogen atom or a substituent; $X^6$, $X^7$, $X^8$, $X^9$, and $X^{10}$, which may be the same or different, each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, with the proviso that the total of Hammett substituent constant σp values of $X^6$, $X^8$, and $X^{10}$, and Hammett substituent constant σm values of $X^7$ and $X^9$, is from 1.20 to 3.80, and more preferably from 1.50 to 3.80; $Q^1$ represents a group of nonmetallic atoms necessary to form a nitrogen-containing five- to eight-membered heterocycle together with the C; and $Q^2$ represents a group of nonmetal atoms required to form together with C a nitrogen-containing 5- to 8-membered ring fused with a benzene ring or a heterocyclic ring.

Details of the compounds represented by formulae (D-I) to (D-VII) are described on pages 4 to 7 of the specification of the above unexamined published Japanese patent application. Specific examples (1) to (80) of the compounds represented by formulae (D-I) and (D-II) described on pages 7 to 22 of said specification can be used as the color-developing agent for use in the present invention.

Couplers preferably used in the present invention are compounds having structures represented by formulae (1) to (12) described in JP-A-9-152705. Specifically a coupler of the following structure can be used.

(C-1)

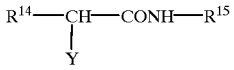

(C-2)

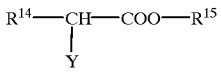

(C-3)

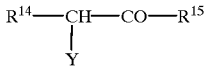

-continued (C-4)

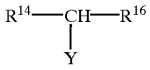

(C-5)

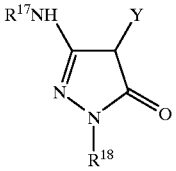

(C-6)

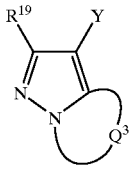

(C-7)

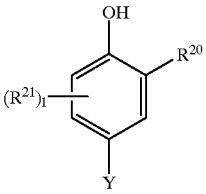

(C-8)

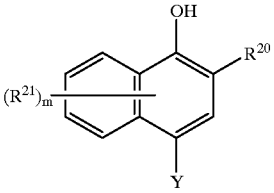

(C-9)

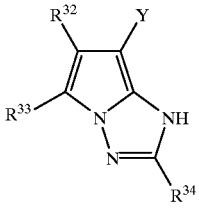

(C-10)

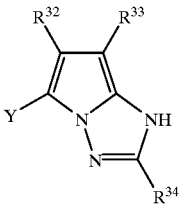

(C-11)

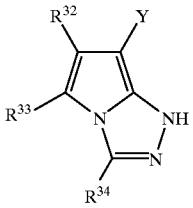

-continued (C-12)

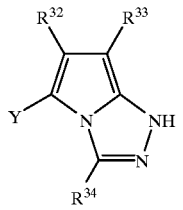

Formulae (C-1) to (C-4) represent couplers that are called active methylene couplers, and, in the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, each of which may optionally be substituted.

In formulae (C-1) to (C-3), $R^{15}$ represents an optionally substituted alkyl group, aryl group, or heterocyclic residue. In formula (C-4), $R^{16}$ represents an optionally substituted aryl group or heterocyclic residue. Examples of the substituent that may be possessed by $R^{14}$, $R^{15}$, and $R^{16}$ include those mentioned for the above as examples of the substituent on the ring that is formed with Q and $C_\alpha$.

In formulae (C-1) to (C-4), Y is a group that renders the coupler nondiffusible and that is capable of coupling split-off by the coupling reaction with the oxidized product of a developing agent. Examples of the structure of the coupling split-off part of Y are a heterocyclic group (a saturated or unsaturated 5-membered to 7-membered monocyclic or condensed ring having as a hetero atom at least one nitrogen atom, oxygen atom, sulfur atom, or the like, e.g. succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzothiazolin-2-one, 2-pyrrolin-5-one, 2-imidazolin-5-one, indolin-2,3-dione, 2,6-dioxypurine, parabic acid, 1,2,4-triazolidin-3,5-dione, 2-pyridone, 4-pyridone, 2-pyrimidone, 6-pyridazone, 2-pyrazone, 2-amino-1,3,4-thiazolidine, and 2-imino-1,3,4-thiazolidin-4-one), a halogen atom (e.g. a chlorine atom and a bromine atom), an aryloxy group (e.g. phenoxy and 1-naphthoxy), a heterocyclic oxy group (e.g. pyridyloxy and pyrazolyoxy), an acyloxy group (e.g. cyclohexylcarbonyloxy and benzoyloxy), an alkoxy group, a carbamoyloxy group (e.g. N,N-didodecylcarbamoyloxy and morpholinocarbonyloxy), an aryloxycarbonyloxy group (e.g. phenoxylcarbonyloxy), an alkoxycarbonyloxy group, an arylthio group (e.g. phenylthio and naphthylthio), a heterocyclic thio group (e.g. tetrazolylthio, 1,3,4-thiadiazolylthio, 1,3,4-oxadiazolylthio, and benzimidazolylthio), an alkylthio group (e.g. methylthio, octylthio, and hexadecylthio), an alkylsulfonyloxy group, an arylsulfonyloxy group (e.g. benzenesulfonyloxy and toluenesulfonyloxy), a carbonamido group (e.g. undecylcarbonylamino and phenylcarbonylamino), a sulfonamido group (e.g. dodecylsulfonamido and benzenesulfonamido), an alkylsulfonyl group, an arylsulfonyl group (e.g. benzenesulfonyl), an alkylsulfinyl group (e.g. octylsulfinyl), an arylsulfinyl group (e.g. benzenesulfinyl), and a carbamoylamino group (e.g. N-hexadecylcarbamoylamino). Among these, preferable structures of the coupling split-off part of Y are an aryloxy group, a heterocyclic oxy group, an acyloxy group, a carbamoyloxy group, an aryloxycarbonyloxy group, an arylthio group, a heterocyclic thio group, an alkylsulfonyloxy group, and an arylsulfonyloxy group, and most preferably an aryloxy group, a heterocyclic oxy group, an acyloxy group, an aryloxycarbonyloxy group, an alkoxycarbonyloxy group, and a carbamoyloxy group.

Y may be substituted by a substituent to render the coupler nondiffusible, and examples of the substituent substituting on Y include those exemplifying the substituent on the ring formed by Q and Cα mentioned above. The total number of the carbon atoms contained in Y is preferably 6 or more but 50 or less, more preferably 8 or more but 40 or less, and most preferably 10 or more but 30 or less. In formulae (C-1) to (C-4), $R^{14}$ and $R^{15}$ together or $R^{14}$ and $R^{16}$ together may bond to form preferably a 5- to 7-membered ring and more preferably a 5- to 6-membered ring.

Formula (C-5) represents a coupler that is called a 5-pyrazolone coupler, and in the formula, $R^{17}$ represents an alkyl group, an aryl group, an acyl group, or a carbamoyl group. $R^{18}$ represents a phenyl group or a phenyl group that is substituted by one or more halogen atoms, alkyl groups, cyano groups, alkoxy groups, alkoxycarbonyl groups, or acylamino groups.

Preferable 5-pyrazolone couplers represented by formula (C-5) are those wherein $R^{17}$ represents an aryl group or an acyl group, and $R^{18}$ represents a phenyl group that is substituted by one or more halogen atoms. With respect to these preferable groups, more particularly, $R^{17}$ is an aryl group, such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidophenyl group, and a 2-chloro-5-[2-(4-hydroxy-3-t-butylphenoxy)tetradecaneamido]phenyl group; or $R^{17}$ is an acyl group, such as an acetyl group, a 2-(2,4-di-t-pentylphenoxy)butanoyl group, a benzoyl group, and a 3-(2,4-di-t-amylphenoxyacetamido)benzoyl group, any of which may have a substituent, such as a halogen atom or an organic substituent that is bonded through a carbon atom, an oxygen atom, a nitrogen atom, or a sulfur atom. Y has the same meaning as defined above. Preferably $R^{18}$ represents a substituted phenyl group, such as a 2,4,6-trichlorophenyl group, a 2,5-dichlorophenyl group, and a 2-chlorophenyl group.

Formula (C-6) represents a coupler that is called a pyrazoloazole coupler, and, in the formula, $R^{19}$ represents a hydrogen atom or a substituent. $Q^3$ represents a group of nonmetal atoms required to form a 5-membered azole ring containing 2 to 4 nitrogen atoms, which azole ring may have a substituent (including a condensed ring).

Preferable pyrazoloazole couplers represented by formula (C-6), in view of spectral absorption characteristics of the color-formed dyes, are imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067. Details of substituents of the azole rings represented by the substituents $R^{19}$ and $Q^3$ are described, for example, in U.S. Pat. No. 4,540,654, the second column, line 41, to the eighth column, line 27. Preferable pyrazoloazole couplers are pyrazoloazole couplers having a branched alkyl group directly bonded to the 2-, 3-, or 6-position of the pyrazolotriazole group, as described in JP-A-61-65245; pyrazoloazole couplers containing a sulfonamido group in the molecule, as described in JP-A-61-65245; pyrazoloazole couplers having an alkoxyphenylsulfonamido ballasting group, as described in JP-A-61-147254; pyrazolotriazole couplers having an alkoxy group or an aryloxy group at the 6-position, as described in JP-A-62-209457 or JP-A-63-307453; and pyrazolotriazole couplers having a carbonamido group in the molecule, as described in JP-A-2-201443. Y has the same meaning as defined above.

Formulae (C-7) and (C-8) are respectively called phenol couplers and naphthol couplers, and in the formulae $R^{20}$ represents a hydrogen atom or a group selected from the group consisting of —$CONRR^{22}R^{23}$, —$SO_2NR^{22}R^{23}$, —$NHCOR^{22}$, —$NHCONR^{22}R^{23}$, and —$NHSO_2NR^{22}R^{23}$. $R^{22}$ and $R^{23}$ each represent a hydrogen atom or a substituent. In formulae (C-7) and (C-8), $R^{21}$ represents a substituent, l is an integer selected from 0 to 2, and m is an integer selected from 0 to 4. When l and m are 2 or more, $R^{21}$'s may be different. Examples of the substituent of $R^{21}$ to $R^{23}$ include those mentioned for the above as examples of the substituent of the ring that is formed with Q and $C_\alpha$. Y has the same meaning as defined above.

Preferable examples of the phenol couplers represented by formula (7) include 2-acylamino-5-alkylphenol couplers described, for example, in U.S. Pat. No. 2,369,929, U.S. Pat. No. 2,801,171, U.S. Pat. No. 2,772,162, U.S. Pat. No. 2,895,826, and U.S. Pat. No. 3,772,002; 2,5-diacylaminophenol couplers described, for example, in U.S. Pat. No. 2,772,162, U.S. Pat. No. 3,758,308, U.S. Pat. No. 4,126,396, U.S. Pat. No. 4,334,011, and U.S. Pat. No. 4,327,173, West Germany Patent Publication No. 3 329 729, and JP-A-59-166956; and 2-phenylureido-5-acylaminophenol couplers described, for example, in U.S. Pat. No. 3,446,622, U.S. Pat. No. 4,333,999, U.S. Pat. No. 4,451,559, and U.S. Pat. No. 4,427,767. Y has the same meaning as defined above.

Preferable examples of the naphthol couplers represented by formula (C-8) include 2-carbamoyl-1-naphthol couplers described, for example, in U.S. Pat. No. 2,474,293, U.S. Pat. No. 4,052,212, U.S. Pat. No. 4,146,396, U.S. Pat. No. 4,282,233, and U.S. Pat. No. 4,296,200; and 2-carbamoyl-5-amido-1-naphthol couplers described, for example, in U.S. Pat. No. 4,690,889. Y has the same meaning as defined above.

Formulas (C-9) to (C-12) are couplers called pyrrolotriazoles, and $R^{32}$, $R^{33}$, and $R^{+}$each represent a hydrogen atom or a substituent. Y has the same meaning as defined above. Examples of the substituent of $R^{32}$, $R^{33}$ and $R^{34}$ include those mentioned for the above as examples of the substituent on the ring that is formed with Q and $C_\alpha$.

Preferable examples of the pyrrolotriazole couplers represented by formulae (C-9) to (C-12) include those wherein at least one of $R^{32}$ and $R^{33}$ is an electron-attracting group, which specific couplers are described in EP-A-488 248 (A1 ), EP-A-491 197 (A1), and EP-A-545 300. Y has the same meaning as defined above.

Further, a fused-ring phenol, an imidazole, a pyrrole, a 3-hydroxypyridine, an active methylene other than the above, an active methine, a 5,5-ring-fused heterocyclic, and a 5,6-ring-fused heterocyclic coupler, can be used.

As the fused-ring phenol couplers, those described, for example, in U.S. Pat. No. 4,327,173, U.S. Pat. No. 4,564,586, and U.S. Pat. No. 4,904,575, can be used. As the imidazole couplers, those described, for example, in U.S. Pat. No. 4,818,672 and U.S. Pat. No. 5,051,347, can be used. As the 3-hydroxypyridine couplers, those described, for example, in JP-A-1-315736, can be used. As the active methylene and active methine couplers, those described, for example, in U.S. Pat. No. 5,104,783 and U.S. Pat. No. 5,162,196, can be used. As the 5,5-ring-fused heterocyclic couplers, for example, pyrrolopyrazole couplers described in U.S. Pat. No. 5,164,289, and pyrroloimidazole couplers described in JP-A-4-174429, can be used. As the 5,6-ring-fused heterocyclic couplers, for example, pyrazolopyrimidine couplers described in U.S. Pat. No. 4,950,585, pyrrolotriazine couplers described in JP-A-4-204730, and couplers described in European patent No. 556 700, can be used.

Out of the above compounds, particularly preferably the compound represented by formula (C-6) is used as the yellow coupler, the compound represented by formula (C-6) or (C-7) is used as the magenta coupler, and the compound represented by any one of formulae (C-7) to (C-12) is used as the cyan coupler.

In the coupler used in the present invention, the total number of the carbon atoms excluding the carbon atoms in Y is preferably 1 or more but 30 or less, more preferably 1 or more but 24 or less, and most preferably 1 or more but 18 or less. Specific examples of the couplers that can be used in the present invention are shown below, but, of course, the present invention is not limited to them:

(C-1)

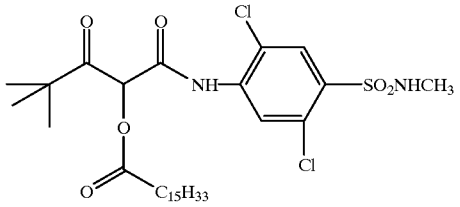

(C-2)

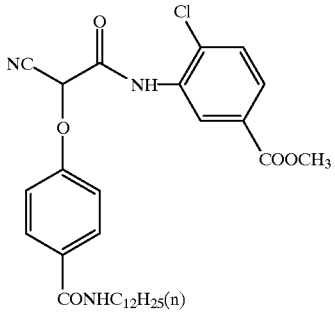

-continued
(C-3)
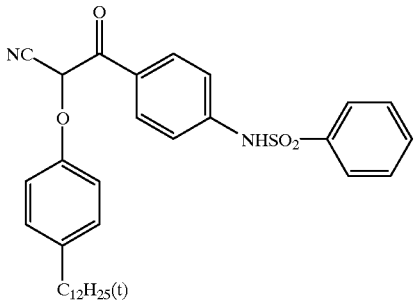
(C-4)
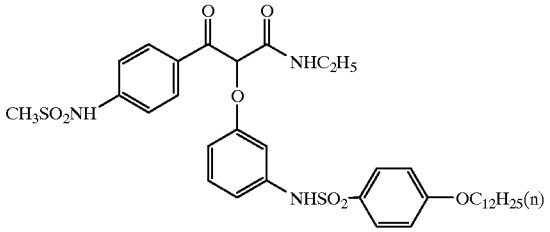
(C-5)
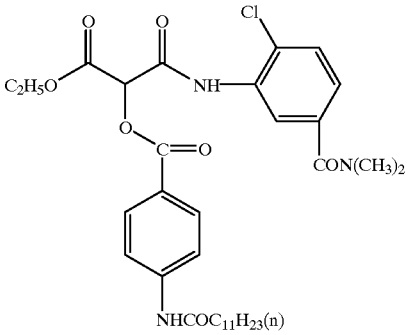
(C-6)
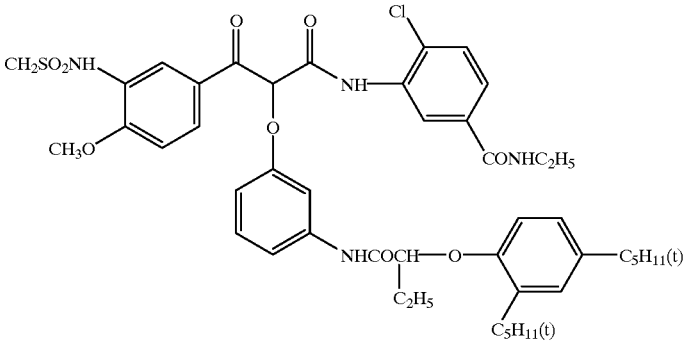
(C-7)
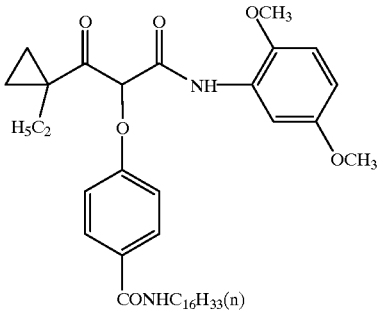
(C-8)
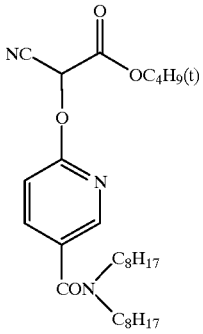

-continued
(C-9)
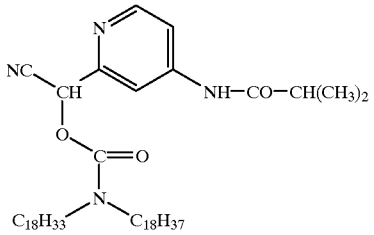
(C-10)
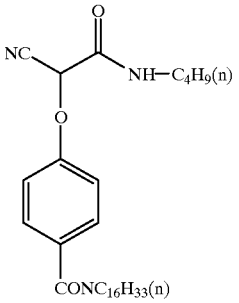
(C-11)
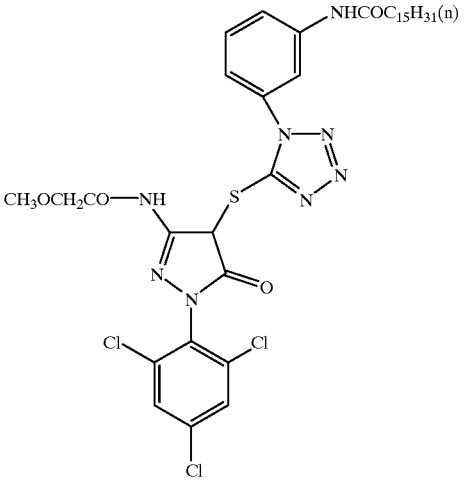
(C-12)
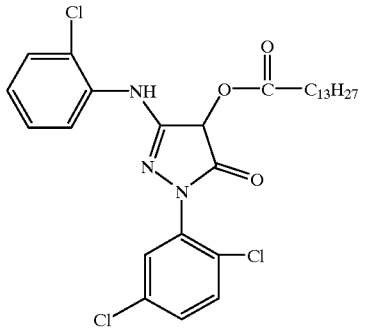
(C-13)
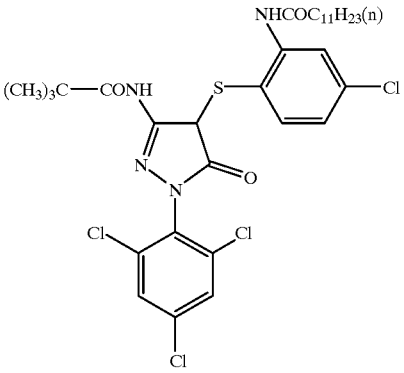
(C-14)
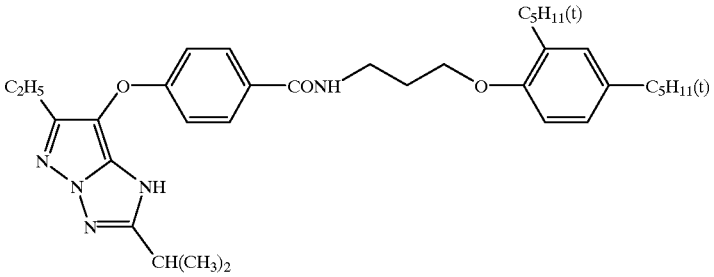

-continued
(C-15)
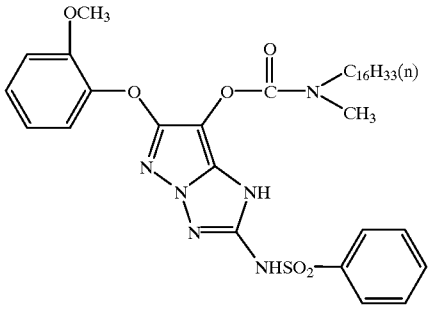
(C-16)
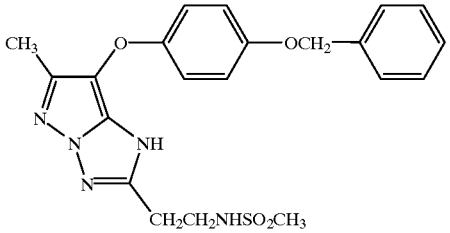
(C-17)
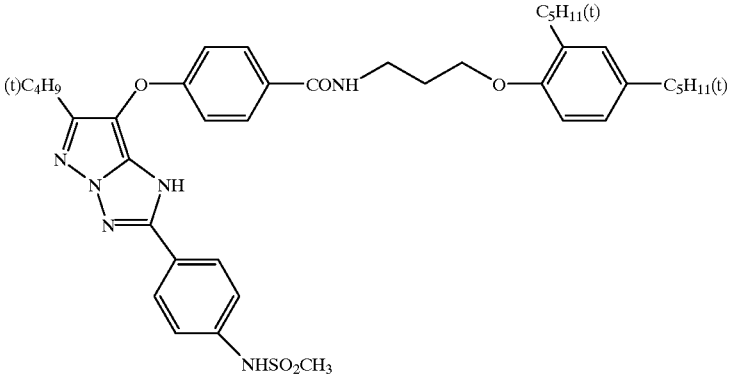
(C-18)
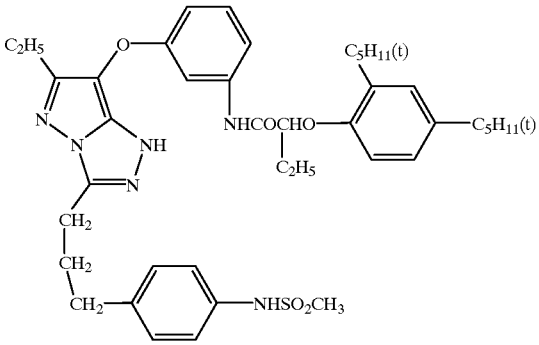
(C-19)
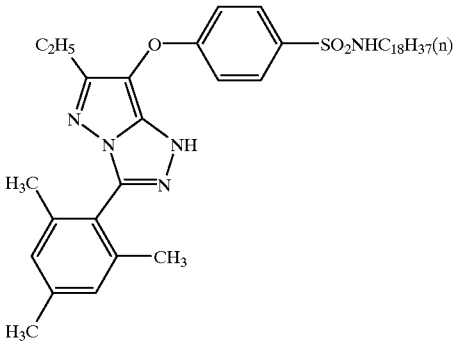
(C-20)
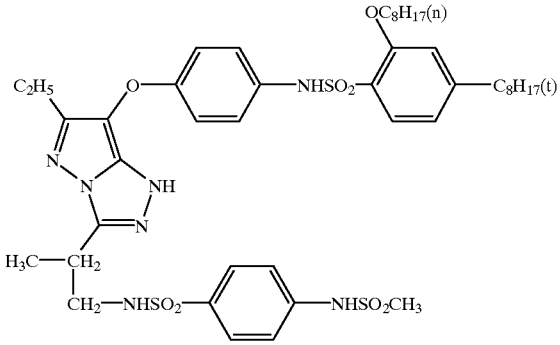
(C-21)
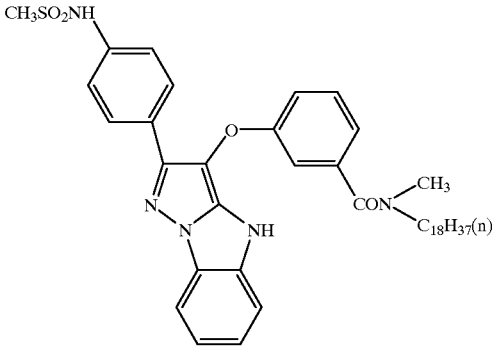

-continued
(C-22)
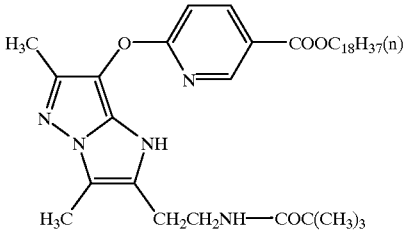
(C-23)
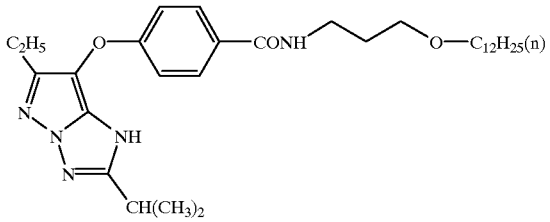
(C-24)
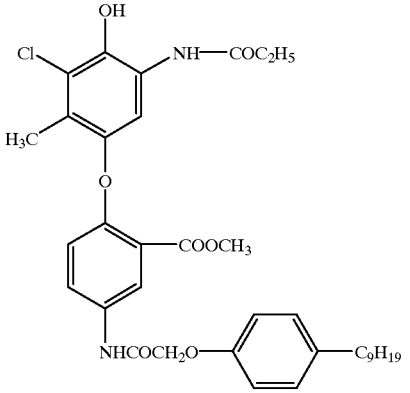
(C-25)
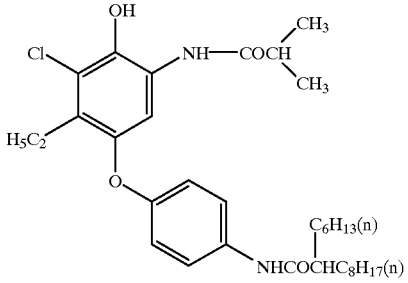
(C-26)
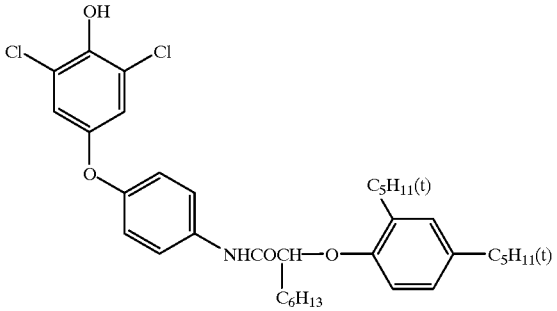
(C-27)
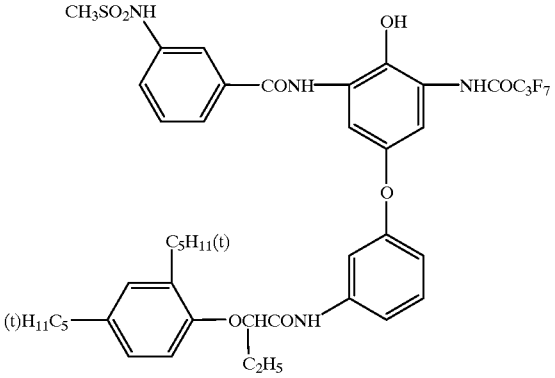
(C-28)
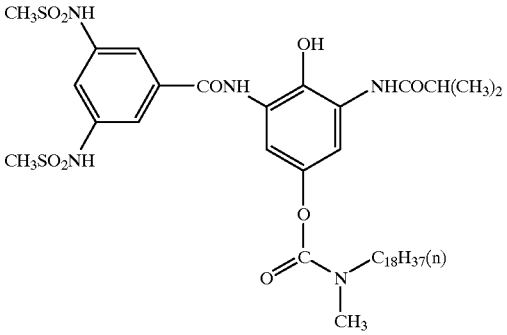
(C-29)
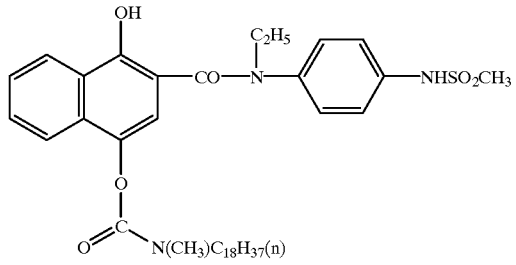

-continued
(C-30)
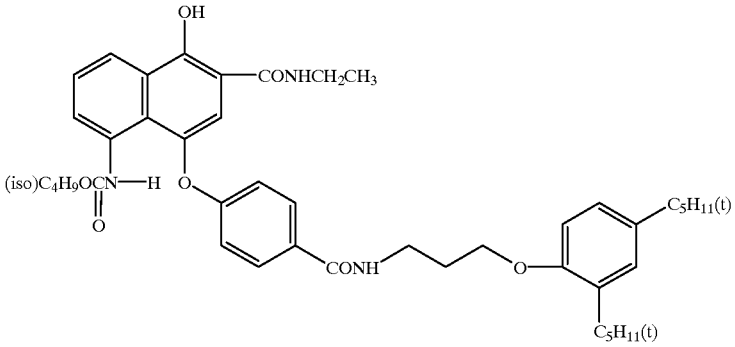
(C-31)
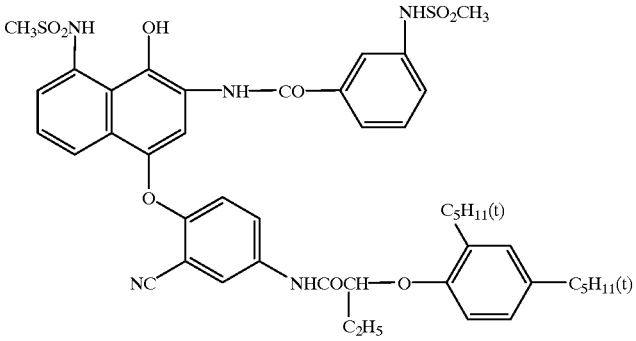
(C-32)
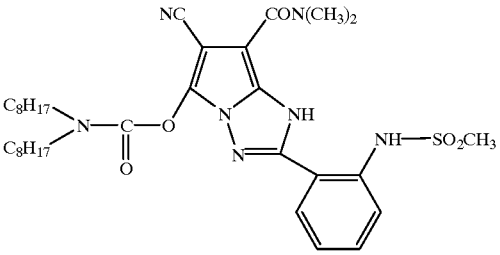
(C-33)
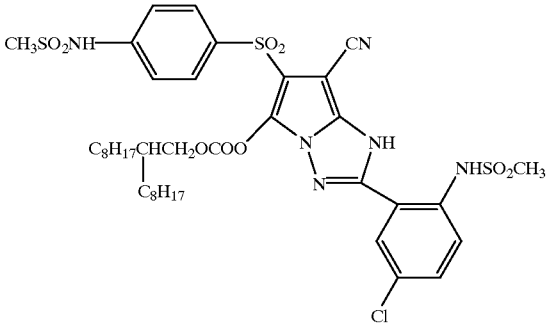
(C-34)
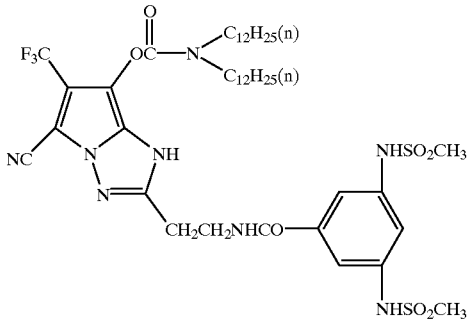
(C-35)
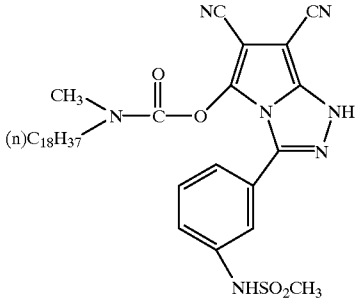

-continued
(C-36)
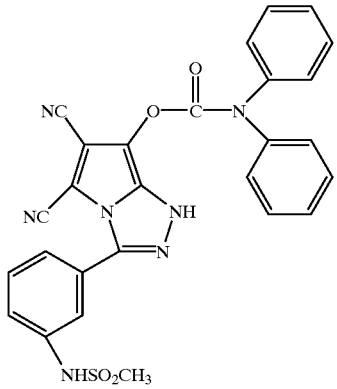
(C-37)
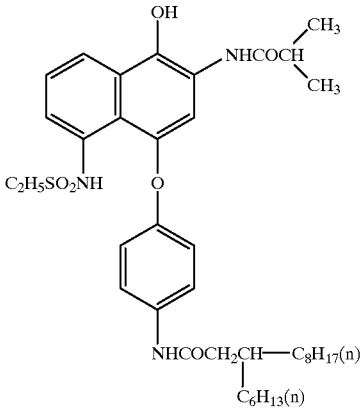
(C-38)
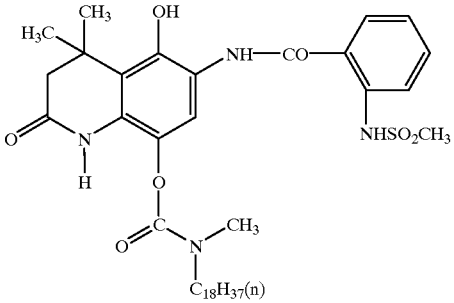
(C-39)
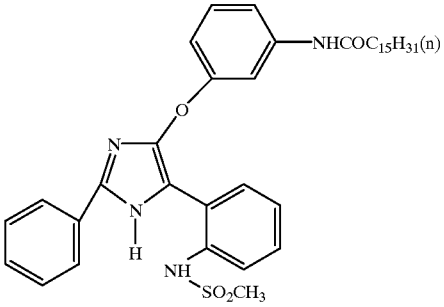
(C-40)
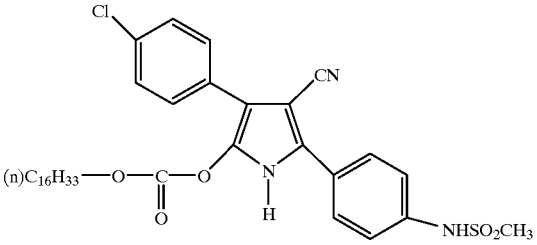
(C-41)
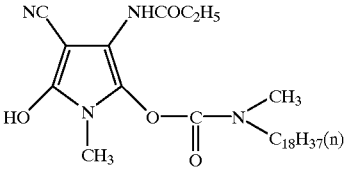
(C-42)
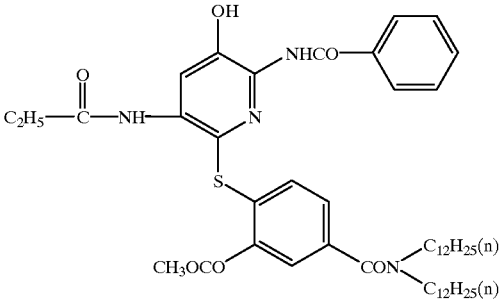
(C-43)
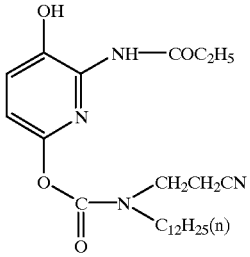
(C-44)
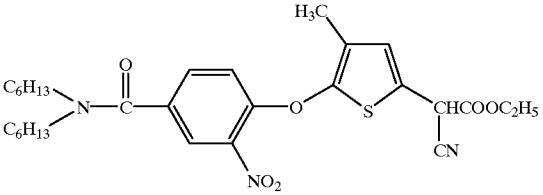

-continued (C-45)

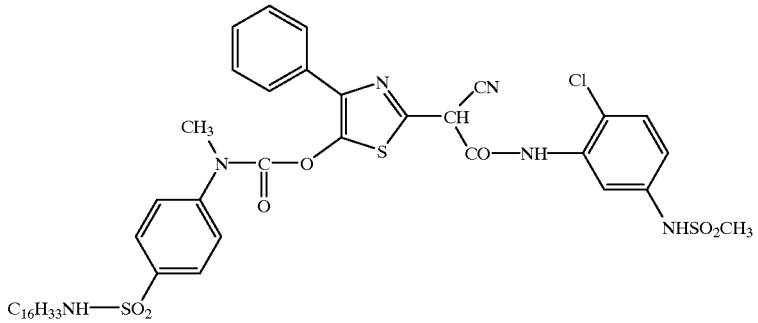

(C-46)

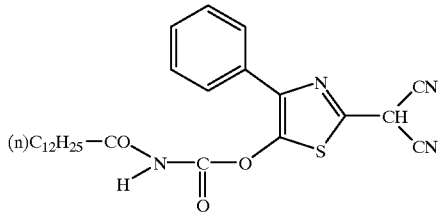

(C-47)

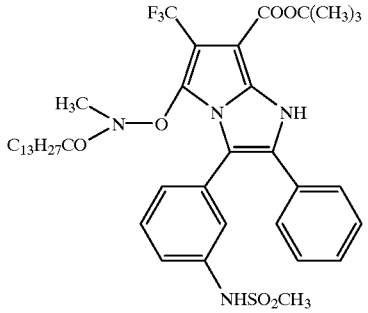

(C-48)

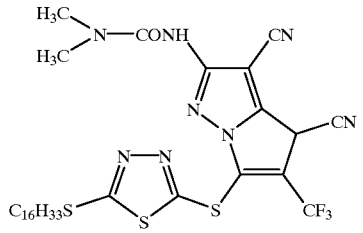

(C-49)

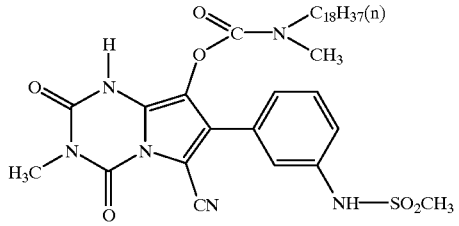

(C-50)

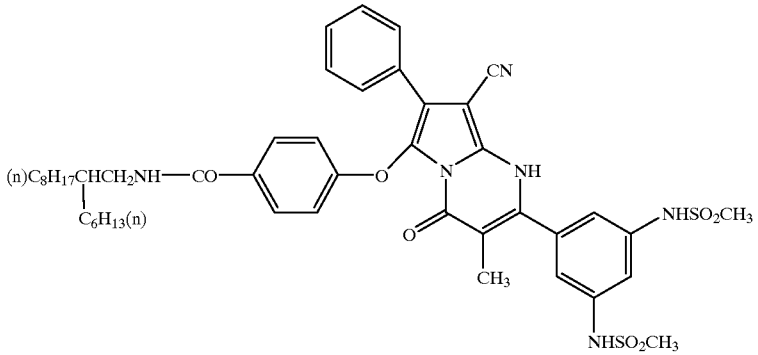

The amount to be added of the coupler that is used in the present invention, varies according to a molar extinction coefficient ($\epsilon$) of the dye to be formed. In order to obtain an image density of 1.0 or more in terms of reflection density, in the case of the coupler wherein the $\epsilon$ of the dye that will be produced by coupling is of the order of 5,000 to 500,000, suitably the amount to be added, of the coupler that is used in the present invention, is of the order of generally 0.001 to 100 mmol/m$^2$, preferably 0.01 to 10 mmol/m$^2$, and more preferably 0.05 to 5 mmol/m$^2$, in terms of the coated amount.

The molar amount to be added of the color-image-forming reducing agent for use in the present invention is generally 0.01 to 100 times, preferably 1 to 10 times, and more preferably 0.2 to 5 times, the molar amount of the coupler. Two or more of the couplers can be used in combination.

The heat-developable color light-sensitive material of the present invention has basically on a base a light-sensitive silver halide emulsion, a binder, a coupler, and a reducing agent and, if required, it can contain an organometal salt oxidizing agent or the like.

Although these components are added to the same layer in many cases, they can be added separately to different layers.

Other reducing agents than the silver-developing reducing agent and the color-image-forming reducing agent used in the present invention are preferably built in the heat-developable light-sensitive material, but they may be supplied from the outside, for example, by means of diffusing them from the later-described dye-fixing element.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of a green-sensitive layer, a red-sensitive layer, an infrared-sensitive layer, and a combination of a red-sensitive layer, an infrared-sensitive layer (1), and an infrared-sensitive layer (2), as described in JP-A-59-180550, JP-A-64-13546, JP-A-62-253159, and EP-A-479,167, can be mentioned. The photosensitive layers can be arranged in various orders known generally for color photographic materials. Further, each of these photosensitive layers can be divided into two or more layers if necessary, as described in JP-A-1-252954. In the heat-developable light-sensitive material, various non-light-sensitive layers can be provided, such as a protective layer, an underlayer, an intermediate layer, a yellow filter layer, and an antihalation layer, between the above silver halide emulsion layers, or as an uppermost layer or a lowermost layer; and on the opposite side of the photographic support, various auxiliary layers can be provided, such as a backing layer. Specifically, for example, layer constitutions as described in the above-mentioned patents, undercoat layers as described in U.S. Pat. No. 5,051,335, intermediate layers containing a solid pigment, as described in JP-A-1-167,838 and JP-A-61-20,943, intermediate layers containing a reducing agent or a DIR compound, as described in JP-A-1-129,553, JP-A-5-34,884, and JP-A-2-64,634, intermediate layers containing an electron transfer agent, as described in U.S. Pat. Nos. 5,017,454 and 5,139,919, and JP-A-2-235,044, protective layers containing a reducing agent, as described in JP-A-4-249,245, or combinations of these layers, can be provided. It is preferable to design a support so that it has antistatic function and the surface resistivity of $10^{12}\Omega$.cm or less.

Next, silver halide emulsion used in the heat-developable light-sensitive material is described in detail. The silver halide emulsion that can be used in the present invention may be made of any of silver chloride, silver bromide, silver iodobromide, silver chlorobromide, silver chloroiodide, and silver chloroiodobromide.

The silver halide emulsion that is used in the present invention may be a surface-latent-image-type emulsion or an internal-latent-image-type emulsion. The internal-latent-image-type emulsion is used in combination with a nucleator or a light-fogging agent to be used as a direct reversal emulsion. A so-called core-shell emulsion, wherein the grain inside and the grain surface layer have different phases, and an emulsion wherein silver halides different in composition are joined epitaxially, may be used. The silver halide emulsion may be a monodisperse or a polydisperse emulsion. A technique is preferably used wherein the gradation is adjusted by mixing monodisperse emulsions, as described in JP-A-1-167743 or JP-A-4-223643. The grain size is preferably 0.1 to 2 $\mu$m, and particularly preferably 0.2 to 1.5 $\mu$m. The crystal habit of the silver halide grains may be any of regular crystals, such as cubic crystals, octahedral crystals and tetradecahedral crystals; irregular crystals, such as spherical crystals and tabular crystals having a high aspect ratio; crystals having crystal defects, such as twin planes, or other composite crystals of these.

Specifically, any of silver halide emulsions can be used that are prepared by methods described, for example, in U.S. Pat. No. 4,500,626, column 50; U.S. Pat. No. 4,628,021, Research Disclosure (hereinafter abbreviated to as RD) No. 17,029 (1978), RD No. 17,643 (December 1978), pages 22 to 23; RD No. 18,716 (November 1979), page 648; RD No. 307,105 (November 1989), pages 863 to 865; JP-A-62-253159, JP-A-64-13546, JP-A-2-236546, and JP-A-3-110555; by F. Glafkides in "Chemie et Phisique Photographique", Paul Montel (1967); by G. F. Duffin in "Photographic Emulsion Chemistry", Focal Press, 1966; and by V. L. Zelikman et al., in "Making and Coating Photographic Emulsion", Focal Press, 1964.

In the process for preparing the light-sensitive silver halide emulsion for use in the present invention, so-called desalting, for removing excess salts, is preferably carried out. As a means for attaining it, the noodle water-washing method, which is carried out with the gelatin gelled, can be used, and also the sedimentation method, in which inorganic salts comprising polyvalent anions (e.g. sodium sulfate), an anionic surfactant, an anionic polymer (e.g. polystyrene-sulfonic acid sodium salt), or a gelatin derivative (e.g. an aliphatic-acylated gelatin, an aromatic-acylated gelatin, and an aromatic-carbamoylated gelatin) is employed, can be used, with the sedimentation method preferred.

The light-sensitive silver halide emulsion that is used in the present invention may contain a heavy metal, such as iridium, rhodium, platinum, cadmium, zinc, thallium, lead, iron, and, osmium, for various purposes. The compounds of the heavy metal may be used singly or in the form of a combination of two or more. The amount to be added varies depending on the purpose of the application; but the amount is generally on the order of $10^{-9}$ to $10^{-3}$ mol per mol of the silver halide. When they are incorporated, they may be incorporated uniformly in the grains, or they may be localized in the grains or on the surface of the grains. Specifically, emulsions described, for example, in JP-A-2-236542, JP-A-1-116637, and Japanese patent application No. 4-126629 are preferably used.

In the step for forming grains of the light-sensitive silver halide emulsion for use in the present invention, as a silver halide solvent, a rhodanate, ammonia, a tetrasubstituted thioether compound, an organic thioether derivative described in JP-B-47-11386, or a sulfur-containing compound described in JP-A-53-144319 can be used.

As other conditions employed to prepare the emulsion in the present invention, the description, for example, by F. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964, can be referred to. That is, any of the acid process, the neutral process, the ammonia process, and the like can be used; and to react a soluble silver salt with a soluble halogen salt, any of the single-jet method, the double-jet method, a combination thereof, and the like can be used. To obtain monodispersed emulsion, the double-jet method is preferably used.

A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used.

Further, to quicken the growth of the grains, the concentrations, the amounts, and the speeds of the silver salt and the halide to be added may be increased (e.g. JP-A-55-142329, JP-A-55-158124, and U.S. Pat. No. 3,650,757).

As the method of stirring the reaction liquid, any of known stirring methods may be used. The temperature and the pH of the reaction liquid during the formation of the silver halide grains may be set arbitrarily to meet the purpose. Preferably the pH range is 2.3 to 8.5, and more preferably 2.5 to 7.5.

The light-sensitive silver halide emulsion is generally a chemically-sensitized silver halide emulsion. To chemically sensitize the light-sensitive silver halide emulsion for use in the present invention, for example, a chalcogen sensitization method, such as a sulfur sensitization method, a selenium sensitization method, and a tellurium sensitization method; a noble metal sensitization method, wherein gold, platinum, or palladium is used; and a reduction sensitization method, each of which is known for photographic emulsions in general-type light-sensitive material, can be used alone or in combination (e.g. JP-A-3-110555 and Japanese patent application No. 4-75798). These chemical sensitizations can be carried out in the presence of a nitrogen-containing heterocyclic compound (JP-A-62-253159). Further, the below-mentioned antifoggant can be added after the completion of the chemical sensitization. Specifically, methods described in JP-A-5-45833 and JP-A-62-40446 can be used.

At the time of the chemical sensitization, the pH is preferably 5.3 to 10.5, and more preferably 5.5 to 8.5, and the pAg is preferably 6.0 to 10.5, and more preferably 6.8 to 9.0.

The coating amount of the light-sensitive silver halide emulsion used in the present invention is generally in the range of 1 mg to 10 g/$m^2$ in terms of silver.

When the photosensitive silver halide used in the present invention is made to have color sensitivities of green sensitivity, red sensitivity, and infrared sensitivity, the photosensitive silver halide emulsion is spectrally sensitized with methine dyes or the like. If required, the blue-sensitive emulsion may be spectrally sensitized in the blue region.

Dyes that can be used include cyanine dyes, merocyanine dyes, composite cyanin dyes, composite merocyanine dyes, halopolar cyanine dyes, hemicyanine dyes, styryl dyes, and hemioxonol dyes.

Specifically, sensitizing dyes described, for example, in U.S. Pat. No. 4,617,257 and JP-A-59-180550, JP-A-64-13546, JP-A-5-45828, and JP-A-5-45834 can be mentioned.

These sensitizing dyes can be used singly or in combination, and a combination of these sensitizing dyes is often used, particularly for the purpose of adjusting the wavelength of the spectral sensitivity, and for the purpose of supersensitization.

Together with the sensitizing dye, a dye having no spectral sensitizing action itself, or a compound that does not substantially absorb visible light and that exhibits supersensitization, may be included in the emulsion (e.g. those described, for example, in U.S. Pat. No. 3,615,641 and JP-A-63-23145).

The time when these sensitizing dyes are added to the emulsion may be at a time of chemical ripening or before or after chemical ripening. Further, the sensitizing dye may be added before or after the formation of nuclei of the silver halide grains, in accordance with U.S. Pat. No. 4,183,756 and U.S. Pat. No. 4,225,666. Further, these sensitizing dyes and supersensitizers may be added in the form of a solution of an organic solvent, such as methanol, or in the form of a dispersion of gelatin, or in the form of a solution of a surface-active agent. Generally the amount of the sensitizing dye to be added is of the order of $10^{-8}$ to $10^{-2}$ mol per mol of the silver halide.

These additives used in the above process, and conventionally known additives for photography that can be used in heat-developable light-sensitive materials of the present invention and dye-fixing materials, are described in Research Disclosure No. 17643; Research Disclosure No. 18716; and Research Disclosure No. 307105, whose particular parts are given below in a table.

| | Additive | RD 17643 | RD 18716 | RD 307105 |
|---|---|---|---|---|
| 1 | Chemical sensitizers | p. 23 | p. 648 (right column) | p. 866 |
| 2 | Sensitivity-enhancing agents | — | p. 648 (right column) | — |
| 3 | Spectral sensitizers and Supersensitizers | pp. 23–24 | pp. 648 (right column)–649 | pp. 866–868 |
| 4 | Brightening agents | p. 24 | pp. 648 (right column) | p. 868 |
| 5 | Antifogging agents and Stabilizers | pp. 24–25 | p. 649 (right column) | pp. 868–870 |
| 6 | Light absorbers, Filter dyes, and UV Absorbers | pp. 25–26 | pp. 649 (right column)–650 (left column) | p. 873 |
| 7 | Image-dye stabilizers | p. 25 | p. 650 (left column) | p. 872 |
| 8 | Hardeners | p. 26 | p. 651 (left column) | pp. 874–875 |
| 9 | Binders | p. 26 | p. 651 (left column) | pp. 873–874 |
| 10 | Plasticizers and Lubricants | p. 27 | p. 650 (right column) | p. 876 |
| 11 | Coating aids and Surfactants | pp. 26–27 | p. 650 (right column) | pp. 875–876 |
| 12 | Antistatic agents | p. 27 | p. 650 (right column) | pp. 876–877 |
| 13 | Matting agents | | | pp. 878–879 |

As a surface-active agent that can be used in the light-sensitive material of the present invention, the below-described Compounds W-1 to W-28 are preferable.

W-1

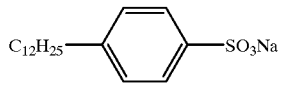

W-2

$C_{12}H_{25}OSO_3Na$

W-3

$C_{14}H_{29}SO_3Na$

W-4

$C_{11}H_{23}CH(OH)—CH_2CH_2SO_3Na$
$C_{11}H_{23}CH=CHCH_2SO_3Na$ a mixture of 40/60 (wt)

W-5

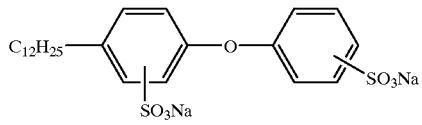

W-6

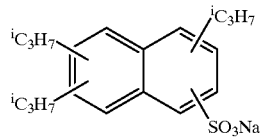

-continued

W-7

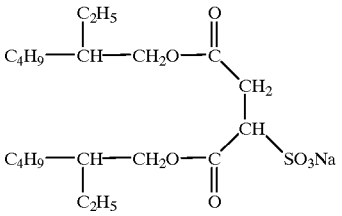

W-8

$C_{11}H_{23}CON(CH_3)CH_2CH_2SO_3Na$

W-9

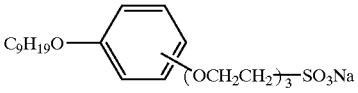

W-10

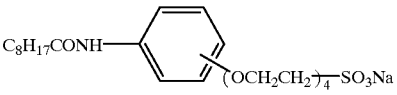

W-11

$C_{12}H_{25}-(O-CH_2CH_2)_3-SO_3Na$

W-12

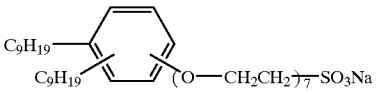

W-13

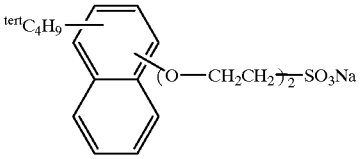

W-14

$C_{17}H_{33}CON(CH_3)-CH_2CH_2-(O-CH_2CH_2)_5-SO_3Na$

W-15

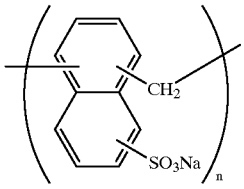

number-average
molecular weight ≈ 1500

W-16

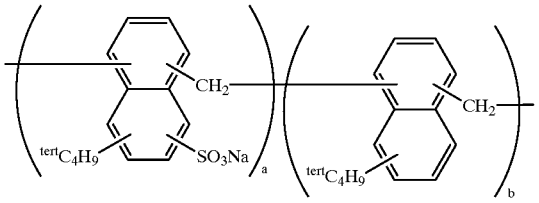

number-average
molecular weight ≈ 1500
a/b ≈ 20/80 (wt)

-continued

W-17

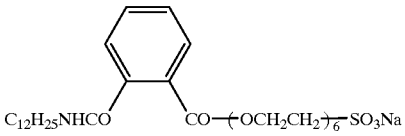

W-18

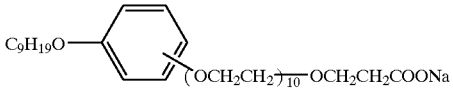

W-19

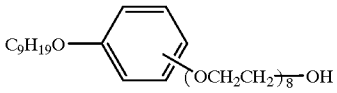

W-20

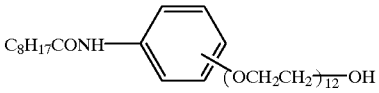

W-21

$C_{12}H_{25}-(O-CH_2CH_2)_{15}-OH$

W-22

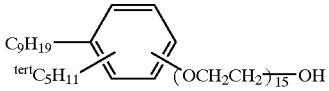

W-23

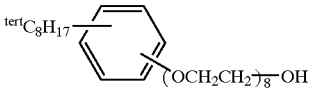

W-24

$C_{17}H_{33}CON(CH_3)-CH_2CH_2-(O-CH_2CH_2)_{14}-OH$

W-25

$H-(OCH_2CH_2)_a-(OCH(CH_3)CH_2)_b-(OCH_2CH_2)_c-OH$ a + c/b = 207/39 (polymerization degree)

W-26

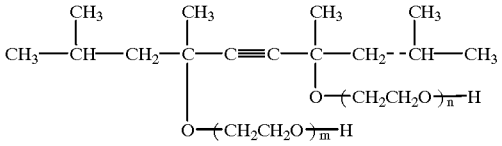

m + n ≈ 10

W-27

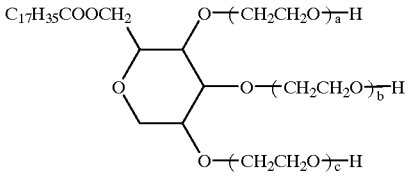

W-28

$C_{11}H_{23}CO-(O-CH_2CH_2)_{12}-H$

As the binder of the constitutional layer of the heat-developable light-sensitive material or the dye-fixing material, a hydrophilic binder is preferably used. Examples thereof include those described in the above-mentioned Research Disclosures and JP-A-64-13546, pages (71) to (75). Specifically, a transparent or semitransparent hydrophilic binder is preferable, and examples include proteins, such as gelatin and gelatin derivatives; cellulose derivatives; such natural compounds as polysaccharides, including starches, acacia, dextrans, and pullulan; and such synthetic polymer compounds as polyvinyl alcohols, polyvinyl pyrrolidones, and acrylamide polymers. Highly water-absorptive polymers described, for example, in U.S. Pat. No. 4,960,681 and JP-A-62-245260; that is, homopolymers of vinyl monomers having —COOM or —$SO_3M$ (M represents a hydrogen atom or an alkali metal), or copolymers of these vinyl monomers, or this vinyl monomer(s) with another vinyl monomer (e.g., those comprising sodium methacrylate or ammonium methacrylate, including Sumika Gel L-5H, trade name, manufactured by Sumitomo Chemical Co., Ltd.) can also be used. Two or more of these binders can be combined and used. Particularly, combinations of gelatin with the above binders are preferable. As the gelatin, lime-processed gelatin, acid-processed gelatin, or de-ashed gelatin, wherein the contents of calcium, etc., are reduced, can be selected to meet various purposes, and combinations of these gelatins are also preferably used.

If a system wherein the heat development is carried out with a trace amount of water supplied is adopted, the absorption of water can be rapidly carried out by using the above high-water-absorptive polymer. Further, in addition to the present invention, when the high-water-absorptive polymer is used in the dye-fixing layer or its protective layer, after the transfer the dye can be prevented from re-transferring from the dye-fixing element to others.

In the present invention, the coating amount of the binder is preferably 20 g or less, particularly preferably 10 g or less, and more preferably 0.5 to 7 g per $m^2$.

In the present invention, the light-sensitive silver halide emulsion may be used together with an organic metal salt as an oxidizing agent. Among the organic metal salts, organosilver salt is particularly preferably used. As the organic compound that can be used to form the above organosilver salt oxidizing agent, benzotriazoles, aliphatic acids, and other compounds, as described in U.S. Pat. No. 4,500,626, columns 52 to 53, can be mentioned. Also useful is acetylene silver described in U.S. Pat. No. 4,775,613. Organosiliver salts may be used in the form of a combination of two or more.

The above organosilver salts may be used additionally in an amount of generally 0.01 to 10 mol, and preferably 0.01 to 1 mol, per mol of the light-sensitive silver halide. Suitably the total coating amount of the light-sensitive silver halide emulsion plus the organosilver salt is generally 0.05 to 10 $g/m^2$, and preferably 0.1 to 4 g/m , in terms of silver.

As another reducing agent other than the above that can be used in the present invention, reducing agents known in the field of heat-developable light-sensitive material can be used. Further, reducing agent precursors that have no reducibility themselves but exhibit reducibility by the action of heat or a nucleophilic agent during the process of development can also be used.

Examples of the another reducing agent other than the above used in the present invention include reducing agents and reducing agent precursors described, for example, in U.S. Pat. No. 4,500,626, columns 49 to 50, U.S. Pat. No. 4,839,272, U.S. Pat. No. 4,330,617, U.S. Pat. No. 4,590,152, U.S. Pat. No. 5,017,454, U.S. Pat. No. 5,139,919, JP-A-60-140335, pages (17) to (18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62 -131253, JP-A-62-131256, JP-A-63-10151, JP-A-64-13546, pages (40) to (57), JP-A-1-120553, JP-A-2-32338, JP-A-2-35451, JP-A-2-234158, JP-A-3-160443, and EP-A-220 746, pages 78 to 96. Combinations of various reducing agents as disclosed in U.S. Pat. No. 3,039,869 can also be used.

When a non-diffusion reducing agent is used, an electron-transport agent and/or an electron-transport agent precursor can be used additionally, if necessary, in order to accelerate the electron transport between the non-diffusion reducing agent and the developable silver halide. Particularly preferably, those described, for example, in the above-mentioned U.S. Pat. No. 5,139,919, EP-A-418 743, JP-A-1-138556, and JP-A-3-102345 are used. Further, a method wherein it is introduced in a layer stably as described in JP-A-2-230143 and JP-A-2-235044 is preferably used.

The electron-transport agent or its precursor can be chosen from among the above reducing agents or their precursors. The electron-transport agent and its precursor are desirably greater in its movability than the non-diffusion reducing agent (electron provider).

As the non-diffusion reducing agent (electron provider) used in combination with the electron-transport agent, those that are among the above reducing agents and that are substantially not movable in the layers of the light-sensitive material are suitable. As examples of those, preferably, for example, hydroquinones, sulfonamidophenols, sulfonamidonaphtholes, compounds described as electron providers in JP-A-53-110827, U.S. Pat. No. 5,032,487, U.S. Pat. No. 5,026,634, and U.S. Pat. No. 4,839,272, and the below-described non-diffusion, dye-providing compounds having reducibility can be mentioned.

Electron provider precursors as described in JP-A-3-160443 are also preferably used.

Further, the above reducing agents can be used in intermediate layers and protective layers for various purposes, for example, of the color-mixing inhibition, the improvement of color reproduction, the improvement of the white background, and the prevention of silver from migrating to the dye-fixing material. Specifically, reducing agents described in EP-A-524 649, EP-A-357 040, JP-A-4-249245, JP-A-2-64633, JP-A-2-46450, and JP-A-63-186240 are preferably used. Reducing compounds that release a development inhibitor, as described in JP-B-3-63733, JP-A-1-150135, JP-A-2-110557, JP-A-2-64634, JP-A-3-43735, and EP-A-451 833, can also be used.

The total amount of the reducing compounds to be added in the present invention is generally 0.01 to 20 mol, and particularly preferably 0.1 to 10 mol, per mol of silver.

The hydrophobic additives, such as the silver-developing reducing agents or the color-image-forming reducing agents, used in the present invention, can be introduced, in the form of a co-emulsion formed by a known method, such as a method described in U.S. Pat. No. 2,322,027, into a layer of the heat-developable light-sensitive material. In this case, use is made of a high-boiling organic solvent as described, for example, in U.S. Pat. No. 4,555,470, U.S. Pat. No. 4,536,466, U.S. Pat. No. 4,536,467, U.S. Pat. No. 4,587,206, U.S. Pat. No. 4,555,476, and U.S. Pat. No. 4,599,296, and JP-B-3-62256, if necessary, in combination with a low-boiling organic solvent having a boiling point of 50 to 160° C. Further, couplers, reducing agents, high-boiling organic solvents, and the like, each of which constitute the co-emulsion, can be used in the form of a combination of two or more, respectively.

The high-boiling organic solvent is used in an amount of generally more than 0 g but 10 g or less, preferably 5 g or less, and more preferably 1 g to 0.1 g, per g of the coupler. The amount is also suitably generally 1 cc or less, particularly 0.5 cc or less, and more particularly more than 0 cc but 0.3 cc or less, per g of the binder. A dispersion method that use a polymer, as described in JP-B-51-39853 and JP-A-51-59943 can also be used.

If the hydrophobic additives are compounds substantially insoluble in water, besides the above methods, a method can be used wherein the compounds may be made into fine particles to be dispersed and contained in a binder.

In dispersing the hydrophobic compound in a hydrophilic colloid, various surface-active agents can be used. Besides W-1 to W-28 described in the above, examples of the surface-active agents that can be used include those described in JP-A-59-157636, pages (37) to (38), and in the RD publication shown above.

In the heat-developable light-sensitive material of the present invention, use can be made of a compound that can activate the development and make the image stable. Preferable specific compounds for use are described in U.S. Pat. No. 4,500,626, the 51st column to the 52nd column.

In the system for forming an image by diffusion transfer of a dye, various compounds can be added to the constitutional layers of the heat-developable light-sensitive material of the present invention, for the purpose of fixing unnecessary dyes or colored substances or rendering them colorless, to improve the white background of the resulting image.

Specifically, compounds described in EP-A-353 741, EP-A-461 416, JP-A-63-163345, and JP-A-62-203158 can be used.

For the constitutional layers of the heat-developable light-sensitive material of the present invention, various pigments and dyes can be used, for the purpose of improving color separation and making sensitivity high.

Specifically, compounds described in the above Research Disclosure and compounds and layer structures described, for example, in EP-A-479 167, EP-A-502 508, JP-A-1-167838, JP-A-4-343355, JP-A-2-168252, JP-A-61-20943, EP-A-479 167, and EP-A-502 508 can be used.

In the system wherein an image is formed by diffusion transfer of a dye, a dye-fixing material is used together with the heat-developable light-sensitive material. The dye-fixing material may be either in the form wherein the dye-fixing material is applied on a base different from that of the light-sensitive material, or in the form wherein the dye-fixing material is applied on the same base as that of the light-sensitive material. As for the mutual relationship of the light-sensitive material to the dye-fixing material, and the relationship thereof to the base, and to the white reflective layer, the relationship described in U.S. Pat. No. 4,500,626, column 57, can also be applied to the present invention.

The dye-fixing material preferably used in the present invention has at least one layer containing a mordant and a binder. As the mordant, one known in the field of photography can be used, and specific examples thereof include mordants described in U.S. Pat. No. 4,500,626, columns 58 to 59, JP-A-61-88256, pages (32) to (41), and JP-A-1-161236, pages (4) to (7), and those described, for example, in U.S. Pat. No. 4,774,162, U.S. Pat. No. 4,619,883, and U.S. Pat. No. 4,594,308. Further, dye-accepting polymer compounds as described in U.S. Pat. No. 4,463,079 may be used.

The binder used in the dye-fixing material for use in the present invention is preferably the above hydrophilic binder. Further, the additional use of carrageenans, as described in EP-A-443 529, and latexes having a glass transition temperature of 40° C. or less, as described in JP-B-3-74820, is preferable.

The dye-fixing material may be provided, if necessary, with an auxiliary layer, such as a protective layer, a release (peel-off) layer, an undercoat layer, an intermediate layer, a backing layer, and a curling-preventive layer. Particularly, the provision of a protective layer is useful.

For the constitutional layers of the heat-developable light-sensitive material and the dye-fixing material, use can be made of a plasticizer, a slip agent, or a high-boiling organic solvent as a releasability improver between the light-sensitive material and the dye-fixing material. Specifically, those described, for example, in the above Research Disclosures and JP-A-62-245253 can be mentioned.

Further, for the above purpose, a variety of silicone oils (all silicone oils including dimethylsilicone oils and modified silicone oils formed by introducing various organic groups into dimethylsiloxanes) can be used. For example, various modified silicone oils described in "Hensei Silicone Oils," Gijyutsu Shari, P6–18B, published by Shinetsu Silicone K.K., and particularly carboxy-modified silicone (trade name: X-22-3710) are effective.

Further, silicone oils described in JP-A-62-215953 and JP-A-63-46449 are also effective.

In the heat-developable light-sensitive material and the dye-fixing material, an anti-fading (anti-discoloring) agent may be used. As the anti-fading agent, can be mentioned, for example, an antioxidant, an ultraviolet absorber, or a certain type of metal complex, and, for example, ultraviolet absorbers and dye-image stabilizers described in the above Research Disclosures are also useful.

As the antioxidant, there are, for example, chroman-series compounds, coumaran-series compounds, phenol-series compounds (e.g., hindered phenols), hydroquinone derivatives, hindered amine derivatives, and spiroindane-series compounds. Further, compounds described in JP-A-61-159644 are also effective.

As the ultraviolet absorber, there are benzotriazole-series compounds (U.S. Pat. No. 3,533,794 etc.), 4-thiazolidone-series compounds (U.S. Pat. No. 3,352,681 etc.), and benzophenone-series compounds (JP-A-46-2784 etc.), as well as compounds described, for example, in JP-A-54-48535, JP-A-62-136641, and JP-A-61-88256. Further, ultraviolet absorbable polymers described in JP-A-62-260152 are also effective.

As the metal complex, there are compounds described, for example, in U.S. Pat. No. 4,241,155, U.S. Pat. No. 4,245,018 in columns 3 to 36, U.S. Pat. No. 4,254,195 in columns 3 to 8, JP-A-62-174741, JP-A-61-88256 on pages (27) to (29), JP-A-63-199248, JP-A-1-75568, and JP-A-1-74272.

The anti-fading agent for preventing the dye transferred to the dye-fixing material from fading may be contained previously in the dye-fixing material, or it may be supplied to the dye-fixing material from the outside, for example, from the heat-developable light-sensitive material or the later-described transfer solvent.

The above antioxidants, ultraviolet absorbers, and metal complexes may be used in combination each other.

In the heat-developable light-sensitive material and the dye-fixing material, a fluorescent whitening agent may be used. Particularly preferably, the fluorescent whitening agent is built in the dye-fixing material or it is supplied from the outside, for example, from the heat-developable light-sensitive material or the transfer solvent. As examples thereof, can be mentioned compounds described, for example, in "The Chemistry of Synthetic Dyes," Vol. V, Section 8, edited by K. Veenkataraman and in JP-A-61-143752. More specifically, for example, stilbene-series compounds, coumarin-series compounds, biphenyl-series compounds, benzoxazolyl-series compounds, naphthalimide-series compounds, pyrazoline-series compounds, and carbostyryl-series compounds can be mentioned.

The fluorescent whitening agent can be used in combination with the anti-fading agent or the ultraviolet absorber.

Specific examples of these anti-fading agent, ultraviolet absorber, and fluorescent whitening agent, are described in JP-A-62-215272, pages (125) to (137), and JP-A-1-161236, pages (17) to (43).

Examples of the hardening agent that is used in constitutional layers of the heat-developable light-sensitive material or the dye-fixing material, include hardening agents described, for example, in the above Research Disclosures, U.S. Pat. No. 4,678,739, column 41, and U.S. Pat. No. 4,791,042, and JP-A-59-116655, JP-A-62-245261, JP-A-61-18942, and JP-A-4-218044. More specifically, an aldehyde-series hardening agent (formaldehyde, etc.), an aziridineseries hardening agent, an epoxy-series hardening agent, a vinyl sulfone-series hardening agent (N,N'-ethylene-bis(vinylsulfonylacetamido)ethane, etc.), an N-methylol-series hardening agent (dimethylol urea, etc.), or a polymer hardening agent (compounds described, for example, in JP-A-62-234157), can be mentioned.

These hardening agents are used in an amount of generally 0.001 to 1 g, and preferably 0.005 to 0.5 g, per g of the gelatin coated. The layer into which the hardeners are added may be any of layers that constitute the photographic material or the dye-fixed material, or the hardener may be divided into two or more parts, which are added into two or more layers.

In the constitutional layers of the heat-developable light-sensitive material and the dye fixing material, various anti-foggants and photographical stabilizers and their precursors can be used. Specific examples thereof include azoles and azaindenes described in RD 17643 (1978), pages 24 to 25, nitrogen-containing carboxylic acids and phosphoric acids described in JP-A-59-168442, mercapto compounds and their metal salts described in JP-A-59-111636, and acetylene compounds described in JP-A-62-87957. In the case wherein a precursor is used in the present invention, it is particularly preferably used in the light-sensitive silver halide emulsion layer as described above, but it can be used in the dye-fixing material.

If these compounds are not precursors, they are used preferably in an amount of $5\times10^{-6}$ to $1\times10^{-1}$ mol and more preferably $1\times10^{-5}$ to $1\times10^{-2}$ mol, per mol of the silver. If they are precursors, the amount thereof to be used is preferably the same as described before.

In the constitutional layers of the heat-developable photographic material or dye-fixing material, use can be made of various surface-active agents for various purposes of, for example, serving as a coating aid, improving releasability and slipping property, preventing electrification, or accelerating development. Specific examples of the surface-active agents are described, for example, in the above Research Disclosures and JP-A-62-173463 and JP-A-62-183457.

In the constitutional layers of the heat-developable photographic material or dye-fixing material, an organofluoro compound may also be contained, for example, for the purposes of improving slipping properties, preventing electrification, and improving releasability. Typical examples of the organofluoro compound include hydrophobic fluoro compounds, including solid fluoro compound resins, such as ethylene tetrafluoride resins, or oily fluoro compounds, such as fluoro oils; or fluorine-containing surface-active agents described, for example, in JP-B-57-9053, column 8 to column 17, JP-A-61-20944, and JP-A-62-135826.

In the heat-developable photographic material and the dye-fixing material, a matting agent can be used for the purpose of adhesion prevention, improvement of slipping property, etc. Example matting agents include compounds, including silicon dioxide, polyolefins, polymethacrylates, and the like, as described in JP-A-61-88256, page (29), as well as compounds, including benzoguanamine resin beads, polycarbonate resin beads, ABS resin beads, and the like, described in JP-A-63-274944 and JP-A-63-274952. As other matting agents, compounds described in the above RD can be used. These matting agents are added into the uppermost layer (protective layer), and also into a lower layer if required.

Further, the constitutional layers of the heat-developable photographic material and the dye-fixing material may contain a heat solvent, an antifoaming agent, a germ-proofing agent, a mildew-proofing agent, colloidal silica, etc. Specific examples of these additives are described, for example, in JP-A-61-88256, pages (26) to (32); JP-A-3-11338, and JP-B-2-51496.

In the present invention, an image-formation-accelerating agent can be used in the heat-developable light-sensitive material and/or the dye-fixing material. Image-formation-accelerating agents function, for example, to accelerate the redox reaction between a silver salt oxidizing agent and a reducing agent, to accelerate a dye formation reaction from a dye-providing compound, a dye decomposition reaction, or a diffusion dye-releasing reaction, and to accelerate transfer of a dye from a layer of a heat-developable light-sensitive material to a dye-fixing layer. These agents are classified, from the physicochemical functional point of view, for example, into bases or base precursors, nucleophilic compounds, high-boiling organic solvents (oils), heat solvents, surfactants, and compounds interactive with silver or silver ions. However, generally these compounds have a composite function, and they usually possess some of the above acceleration effects in combination. The details thereof are described in U.S. Pat. No. 4,678,739, columns 38 to 40.

As the base precursor, for example, salts of organic acids with bases that will be decarboxylated by heat, as well as compounds that will release amines by intramolecular nucleophilic substitution reaction, Lossen rearrangement, or Beckman rearrangement, are mentioned. Specific examples thereof are described, for example, in U.S. Pat. Nos. 4,514,493 and 4,657,848.

In the system wherein the heat development and the transfer of the dye are carried out simultaneously in the presence of a small amount of water, a base and/or a base precursor is preferably contained in the dye-fixing material, with a view to increasing the preservability of the heat-developable light-sensitive material.

In addition to the above, combinations of hardly soluble (in water) metal compounds described in EP-A-210 660 and U.S. Pat. No. 4,740,445 with compounds capable of complex formation reaction with metal ions constituting these hardly soluble compounds (referred to as complex-forming compounds), and compounds capable of producing a base by electrolysis, as described in JP-A-61-232451, can also be used as the base precursor. Particularly the former means is effective. The hardly soluble metal compound and the complex-forming compound are advantageously added separately to the heat-developable light-sensitive material and the dye-fixing element, as described in the above patent publications.

In the heat-developable photographic material and/or the dye-fixing material for use in the present invention, in order to obtain a constant image all the time, against fluctuation of the processing temperature and the processing time at the time of development, various development-stopping agents can be used.

Herein, the term "a development-stopping agent" means a compound that neutralizes bases quickly or reacts quickly with bases after suitable development, to lower the base concentration in the film, to stop the development; or a compound that interacts with silver and silver salts, to inhibit the development. Specific examples include acid precursors that release an acid when heated, electrophilic compounds that undergo a substitution reaction with coexisting bases when heated, nitrogen-containing heterocyclic compounds, mercapto compounds, and their precursors. Details are described in JP-A-62-253159, pages (31) to (32).

As the base (support) of the heat-developable light-sensitive material and the dye-fixing material in the present invention, those that can withstand the processing temperature are used. Generally, photographic bases, such as papers and synthetic polymers (films) described in "Shashin Kogaku no Kiso -Ginen Shashin-hen-," edited by Nihon Shashin-gakkai and published by Korona-sha, 1979, pages (223) to (240), can be mentioned. Specifically, use is made of polyethylene terephthalates, polyethylene naphthalates, polycarbonates, polyvinyl chlorides, polystyrenes, polypropylenes, polyimides, celluloses (e.g., triacetylcellulose), those obtained by incorporating a pigment, such as titanium oxide, into films made of these, synthetic papers made from polypropylenes or the like by the film method, papers made by mixing synthetic resin pulps, for example, of polyethylenes, with natural pulp, Yankee paper, baryta paper, coated papers (particularly, cast-coated paper), metals, cloths, glasses, etc.

These may be used singly or may be used in the form of a base one or both of whose surfaces are laminated with a synthetic polymer, such as polyethylenes. This laminate layer can be previously formed to contain, if necessary, a dye or a pigment, such as titanium oxide, ultramarine, and carbon black.

In addition to the above, bases described, for example, in JP-A-62-253159, pages (29) to (31), JP-A-1-161236, pages (14) to (17), JP-A-63-316848, JP-A-2-22651, JP-A-3-56955, and U.S. Pat. No. 5,001,033 can be used.

The backing surface of these bases may be coated with a hydrophilic binder plus a semiconductive metal oxide, such as tin oxide and alumina sol, carbon black, and another antistatic agent. Specifically, bases described, for example, in JP-A-63-220246 can be used.

Further, preferably the surface of the base is subjected to various surface treatments or it is provided with various undercoats, for the purpose of improving the adhesion to the hydrophilic binder.

Example methods of exposing the heat-developable light-sensitive material to light and recording the image, include a method wherein a landscape, a man, or the like is directly photographed by a camera or the like; a method wherein a reversal film or a negative film is exposed to light using, for example, a printer, or an enlarging apparatus; a method wherein an original picture is subjected to scanning exposure through a slit by using an exposure system of a copying machine or the like; a method wherein light-emitting diodes and various lasers (e.g. laser diodes and gas lasers) are allowed to emit light, to carry out scanning exposure through image information and electrical signals (methods described, for example, in JP-A-2-129625, and Japanese patent application Nos. 3-338182, 4-9388, and 4-281442); and a method wherein image information is outputted to an image display apparatus, such as a CRT, a liquid crystal display, an electroluminescence display, and a plasma display, and exposure is carried out directly or through an optical system.

Light sources that can be used for recording an image on the heat-developable light-sensitive material, as mentioned above, include natural light and light sources and exposure methods described in U.S. Pat. No. 4,500,626, column 56, and JP-A-2-53378 and JP-A-2-54672, such as a tungsten lamp, a light-emitting diode, a laser light source, and a CRT light source.

Image-wise exposure can be carried out by using a wavelength-converting element that uses a nonlinear optical material and a coherent light source, such as laser rays, in combination. Herein the term "nonlinear optical material" refers to a material that can develop nonlinearity of the electric field and the polarization that appears when subjected to a strong photoelectric field, such as laser rays, and inorganic compounds, represented by lithium niobate, potassium dihydrogenphosphate (KDP), lithium iodate, and $BaB_2O_4$; urea derivatives, nitroaniline derivatives, nitropyridine-N-oxide derivatives, such as 3-methyl-4-nitropyridine-N-oxide (POM); and compounds described in JP-A-61-53462 and JP-A-62-210432 can be preferably used. As the form of the wavelength-converting element, for example, a single crystal optical waveguide type and a fiber type are known, both of which are useful.

Further, the above image information can employ, for example, image signals obtained from video cameras, electronic still cameras, and the like; television signals, represented by Nippon Television Singo Kikaku (NTSC); image signals obtained by dividing an original picture into a number of picture elements by a scanner or the like; and an image signals produced by a computer, represented by CG or CAD.

The heat-developable light-sensitive material and/or the dye-fixing material of the present invention may be in the form that has an electroconductive heat-generating material layer as a heating means for heat development and diffusion transfer of the dye. In this case, as the heat-generating element, one described, for example, in JP-A-61-145544 can be employed.

The heating temperature in the heat development process is about 50 to 250° C. and particularly a heating temperature of about 60 to 180° C. is useful. The diffusion transfer process of the dye may be carried out simultaneously with the heat development or after the completion of the heat development process. In the latter case, the heating temperature in the transfer process may be in the range from the temperature in the heat development process to the room temperature and is preferably particularly 50° C. or more to a temperature about 10° C. lower than the heat development process.

Although the transfer of the dye can be brought about only by heat, a solvent may be used to accelerate the dye transfer. Further, it is also useful to use a method described, for example, in U.S. Pat. No. 4,704,345, U.S. Pat. No 4,740,445, and JP-A-61-238056 wherein the development and the transfer are carried out at the same time or successively by heating in the presence of a small amount of a solvent (particularly water). In this system, the heating temperature is preferably 50° C. or higher, but the boiling point of the solvent or lower. For example, in the case wherein the solvent is water, the heating temperature is preferably 50° C. to 100® C.

Examples of the solvent that is used for acceleration of the development and/or for diffusion transfer of dyes include water, an aqueous basic solution containing an inorganic alkali metal salt or an organic base (as the base, those described in the section of image-formation-accelerating agents can be used), a low-boiling solvent, and a mixed solution of a low-boiling solvent with water or the above-mentioned aqueous basic solution. Also, a surface-active agent, an antifoggant, a complexing compound with a hardly-soluble metal salt, a mildew-proofing agent, and an antifungus agent may be contained in the solvent.

As the solvent to be used in these heat development or diffusion transfer steps, water is preferably used, and the water may be any water that is generally used. Specifically, for example, distilled water, tap water, well water, and mineral water can be used. In the heat-development apparatus in which the heat-developable light-sensitive material of the present invention and an dye-fixing material are used, water may be used only once, or it may be circulated for repeated use. In the latter case, water that contains components dissolved out of the material will be used. Also, apparatuses and water described, for example, in JP-A-63-144354, JP-A-63-144355, JP-A-62-38460, and JP-A-3-21055 may be used.

These solvents may be used in such a way that they are applied to the heat-developable light-sensitive material or the dye-fixing material or to both of them. The amount of the solvent to be used may be the weight of the solvent corresponding to or below the maximum swell volume of the entire coated film.

As the method of applying water, for example, methods described in JP-A-62-253159, page (5), and JP-A-63-85544, Japanese patent application No. 8-181045 are preferably used. Further, the solvent may be enclosed in microcapsules or may take the form of a hydrate, to be previously built into either or both of the heat-developable light-sensitive material and dye-fixing material, for use.

The suitable temperature of the water to be applied is generally 30 to 60° C. as described, for example, in JP-A-63-85544, supra. It is particularly useful to make temperature 45° C. or more, in view of prevention of propagation of bacteria in water.

To accelerate the dye transfer, a system can be adopted wherein a hydrophilic heat solvent that is solid at normal temperatures and melts at a higher temperature is built in the heat-developable light-sensitive material and/or the dye-fixing material. The layer wherein the hydrophilic heat solvent is built in may be any of the light-sensitive silver halide emulsion layer, the intermediate layer, the protective layer, and the dye-fixing layer, but preferably it is the dye-fixing layer and/or the layer adjacent thereto. Examples of the hydrophilic heat solvent are ureas, pyridines, amides, sulfonamides, imides, alcohols, oximes, and other heterocycles.

Example heating methods in the development step and/or transfer step include one wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere. As a method wherein the heat-developable light-sensitive material and a dye-fixing material are placed one upon the other, methods described in JP-A-62-253159 and JP-A-61-147244, on page (27), can be applied.

To process the photographic elements for use in the present invention, any of various heat development apparatuses can be used. For example, apparatuses described, for example, in JP-A-59-75247, JP-A-59-177547, JP-A-59-181353, and JP-A-60-18951, unexamined published Japanese Utility Model Application (JU-A) No. 62-25944, and JP-A-6-130509, JP-A-6-95338, and JP-A-6-95267 are preferably used. As a commercially available apparatus, for example, a PICTROSTAT 100, a PICTROSTAT 200, a PICTROGRAPHY 3000, and a PICTROGRAPHY 2000 (all trade names, manufactured by Fuji Photo Film Co., Ltd.), can be used.

In the case wherein the above image obtained by means of the heat-developable light-sensitive material and the dye-fixing element is used as a color proof for printing, the method for expressing the density may be any method of the continuous gradation control, the area gradation control that uses a part having discontinuous density, or the gradation control that is the combination of them.

By using an LD (laser diode) or LED (light-emitting diode) as an exposure light source, the output of digital signal is made possible. Thus, the using method wherein the control of the design and the image including the tinge or the like of printed products can be made on a CRT and a color proof is outputted as a final output (DDCP), becomes possible. Namely, the DDCP serves as an effective means for caring out the output of a proof efficiently in the field of color proofs. This is because color printers are relatively simply constituted and inexpensive; in color printers, as is well known, the preparation of process films for color printers and the preparation of press plates (presensitizing printing plates, so called PS plates) or the like are not required; and hard copies each having an image on a sheet can be made easily several times in a short period of time.

When an LD or LED is used as an exposure light source, the three spectral sensitivities of yellow, magenta, and cyan, the four spectral sensitivities of yellow, magenta, cyan, and black, or the spectral sensitivities of respective colors obtained by mixing two or more coloring materials for the purpose of obtaining desired hue, preferably have the peaks of the spectral sensitivities on separate wavelengths 20 nm or more apart, respectively. As another method, there is a method, wherein an image having two or more colors is obtained by using one exposure wavelength, when the spectral sensitivities of two or more colors are different 10 times or more in their sensitivity difference.

Now, a method of reproducing moire or the like on printed matter by a color printer is described.

In order to form a color proof for printing that reproduces faithfully, for example, moire appearing on high resolution printed matter by a low resolution color printer, for every dot area ratio data aj of a CMYK 4 plate, the threshold value matrix 24 is referred to and the conversion to bit map data b'j of each 48800 DPI is made. Then, bit map data b'j in a certain range are referred to simultaneously, to count the area ratio ci of each color. Then, the first tristimulus value data X, Y, and Z of 1600 DPI that are colorimetry value data of the above respective colors previously found, are calculated. The first tristimulus value data X, Y, and Z are subjected to anti-aliasing filtering, to calculate the second tristimulus value data X', Y', and Z' of 400 DPI. The calculated data are used as input data of the color printer. (The foregoing is described in detail in JP-A-8-192540.)

When a color image is recorded using an output apparatus, such as a color printer, a color image having a desired color can be realized by operating color signals related, for example, to yellow, magenta, and cyan. However, since the above color signals depend on the output properties of the output apparatus, color signals fed from an external apparatus having different properties are required to be subjected to color conversion processing with the above output properties taken into consideration.

Therefore, there is a method, wherein several known color patches different in color are made by using the particular output apparatus, the colors of the color patches are measured, to obtain, for example, the conversion relation for converting the known color signals CMY of the color patches to stimulus value signals XYZ independent of the output apparatus (this conversion relation being hereinafter referred to as "forward conversion relation"); and, from this forward conversion relationship, the conversion relation for converting the stimulus value signals XYZ to color signals CMY (this conversion relation being hereinafter referred to as "reverse conversion relation") is found; and this reverse relation is used to carry out the above color conversion processing.

Herein, as a method for finding color signals CMY from the above stimulus value signals XYZ, three examples are given below, which do not limit the present invention.

1. A method wherein tetrahedrons whose apexes are four stimulus value signals XYZ are set, the spaces of the stimulus value signals XYZ are divided by the tetrahedrons, the spaces of color signals CMY are similarly divided by tetrahedrons, and color signals CMY corresponding to any stimulus value signals XYZ in corresponding tetrahedrons are found by linear computing.

2. A method wherein color signals CMY corresponding to any stimulus value signals XYZ are found by repeat operation using the Newton method. (see *PHOTOGRAPHIC SCIENCE AND ENGINEERING*, Volume 16, Number 2, March–April 1972, pp 136–143 "Metameric color matching in subtractive color photography.")

3. A color conversion method for converting color signals from a first colorimetric system to a second calorimetric system, comprising a first step of finding, as a first forward conversion relation, the relation of real color signals of the said first calorimetric system obtained from known real color signals of the said second calorimetric system, a second step of approximating the said first forward conversion relation by a monotone function to set virtual color signals outside the region consisting of the said real color signals, a third step of finding, as a second forward conversion relation, the relation of the particular color signals of the said first calorimetric system obtained from color signals consisting of the said real color signals in the said second calorimetric system and the said virtual color signals, and a fourth step of finding, as a reverse conversion relation, the relation of color signals of the said first calorimetric system from the said second conversion relation using a repeat operation, thereby color signals are converted from the first calorimetric system to the second calorimetric system using the said reverse conversion relation. Namely, in this color conversion method for converting color signals from a first calorimetric system to a second calorimetric system, after real color signals (e.g., XYZ color signals) of a first calorimetric system corresponding to known real color signals (e.g., CMY color signals) of a second calorimetric system are found, a first forward conversion relation between these real color signals is approximated by a monotone function, to set virtual color signals outside the region consisting of the said real color signals. Then, based on a second forward conversion relation between the first calorimetric system and the second calorimetric system consisting of the said real color signals and the said virtual color signals, a reverse conversion relation for converting to the said first calorimetric system and the said second calorimetric system is found using a repeat operation represented by the Newton method, to convert colors using this reverse conversion relation, which method is mentioned by way of example.

The size of the image obtained by the above heat-developable light-sensitive material and the dye-fixing element may be any of a standard size of series A, A1 to A6, a Kiku-size (a medium octabo), a standard size of series B, B1 to B6, and a Shiroku-ban-size (duodecimo). Further, in accordance with the size, the size of the heat-developable light-sensitive material and the dye-fixing element may have any width generally in the range of 100 to 2,000 mm.

The heat-developable light-sensitive material and the dye-fixing element may be fed in the form of a roll or a sheet and also a combination is possible wherein only one of them is in the form of a roll and the other is in the form of a sheet.

The heat-developable color photographic light-sensitive material of the present invention makes it possible to form a high-density image by quick processing, and to give an image excellent in discrimination. Further, the light-sensitive material of the invention exhibits such an excellent effect that the above performance is not deteriorated by storage of the unexposed light-sensitive material.

Next, the present invention is described in more detail on the basis of the following examples, but the invention is not limited to those.

EXAMPLES

Example 1

Image Receiving Element R101 having the constitution shown in Table 1 was made.

TABLE 1

Constitution of Image Receiving Element R101

| Number of layer | Additive | Coated amount ($mg/m^2$) |
|---|---|---|
| Sixth layer | Water-soluble polymer(1) | 130 |
| | Water-soluble polymer(2) | 35 |
| | Water-soluble polymer(3) | 45 |
| | Potassium nitrate | 20 |
| | Anionic surfactant(1) | 6 |
| | Anionic surfactant(2) | 6 |
| | Amphoteric surfactant(1) | 50 |
| | Stain-preventing agent(1) | 7 |
| | Stain-preventing agent(2) | 12 |
| | Matting agent(1) | 7 |
| Fifth layer | Gelatin | 250 |
| | Water-soluble polymer(1) | 25 |
| | Anionic surfactant(3) | 9 |
| | Hardener(1) | 185 |
| Forth layer | Mordant(1) | 1850 |
| | Water-soluble polymer(2) | 260 |
| | Water-soluble polymer(4) | 1400 |
| | Dispersion of latex(1) | 600 |
| | Anionic surfactant(3) | 25 |
| | Nonionic surfactant(1) | 18 |
| | Guanidine picolinate | 2550 |
| | Sodium quinolinate | 350 |
| Third layer | Gelatin | 370 |
| | Mordant(1) | 300 |
| | Anionic surfactant(3) | 12 |
| Second layer | Gelatin | 700 |
| | Mordant(1) | 290 |
| | Water-soluble polymer(1) | 55 |
| | Water-soluble polymer(2) | 330 |
| | Anionic surfactant(3) | 30 |
| | Anionic surfactant(4) | 7 |
| | High-boiling organic solvent(1) | 700 |
| | Brightening agent(1) | 30 |
| | Stain-preventing agent(3) | 32 |
| | Guanidine picolinate | 360 |
| | Sodium quinolinate | 45 |
| First layer | Gelatin | 280 |
| | Water-soluble polymer(1) | 12 |
| | Anionic surfactant(1) | 14 |
| | Sodium metaborate | 35 |
| | Hardener(1) | 185 |

TABLE 1-continued

Base(1) Polyethylene-Laminated Paper Support (thickness 215 μm)
The coated amount of dispersion of latex is in terms of the coated amount of solid content of latex.

Constitution of Support

| Name of layer | Composition | Film thickness (μm) |
|---|---|---|
| Surface undercoat layer | Gelatin | 0.1 |
| Surface PE layer (Glossy) | Low-density polyethylene (Density 0.923) :90.2 parts | |
| | Surface-processed titanium oxide :9.8 parts | 36.0 |
| | Ultramarine :0.001 parts | |
| Pulp layer | Fine quality paper (LBKP/NBKP = 6/4, Density 1.053) | 152.0 |
| Back-surface PE layer (Matte) | High-density polyethylene (Density 0.955) | 27.0 |
| Back-surface undercoat layer | Styrene/acrylate copolymer Colloidal silica Polystyrenesulfonic acid sodium salt | 0.1 |
| | | 215.2 |

Anionic surfactant(1)

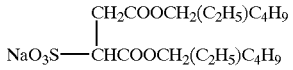

Anionic surfactant(2)

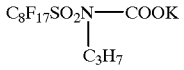

Anionic surfactant(3)

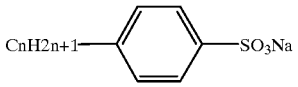

n = 12.6

Anionic surfactant(4)

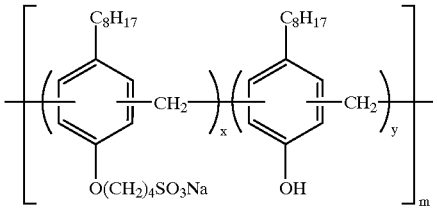

x:y = 4:6 m = 6.8

Nonionic surfactant(1)

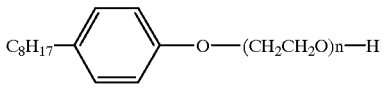

n = 85

TABLE 1-continued

Amphoteric surfactant(1)

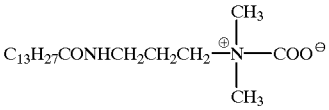

Brightening agent(1)

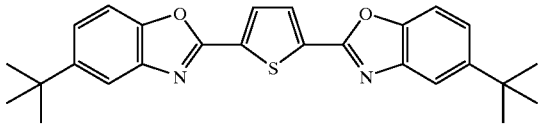

Mordant(1)

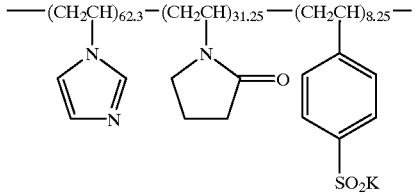

Stain-preventing agent(1)

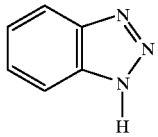

Stain-preventing agent(2)

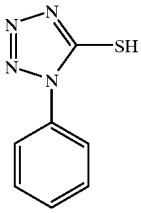

Stain-preventing agent(3)

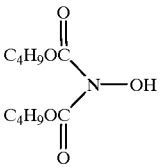

High-boiling solvent(1)
$C_{28}H_{46.9}C_{17.1}$ (EMPARA 40 (trade name: manufactured by Ajinomoto K.K.))

Water-soluble polymer(1)
Sumikagel L5-H (trade name: manufactured by Sumitomo Kagaku Co.)

Water-soluble polymer(2)
Dextran (molecular weight 70,000)

Water-soluble polymer(3)
κ (kappa)-Carrageenan (trade name: manufactured by Taito Co.)

TABLE 1-continued

| | |
|---|---|
| Water-soluble polymer(4) | |
| MP polymer MP-102 | (trade name: manufactured by Kuraray Co.) |
| Dispersion of latex(1) | |
| LX-438 | (trade name: manufactured by Nippon Zeon Co.) |
| Matting agent(1) | |
| SYLOID79 | (trade name: manufactured by Fuji Davisson Kagaku Co.) |
| Matting agent(2) | |
| PMMA grains | (average grain diameter 4 μm) |
| Hardener(1) | 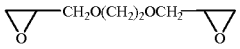 |

Next, the methods of preparing light-sensitive elements are described.

First, the methods of preparing light-sensitive silver halide emulsions are described. Light-Sensitive Silver Halide Emulsion (1) [for a red-sensitive emulsion layer].

Solution (I) having the composition shown in Table 4 was added to a well-stirred aqueous solution having the composition shown in Table 3, over 9 min at a constant flow rate, and before 10 sec of the addition of Solution (I), Solution (II) was added over 9 min 10 sec at a constant flow rate. Then, after 36 min, Solution (III) having the composition shown in Table 4 was added over 24 min at a constant flow rate, and simultaneously with the addition of Solution (III), Solution (IV) was added over 25 min at a constant flow rate.

After washing with water and desalting (at a pH of 4.0 using Settling Agent a) in a usual manner, 880 g of lime-processed ossein gelatin was added, the pH was adjusted to 6.0, and after the chemical sensitization was carried out optimally at 60° C. for 71 min by adding 12.8 g of a ribonucleic acid decomposition product and 32 mg of trimethylthiourea, then, 2.6 g of 4-hydroxy-6-methyl-1,3,3a,7-tetrazaindene, 3.2 g of Dye (a), 5.1 g of KBr, and 2,6 g of the later-described stabilizer were successively added, followed by cooling. In this way, 28.1 kg of a monodisperse cubic silver chlorobromide emulsion having an average grain size of 0.35 μm was obtained.

TABLE 3

| Composition | |
|---|---|
| $H_2O$ | 26300 cc |
| Lime-processed gelatin | 800 g |
| KBr | 12 g |
| NaCl | 80 g |
| Compound (a) | 1.2 g |
| Temperature | 53° C. |

TABLE 4

| | Solution (I) | Solution (II) | Solution (III) | Solution (IV) |
|---|---|---|---|---|
| $AgNO_3$ | 1200 g | none | 2800 g | none |
| KBr | none | 546 g | none | 1766 g |
| NaCl | none | 144 g | none | 96 g |
| $K_2IrCl_6$ | none | 3.6 mg | none | none |
| Total volume | water to make 6.5 liters | water to make 6.5 liters | water to make 10 liters | water to make 10 liters |

Compound (a)

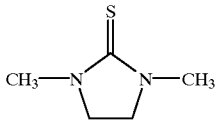

Dye (a)

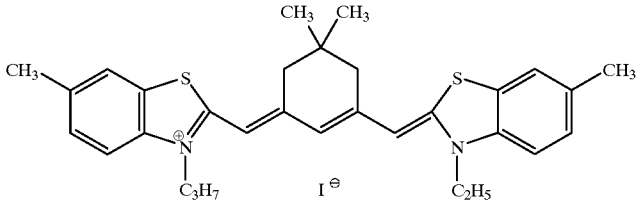

Light-Sensitive Silver Halide Emulsion (2) [for a green-sensitive emulsion layer]

Solutions (I) and (II) each having the composition shown in Table 6 were added simultaneously, to a well-stirred aqueous solution having the composition shown in Table 5, over 9 min at a constant flow rate. After 5 min, Solutions (III) and (IV) each having the composition shown in Table 6 were simultaneously added thereto, at a constant flow rate over 32 min. After the completion of the addition of Solutions (III) and (IV), 60 ml of a methanol solution of dyes (containing 360 mg of Dye (b-1) and 73.4 mg of Dye (b-2)) was added at a time.

After washing with water and desalting (at a pH of 4.0 using Settling Agent a) in a usual manner, 22 g of lime-processed ossein gelatin was added, the pH and the pAg were adjusted to 6.0 and 7.6 respectively, then the chemical sensitization was carried out optimally at 60° C. by adding 1.8 mg of sodium thiosulfate and 180 mg of 4-hydroxy-6-methyl-1,3,3a,7-tetrazaindene, and then 90 mg of Antifogging Agent (1) was added, followed by cooling. In this way, 635 g of a monodisperse cubic silver chlorobromide emulsion having an average grain size of 0.30 μm was obtained.

TABLE 5

| Composition | |
|---|---|
| $H_2O$ | 600 cc |
| Lime-processed gelatin | 20 g |
| KBr | 0.3 g |
| NaCl | 2 g |
| Compound (a) | 0.03 g |
| Sulfuric acid (1N) | 16 cc |
| Temperature | 46° C. |

TABLE 6

| | Solution (I) | Solution (II) | Solution (III) | Solution (IV) |
|---|---|---|---|---|
| $AgNO_3$ | 30.0 g | none | 90.0 g | none |
| KBr | none | 3.50 g | none | 57.1 g |
| NaCl | none | 1.72 g | none | 3.13 g |
| $K_2IrCl_6$ | none | none | none | 0.03 mg |
| Total volume | water to make 126 ml | water to make 131 ml | water to make 280 ml | water to make 289 ml |

over 28 min, and then after 10 sec, Solution (III) was added over 27 min 50 sec.

Then, after washing with water and desalting (at a pH of 3.9 using Settling Agent b) in a usual manner, 1,230 g of lime-processed ossein gelatin and 2.8 mg of Compound (b) were added, and the pH and the pAg were adjusted to 6.1 and 8.4 respectively. Then, after the chemical sensitization was carried out at 60° C. for optimally by adding 24.9 mg of sodium thiosulfate, 13.1 g of Dye (c) and 118 ml of Compound (c) were added successively, followed by cooling. The silver halide grains of the resulting emulsion were potato-like grains and had an average grain size of 0.53 μm and the yield was 30,700 g.

TABLE 7

| Composition | |
|---|---|
| $H_2O$ | 29200 cc |
| Lime-processed gelatin | 1582 g |
| KBr | 127 g |
| Compound (a) | 0.66 g |
| Temperature | 72° C. |

Dye(b-1)

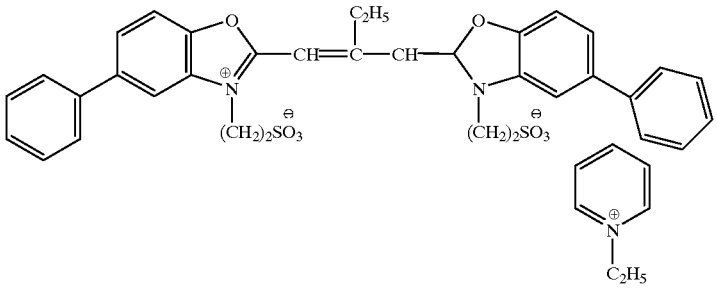

Dye(b-2)

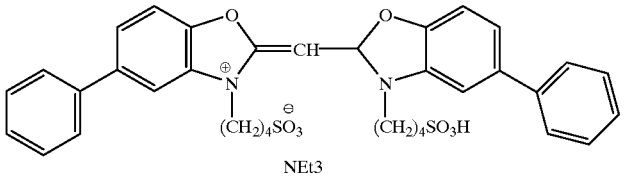

Settling agent a

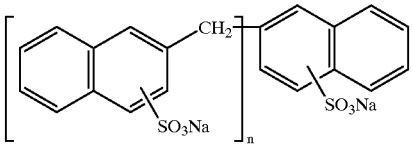

Antifoggant(1)

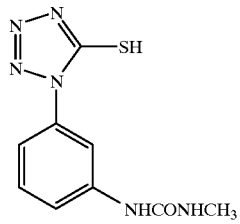

Light-Sensitive Silver Halide Emulsion (3) [for a blue-sensitive emulsion layer]

To a well-stirred aqueous solution having the composition shown in Table 7, was added Solution (II) having the composition shown in Table 8 over 30 min, and after 10 sec of the start of the addition of Solution (II), Solution (I) having the composition shown in Table 8 was added over 30 min. After 2 min of the completion of the adding of solution (I), Solution (V) was added, also after 5 min of the completion of the adding of Solution (II), Solution (IV) was added

TABLE 8

| | Solution (I) | Solution (II) | Solution (III) | Solution (IV) | Solution (V) |
|---|---|---|---|---|---|
| $AgNO_3$ | 939 g | none | 3461 g | none | none |
| KBr | none | 572 g | none | 2464 g | none |
| KI | none | none | none | none | 22 g |

TABLE 8-continued

| | Solution (I) | Solution (II) | Solution (III) | Solution (IV) | Solution (V) |
|---|---|---|---|---|---|
| Total volume | water to make 6690 ml | water to make 6680 ml | water to make 9700 ml | water to make 9740 ml | water to make 4400 ml |

Settling agent b

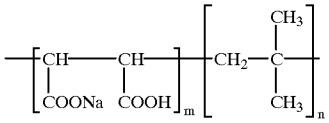

m + n = 1

Dye(c)

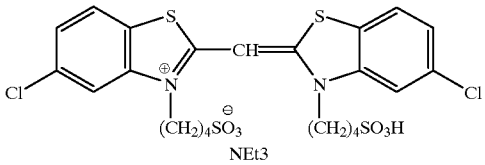

Compound(c)

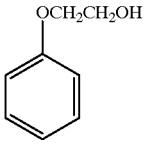

Compound(b)

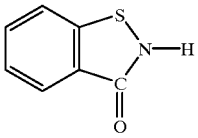

Next, the preparation methods of gelatin dispersions of hydrophobic additives are described.

A gelatin dispersion of each of a yellow coupler, a magenta coupler, a cyan coupler, and a developing agent whose formulation is shown in Table 9 was prepared, respectively. That is, the oil phase components were dissolved by heating to about 70° C. to form a uniform solution, and, to the resultant solution, was added the aqueous phase components that had been heated to about 60° C., followed by stirring to mix and dispersing by a homogenizer for 10 min at 10,000 rpm. To the resultant description, was added additional water, followed by stirring to obtain a uniform dispersion.

TABLE 9

| | | Composition of dispersion | | |
|---|---|---|---|---|
| | | Yellow | Magenta | Cyan |
| Oil phase | Cyan coupler C-28 | none | none | 7.0 g |
| | Magenta coupler C-28 | none | 7.0 g | none |
| | Yellow coupler C-14 | 7.0 g | none | none |
| | Color-developing agent① | none | none | 5.6 g |

TABLE 9-continued

| | | Composition of dispersion | | |
|---|---|---|---|---|
| | | Yellow | Magenta | Cyan |
| | Color-developing agent② | none | 5.6 g | none |
| | Color-developing agent③ | 5.6 g | none | none |
| | Antifoggant⑤ | 0.25 g | none | none |
| | Antifoggant② | none | 0.25 g | 0.25 g |
| | High-boiling solvent ④ | 7.4 g | 7.4 g | 7.4 g |
| | Ethyl acetate | 15 cc | 15 cc | 15 cc |
| Aqueous phase | Lime-processed gelatin | 10.0 g | 10.0 g | 10.0 g |
| | Calcium nitrate | 0.1 g | 0.1 g | 0.1 g |
| | Surfactant① | 0.7 g | 0.7 g | 0.7 g |
| | Water | 110 cc | 110 cc | 110 cc |
| | Additional water | 110 cc | 110 cc | 110 cc |
| | Antiseptic① | 0.04 g | 0.04 g | 0.04 g |

Color-developing agent

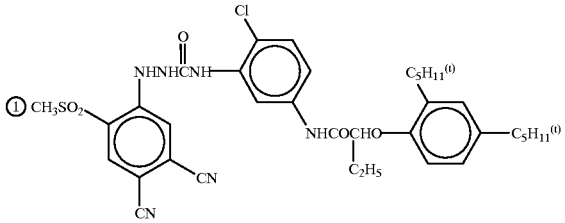

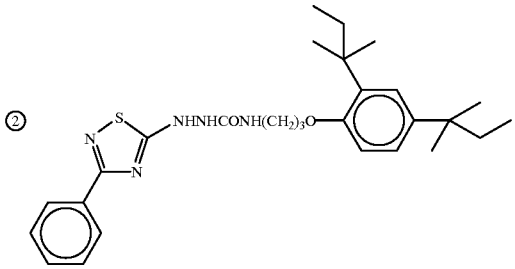

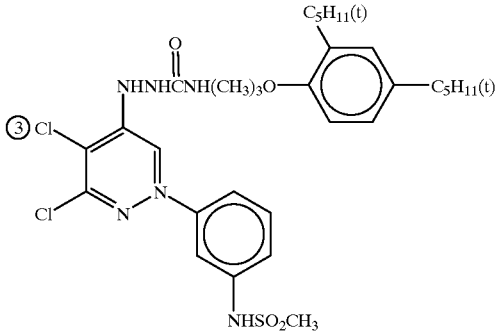

Antifoggant⑤

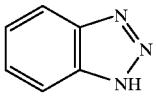

Antifoggant②

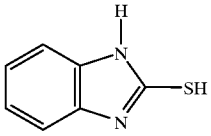

TABLE 9-continued

| | Composition of dispersion | | |
|---|---|---|---|
| | Yellow | Magenta | Cyan |
| High-boiling solvent④ | | | |

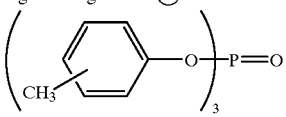

Antiseptic①

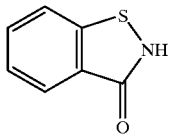

A gelatin dispersion of Antifoggant ④ and Reducing Agent ① whose formulation is shown in Table 10 was prepared. That is, the oil phase components were dissolved by heating to about 60° C., and, to the resultant solution, was added the aqueous phase components that had been heated to about 60° C., and after stirring and mixing them, the resultant mixture was dispersed for 10 min at 10,000 rpm by a homogenizer, to obtain a uniform dispersion.

TABLE 10

| | | Composition of dispersion |
|---|---|---|
| Oil phase | Antifoggant④ | 0.16 g |
| | Reducing agent① | 1.3 g |
| | High-boiling solvent② | 2.3 g |
| | High-boiling solvent⑤ | 0.2 g |
| | Surfactant① | 0.5 g |
| | Surfactant④ | 0.5 g |
| | Ethyl acetate | 10.0 ml |
| Aqueous phase | Acid-processed gelatin | 10.0 g |
| | Antiseptic① | 0.004 g |
| | Calcium nitrate | 0.1 g |
| | Water | 35.0 ml |
| | Additional water | 104.4 ml |

A dispersion of Polymer Latex (a) whose formulation is shown in Table 11 was prepared. That is, while a mixed solution of Polymer Latex (a), Surfactant ⑤, and water whose amounts are shown in Table 18 was stirred, Anionic Surfactant ⑥ was added thereto over 10 min, to obtain a uniform dispersion. The resulting dispersion was repeatedly diluted with water and concentrated using a ultrafiltration module (Ultrafiltration Module: ACV-3050, trade name, manufactured by Ashahi Chemical Industry Co., Ltd.) to bring the salt concentration of the dispersion to 1/9, thereby obtaining a description.

TABLE 11

| | Composition of dispersion |
|---|---|
| Polymer Latex (a) aqueous solution (solid content 13%) | 108 ml |
| Surfactant⑤ | 20 g |
| Surfactant⑥ | 600 ml |
| Water | 1232 ml |

A gelatin dispersion of zinc hydroxide was prepared according to the formulation shown in Table 12. That is, after the components were mixed and dissolved, dispersing was carried out for 30 min in a mill using glass beads having an average particle diameter of 0.75 mm. Then the glass beads were separated and removed, to obtain a uniform dispersion.

TABLE 12

| | Composition of dispersion |
|---|---|
| Zinc hydroxide | 15.9 g |
| Carboxymethyl cellulose | 0.7 g |
| Poly(sodium acrylate) | 0.07 g |
| Lime-processed gelatin | 4.2 g |
| Water | 100 ml |
| Antiseptic② | 0.4 g |

The preparation method of a gelatin dispersion of a matting agent that was added to the protective layer is described. A solution containing PMMA dissolved in methylene chloride was added, together with a small amount of a surfactant, to gelatin, and they were stirred and dispersed at high speed. Then the methylene chloride was removed off using a vacuum solvent removing apparatus, to obtain a uniform dispersion having an average particle size of 4.3 μm.

Surfactant ①

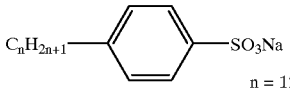

n = 12.6

Antifoggant ④

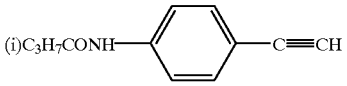

-continued
Surfactant ④
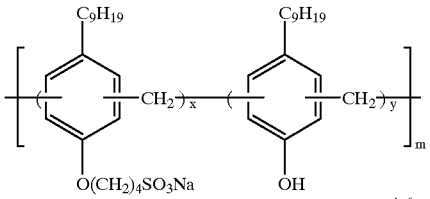
x:y = 4:6
m = 6.8
High-boiling solvent ②
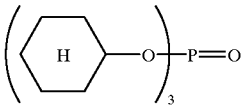
Antiseptic ①
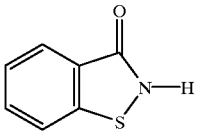
High-boiling solvent ⑤
$C_{18}H_{48.9}C_{17.1}$ (EMPARA 40 (trade name: manufactured by Ajinomoto K.K.))
Reducing agent ①
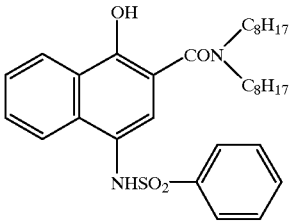
Polymer Latex(a)
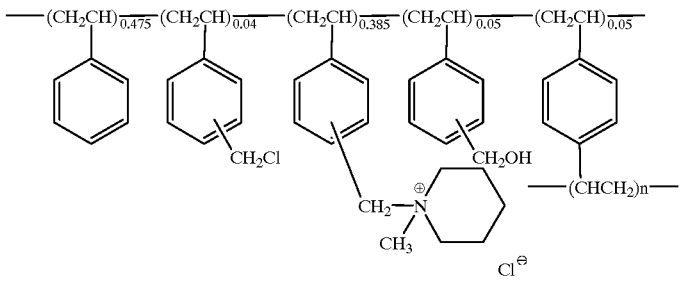
Surfactant ⑤
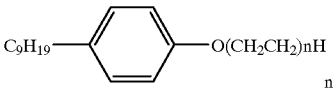
n = 50
Surfactant ⑥
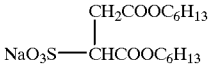
Antiseptic ②
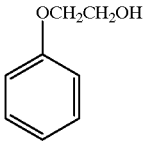
Surfactant ②
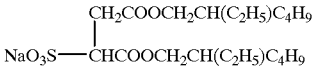
Surfactant ③
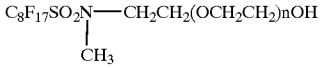
Water-soluble polymer ①
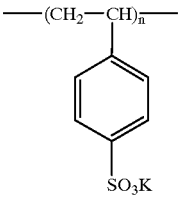
limiting viscosity
[η] = 1.6
(0.1N NaCl, 30° C.)
molecular weight = 1,000,000

-continued

Water-soluble polymer ②

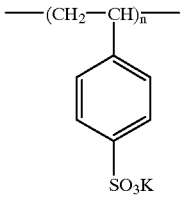

limiting viscosity
[η] = 0.8
(0.1N NaCl, 30° C.)
molecular weight = 400,000

Hardener ①

$CH_2{=}CHSO_2CH_2SO_2CH{=}CH_2$

Using the above materials, Light-Sensitive Element shown in Tables 13 and 14 was prepared.

TABLE 13

Constitution of Main Materials of Light-Sensitive Element 101

| Number of layer | Name of layer | Additive | Added amount (mg/m²) |
|---|---|---|---|
| Seventh layer | Protective layer | Acid-processed gelatin | 387 |
| | | Matting agent (2) | 17 |
| | | Surfactant ② | 6 |
| | | Surfactant ③ | 20 |
| | | Dispersion of Polymer Latex (a) | 10 |
| Sixth layer | Intermediate layer | Lime-processed gelatin | 862 |
| | | Antifoggant ④ | 7 |
| | | Reducing agent ① | 57 |
| | | High-boiling solvent ② | 101 |
| | | High-boiling solvent ⑤ | 9 |
| | | Surfactant ① | 21 |
| | | Surfactant ④ | 21 |
| | | Water-soluble polymer ① | 5 |
| | | Zinc hydroxide | 558 |
| | | Calcium nitrate | 6 |
| Fifth layer | Blue-light-sensitive layer | Lime-processed gelatin | 587 |
| | | Light-sensitive silver halide emulsion (3) | 399 |
| | | Yellow coupler C-14 | 410 |
| | | Color-developing agent ③ | 328 |
| | | Antifoggant ② | 15 |
| | | High-boiling solvent ④ | 433 |
| | | Surfactant ① | 12 |
| | | Water-soluble polymer ① | 40 |
| Forth layer | Intermediate layer | Lime-processed gelatin | 862 |
| | | Antifoggant ④ | 7 |
| | | Reducing agent ① | 57 |
| | | High-boiling solvent ② | 101 |
| | | High-boiling solvent ⑤ | 9 |
| | | Surfactant ① | 21 |
| | | Surfactant ④ | 21 |
| | | Water-soluble polymer ① | 4 |
| | | Zinc hydroxide | 341 |
| | | Calcium nitrate | 8 |
| Third layer | Green-light-sensitive layer | Lime-processed gelatin | 452 |
| | | Light-sensitive silver halide emulsion (2) | 234 |
| | | Magenta coupler C-28 | 420 |
| | | Color-developing agent ② | 336 |
| | | Antifoggant ② | 15 |
| | | High-boiling solvent ④ | 444 |
| | | Surfactant ① | 12 |
| | | Water-soluble polymer ① | 10 |
| Second layer | Intermediate layer | Lime-processed gelatin | 862 |
| | | Antifoggant ④ | 7 |
| | | Reducing agent ① | 57 |
| | | High-boiling solvent ② | 101 |
| | | High-boiling solvent ⑤ | 9 |
| | | Surfactant ① | 21 |
| | | Surfactant ④ | 21 |

TABLE 13-continued

Constitution of Main Materials of Light-Sensitive Element 101

| Number of layer | Name of layer | Additive | Added amount (mg/m²) |
|---|---|---|---|
| | | Water-soluble polymer ① | 10 |
| | | Calcium nitrate | 6 |
| First layer | Red-light-sensitive layer | Lime-processed gelatin | 373 |
| | | Light-sensitive silver halide emulsion (1) | 160 |
| | | Cyan coupler C-28 | 390 |
| | | Color-developing agent ① | 312 |
| | | Antifoggant ② | 14 |
| | | High-boiling solvent ④ | 412 |
| | | Surfactant ① | 11 |
| | | Water-soluble polymer ② | 25 |
| | | Hardener ① | 45 |
| Support (a support made by aluminum-evaporation on a PET of 20 μm and further surface-undercoating with gelatin.) | | | |

Then, to the first, third, and fifth layers of the above light-sensitive material, was added the compound represented by formula (I) or (II) for use in the present invention, in an amount of 20 mol %, to the developing agent, to prepare light-sensitive materials.

Then, the above light-sensitive material and the above image receiving element R101 were put together, and the image output was carried out under heating conditions at 80° C. for 10 sec, by PICTROSTAT 330, trade name, manufactured by Fuji Photo Film Co., Ltd. The outputted image was a sharp color image. {The maximum density and the minimum density were measured by a reflection densitometer X-lite 304, trade name, manufactured by X-lite Co.}

The results are shown in Table 15. As is apparent from the results shown in Table 15, in the case wherein the compound used in the present invention was used, a good color forming property (high Dmax) could be obtained even in a short period of development time.

Further, by using any one of the above compounds W-1 to W-28, as a surfactant, could be obtained the simirar effects.

TABLE 15

| Light-sensitive material | Coupler | Color-developing agent | Silver-developing reducing agent | Dmin/Dmax | Remarks |
|---|---|---|---|---|---|
| 101 | YC-14 | ③ | — | 0.04/1.33 | Comparative example |
| | MC-28 | ② | — | 0.05/1.29 | |
| | CC-28 | ① | — | 0.04/1.39 | |

TABLE 15-continued

| Light-sensitive material | Coupler | Color-developing agent | Silver-developing reducing agent | Dmin/Dmax | Remarks |
|---|---|---|---|---|---|
| 102 | YC-14 | 3 | D-1 | 0.05/2.13 | This |
| | MC-28 | 2 | D-1 | 0.06/2.51 | invention |
| | CC-28 | 1 | D-1 | 0.06/2.60 | |
| 103 | YC-14 | 3 | D-3 | 0.05/2.13 | This |
| | MC-28 | 2 | D-3 | 0.06/2.51 | invention |
| | CC-28 | 1 | D-3 | 0.06/2.60 | |
| 104 | YC-14 | 3 | D-6 | 0.05/2.13 | This |
| | MC-28 | 2 | D-6 | 0.06/2.51 | invention |
| | CC-28 | 1 | D-6 | 0.06/2.60 | |
| 105 | YC-14 | 3 | D-7 | 0.04/2.09 | This |
| | MC-28 | 2 | D-7 | 0.05/2.48 | invention |
| | CC-28 | 1 | D-7 | 0.05/2.55 | |
| 106 | YC-14 | 3 | D-13 | 0.04/2.08 | This |
| | MC-28 | 2 | D-13 | 0.05/2.45 | invention |
| | CC-28 | 1 | D-13 | 0.06/2.61 | |
| 107 | YC-14 | 3 | D-22 | 0.05/2.11 | This |
| | MC-28 | 2 | D-22 | 0.06/2.43 | invention |
| | CC-28 | 1 | D-22 | 0.07/2.66 | |
| 108 | YC-14 | 3 | D-23 | 0.04/1.98 | This |
| | MC-28 | 2 | D-23 | 0.04/2.33 | invention |
| | CC-28 | 1 | D-23 | 0.05/2.41 | |
| 109 | YC-14 | 3 | D-25 | 0.06/1.99 | This |
| | MC-28 | 2 | D-25 | 0.07/2.21 | invention |
| | CC-28 | 1 | D-25 | 0.07/2.38 | |
| 110 | YC-14 | 3 | D-29 | 0.07/1.98 | This |
| | MC-28 | 2 | D-29 | 0.08/2.21 | invention |
| | CC-28 | 1 | D-29 | 0.07/2.29 | |
| 111 | YC-14 | 3 | D-32 | 0.06/1.88 | This |
| | MC-28 | 2 | D-32 | 0.08/2.09 | invention |
| | CC-28 | 1 | D-32 | 0.09/2.18 | |

Example 2

Light-Sensitive Element 201 was prepared in the following manner.

First, the method of preparing a light-sensitive silver halide emulsion is described.

Light-Sensitive Silver Halide Emulsion (1) [Emulsion for Fifth Layer (680-nm Light-Sensitive Layer)]

To a well-stirred aqueous solution having the composition shown in Table 16, were added Solutions (I) and (II) each having the composition shown in Table 17, simultaneously over 13 min, and after 10 min, Solutions (III) and (IV) each having the composition shown in Table 17 were added over 33 min. After 13 min of the start of the addition of Solution III, 150 cc of an aqueous solution containing 0.350% of Sensitizing Dye 1 was added over 27 min.

TABLE 16

| Composition | |
|---|---|
| $H_2O$ | 620 cc |
| Lime-processed gelatin | 20 g |
| KBr | 0.3 g |
| NaCl | 2 g |
| Silver halide solvent 1 | 0.03 g |
| Sulfuric acid (1N) | 16 cc |
| Temperature | 45° C. |

TABLE 17

| | Solution (I) | Solution (II) | Solution (III) | Solution (IV) |
|---|---|---|---|---|
| $AgNO_3$ | 30.0 g | none | 70.0 g | none |
| KBr | none | 13.7 g | none | 44.2 g |

TABLE 17-continued

| | Solution (I) | Solution (II) | Solution (III) | Solution (IV) |
|---|---|---|---|---|
| NaCl | none | 3.62 g | none | 2.4 g |
| $K_2IrCl_3$ | none | none | none | 0.039 mg |
| Total volume | water to make 126 ml | water to make 132 ml | water to make 254 ml | water to make 252 ml |

Silver halide solvent 1

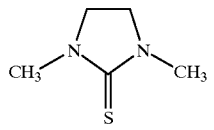

Sensitizing dye 1

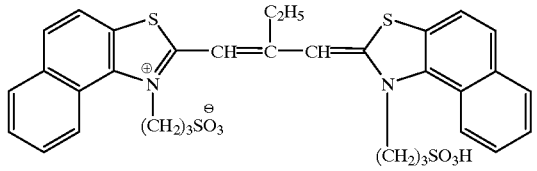

NEt3

After washing with water and desalting (that was carried out using Settling Agent a, at a pH of 4.1) in a usual manner, 22 g of lime-processed ossein gelatin was added, and after adjusting the pH and pAg to 6.0 and 7.9 respectively, the chemical sensitization was carried out at 60° C. The compounds used in the chemical sensitization are shown in Table 18. The yield of the obtained emulsion was 630 g and the emulsion was a monodisperse cubic silver chlorobromide emulsion having a deviation coefficient of 10.2% and an average grain size of 0.20 μm.

Settling agent a

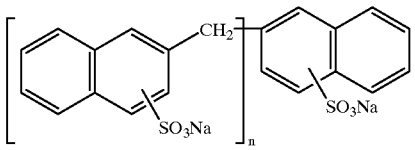

Settling agent b

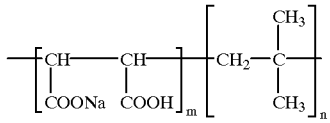

m + n = 1

-continued

Antifoggant ①

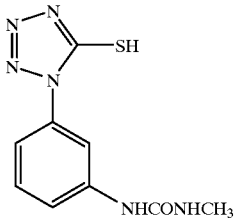

Antiseptic ①

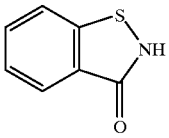

Antiseptic ②

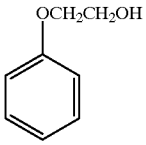

TABLE 18

| Chemicals used in chemical sensitization | Added amount |
|---|---|
| 4-hydroxy-6-methyl-1,3,3a,7-tetrazaindene | 0.36 g |
| Sodium thiosulfate | 6.75 mg |
| Antifoggant① | 0.11 g |
| Antiseptic① | 0.07 g |
| Antiseptic② | 3.31 g |

Light-Sensitive Silver Halide Emulsion (2) [Emulsion for Third Layer (750-nm Light-Sensitive Layer)]

To a well-stirred aqueous solution having the composition shown in Table 19, were added Solutions (I) and (II) each having the composition shown in Table 20, simultaneously over 18 min, and after 10 min, Solutions (III) and (IV) each having the composition shown in Table 20 were added over 24 min.

TABLE 19

| Composition | |
|---|---|
| $H_2O$ | 620 cc |
| Lime-processed gelatin | 20 g |
| KBr | 0.3 g |
| NaCl | 2 g |
| Silver halide solvent① | 0.03 g |
| Sulfuric acid (1N) | 16 cc |
| Temperature | 45° C. |

TABLE 20

| | Solution (I) | Solution (II) | Solution (III) | Solution (IV) |
|---|---|---|---|---|
| $AgNO_3$ | 30.0 g | none | 70.0 g | none |
| KBr | none | 13.7 g | none | 44.2 g |
| NaCl | none | 3.62 g | none | 2.4 g |
| $K_4[Fe(CN)_6].H_2O$ | none | none | none | 0.07 g |
| $K_2IrCl_6$ | none | none | none | 0.04 g |
| Total volume | water to make 188 ml | water to make 188 ml | water to make 250 ml | water to make 250 ml |

After washing with water and desalting (that was carried out using Settling Agent b at a pH of 3.9) in a usual manner, 22 g of lime-processed ossein gelatin from which calcium had been removed (the calcium content: 150 ppm or less) was added, re-dispersing was made at 40° C., 0.39 g of 4-hydroxy-6-methyl-1,3,3a,-7-tetrazaindene was added, and the pH and pAg were adjusted to 5.9 and 7.8 respectively. Thereafter the chemical sensitization was carried out at 70° C. using the chemicals shown in Table 21. At the end of the chemical sensitization, Sensitizing Dye ② in the form of a methanol solution (the solution having the composition shown in Table 22) was added. After the chemical sensitization, the temperature was lowered to 40° C. and then 200 g of a gelatin dispersion of the later-described Stabilizer ① was added, followed by stirring well and keeping in a case. The yield of the thus-obtained emulsion was 938 g, and the emulsion was a monodisperse cubic silver chlorobromide emulsion having a deviation coefficient of 12.6% and an average grain size of 0.25 $\mu$m. In this connection, the emulsion for a 750-nm light-sensitive layer had spectral sensitivity of the J-band type.

TABLE 21

| Chemicals used in chemical sensitization | Added amount |
|---|---|
| 4-hydroxy-6-methyl-1,3,3a,7-tetrazaindene | 0.39 g |
| Triethylthiourea | 3.3 mg |
| Nucleic acid decomposition product | 0.39 g |
| NaCl | 0.15 g |
| KI | 0.12 g |
| Antifoggant② | 0.10 g |
| Antiseptic① | 0.07 g |

TABLE 22

| Composition of dye solution | Added amount |
|---|---|
| Sensitizing dye② | 0.19 g |
| Methanol | 18.7 cc |

Stabilizer ①

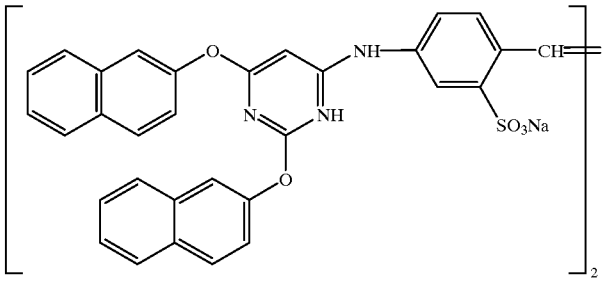

Antifoggant ②

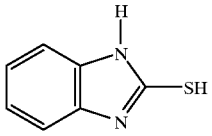

Sensitizing dye ②

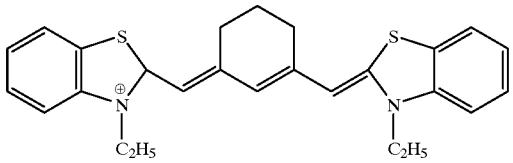

PTS ⊖

PTS = Para-toluenesulfonic acid

Settling agent b

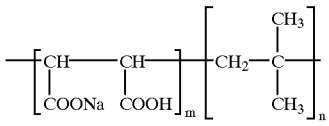

m + n = 1

Light-Sensitive Silver Halide Emulsion (3) [Emulsion for First Layer (810-nm light-sensitive layer)]

To a well-stirred aqueous solution having the composition shown in Table 23, were added Solutions (I) and (II) each having the composition shown in Table 24, simultaneously over 18 min, and after 10 min, Solutions (III) and (IV) each having the composition shown in Table 24 were added over 24 min.

TABLE 23

| Composition | |
|---|---|
| $H_2O$ | 620 cc |
| Lime-processed gelatin | 20 g |
| KBr | 0.3 g |
| NaCl | 2 g |
| Silver halide solvent① | 0.03 g |
| Sulfuric acid (1N) | 16 cc |
| Temperature | 50° C. |

TABLE 24

| | Solution (I) | Solution (II) | Solution (III) | Solution (IV) |
|---|---|---|---|---|
| $AgNO_3$ | 30.0 g | none | 70.0 g | none |
| KBr | none | 13.7 g | none | 44.1 g |
| NaCl | none | 3.62 g | none | 2.4 g |
| $K_2IrCl_6$ | none | none | none | 0.02 mg |
| Total volume | water to make 180 ml | water to make 181 ml | water to make 242 ml | water to make 250 ml |

After washing with water and desalting (that was carried out using Settling Agent a at a pH of 3.8) in a usual manner, 22 g of lime-processed ossein gelatin was added, and after adjusting the pH and pAg to 7.4 and 7.8 respectively, the chemical sensitization was carried out at 60° C. The compounds used in the chemical sensitization are shown in Table 25. At the end of the chemical sensitization, Spectrally Sensitizing Dye 3 in the form of a methanol solution was added. The yield of the thus-obtained emulsion was 680 g, and the emulsion was a monodisperse cubic silver chlorobromide emulsion having a deviation coefficient of 9.7% and an average grain size of 0.32 μm.

TABLE 25

| Chemicals used in chemical sensitization | Added amount |
|---|---|
| 4-hydroxy-6-methyl-1,3,3a,7-tetrazaindene | 0.38 g |
| Triethylthiourea | 3.1 mg |
| Antifoggant② | 0.19 g |
| Antiseptic① | 0.07 g |
| Antiseptic② | 3.13 g |

The preparation method of a gelatin dispersion of colloidal silver is described.

To a well-stirred aqueous solution having the composition shown in Table 26, was added a Solution having the composition shown in Table 27, over 24 min. Thereafter, the washing with water using Settling Agent a was carried out, then 43 g of lime-processed ossein gelatin was added, and the pH was adjusted to 6.3. The average grain size of the thus-obtained grains in the dispersion was 0.02 μm and the yield was 512 g. (The dispersion was a dispersion containing silver 2% and gelatin 6.8%.)

TABLE 26

| Composition | |
|---|---|
| $H_2O$ | 620 cc |
| Dextrin | 16 g |
| NaOH (5N) | 41 cc |
| Temperature | 30° C. |

TABLE 27

| Composition | |
|---|---|
| $H_2O$ | 135 cc |
| $AgNO_3$ | 17 g |

Next, the preparation methods of gelatin dispersions of hydrophobic additives are described.

A gelatin dispersion of each of a yellow coupler, a magenta coupler, a cyan coupler, and a color-developing agent whose formulation is shown in Table 28, was prepared, respectively. That is, the oil phase components were dissolved by heating to about 70° C., to form a uniform solution, and to the resultant solution, was added the aqueous phase components that had been heated to about 60° C., followed by stirring to mix and dispersing by a homogenizer for 10 min at 10,000 rpm. To the resultant dispersion, was added additional water, followed by stirring, to obtain a uniform dispersion.

TABLE 28

| | Composition of dispersion | | |
|---|---|---|---|
| | Yellow | Magenta | Cyan |
| Oil phase | | | |
| Cyan coupler C-31 | none | none | 7.0 g |
| Magenta coupler C-24 | none | 7.0 g | none |
| Yellow coupler C-16 | 7.0 g | none | none |
| Color-developing agent ① | none | none | 5.6 g |
| Color-developing agent ② | none | 5.6 g | none |
| Color-developing agent ③ | 5.6 g | none | none |
| Antifoggant ⑤ | 0.25 g | none | none |
| Antifoggant ② | none | 0.25 g | 0.25 g |
| High-boiling solvent ④ | 7.4 g | 7.4 g | 7.4 g |
| Dye (a) | 1.1 g | none | 0.5 g |
| Ethyl acetate | 15 cc | 15 cc | 15 cc |
| Aqueous phase | | | |
| Lime-processed gelatin | 10.0 g | 10.0 g | 10.0 g |
| Calcium nitrate | 0.1 g | 0.1 g | 0.1 g |
| Surfactant ① | 0.2 g | 0.2 g | 0.2 g |
| Water | 110 cc | 110 cc | 110 cc |
| Additional water | 110 cc | 110 cc | 110 cc |
| Antiseptic ① | 0.04 g | 0.04 g | 0.04 g |

A gelatin dispersion of Antifoggant ④ and Reducing Agent ① whose formulation is shown in Table 29 was prepared. That is, the oil phase components were dissolved by heating to about 60° C., to the resultant solution, was added the aqueous phase components that had been heated to about 60° C., and after stirring and mixing them, the resultant mixture was dispersed for 10 min at 10,000 rpm by a homogenizer, to obtain a uniform dispersion.

TABLE 29

| | | Composition of dispertion |
|---|---|---|
| Oil phase | Antifoggant ④ | 0.16 g |
| | Reducing agent ① | 1.3 g |
| | High-boiling solvent ② | 2.3 g |
| | High-boiling solvent ⑤ | 0.2 g |
| | Surfactant ① | 0.5 g |
| | Surfactant ④ | 0.5 g |
| | Ethyl acetate | 10.0 ml |
| Aqueous phase | Acid-processed gelatin | 10.0 g |
| | Antiseptic ① | 0.004 g |
| | Calcium nitrate | 0.1 g |
| | Water | 35.0 ml |
| | Additional Water | 104.4 ml |

A gelatin dispersion of Reducing Agent ② whose formulation is shown in Table 30 was prepared. That is, the oil phase components were dissolved by heating to about 60° C., to the resultant solution, was added the aqueous phase components that had been heated to about 60° C., and after stirring and mixing them, the resultant mixture was dispersed for 10 min at 10,000 rpm by a homogenizer, to obtain a uniform dispersion. From the thus-obtained dispersion, ethyl acetate was removed off using a vacuum organic solvent removing apparatus.

TABLE 30

| | | Composition of dispersion |
|---|---|---|
| Oil phase | Reducing agent ② | 7.5 g |
| | High-boiling solvent ① | 4.7 g |
| | Surfactant ① | 1.9 g |
| | Ethyl acetate | 14.4 ml |
| Aqueous phase | Acid-processed gelatin | 10.0 g |
| | Antiseptic ① | 0.02 g |
| | Gentamicin | 0.04 g |
| | Sodium bisulfite | 0.1 g |
| | Water | 136.7 ml |

A dispersion of Polymer Latex (a) whose formulation is shown in Table 31 was prepared. That is, while a mixed solution of Polymer Latex (a), Surfactant ⑤, and water whose amounts are shown in Table 32 was stirred, Anionic Surfactant ⑥ was added thereto, over 10 min, to obtain a uniform dispersion. The resulting dispersion was repeatedly diluted with water and concentrated using a ultrafiltration module (Ultrafiltration Module: ACV-3050, trade name, manufactured by Ashahi Chemical Industry Co., Ltd.), to bring the salt concentration of the dispersion to 1/9, thereby obtaining a dispersion.

TABLE 31

| | Composition of dispersion |
|---|---|
| Polymer Latex (a) aqueous solution (solid content 13%) | 108 ml |
| Surfactant ⑤ | 20 g |
| Surfactant ⑥ | 600 ml |
| Water | 1232 ml |

A gelatin dispersion of Stabilizer ① whose formulation is shown in Table 32 was prepared. That is, the oil phase components were dissolved at room temperature, to the resultant solution, was added the aqueous phase components that had been heated to about 40° C., and after stirring and mixing them, the resultant mixture was dispersed for 10 min at 10,000 rpm by a homogenizer. To the resultant dispersion, was added additional water, followed by stirring, hereby obtaining a uniform dispersion.

TABLE 32

| | | Composition of dispersion |
|---|---|---|
| Oil phase | Stabilizer① | 4.0 g |
| | Sodium hydroxide | 0.3 g |
| | Methanol | 62.8 g |
| | Antiseptic② | 0.8 g |
| Aqueous phase | Gelatin from which calcium had been removed (Ca content 100 ppm or less) | 10.0 g |
| | Antiseptic① | 0.04 g |
| | Water | 320 ml |

A gelatin dispersion of zinc hydroxide was prepared according to the formulation shown in Table 33. That is, after the components were mixed and dissolved, dispersing was carried out for 30 min in a mill, using glass beads having an average particle diameter of 0.75 mm. Then the glass beads were separated and removed off, to obtain a uniform dispersion.

TABLE 33

| | Composition of dispersion |
|---|---|
| Zinc hydroxide | 15.9 g |
| Carboxymethyl cellulose | 0.7 g |
| Poly(sodium acrylate) | 0.07 g |
| Lime-processed gelatin | 4.2 g |
| Water | 100 ml |
| Antiseptic② | 0.4 g |

The preparation method of a gelatin dispersion of a matting agent that was added to the protective layer is described. A solution containing PMMA dissolved in methylene chloride was added, together with a small amount of a surfactant, to gelatin, and they were stirred and dispersed at high speed. Then the methylene chloride was removed off using a vacuum solvent removing apparatus, to obtain a uniform dispersion having an average particle size of 4.3 μm.

Dye (a)

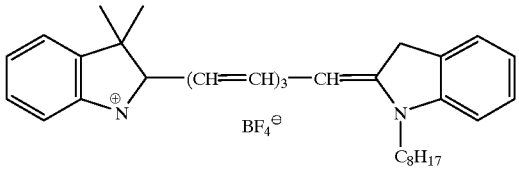

Antifoggant⑤

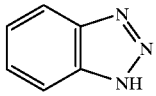

Antifoggant②

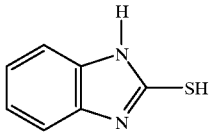

High-boiling solvent④

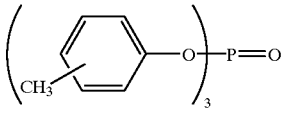

Reducing agent①

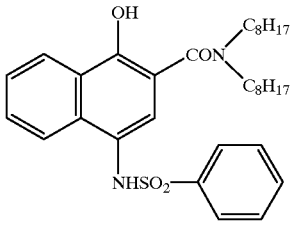

Antifoggant③

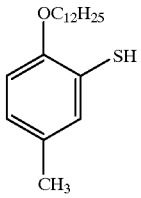

Antifoggant④

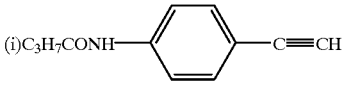

Surfactant①

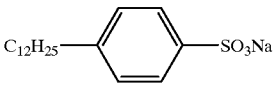

High-boiling solvent①

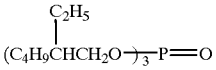

Antiseptic①

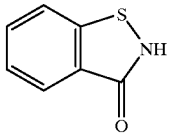

-continued

High-boiling solvent ②

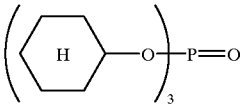

Reducing agent ②

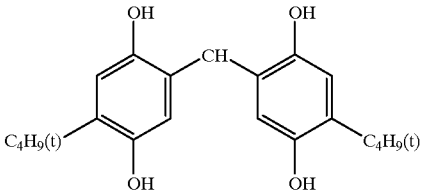

Surfactant ②

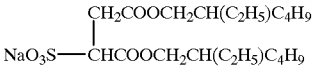

Surfactant ③

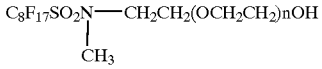

Water-soluble polymer ①

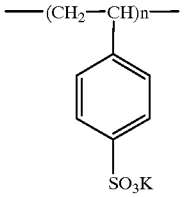

limiting viscosity
number [η] = 1.6
(0.1N NaCl 30° C.)
molecular weight = 1,000,000

Water-soluble polymer ②

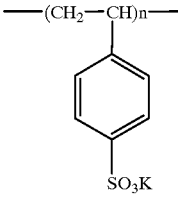

limiting viscosity
number [η] = 0.8
(0.1N NaCl 30° C.)
molecular weight = 400,000

Sensitizing dye ③

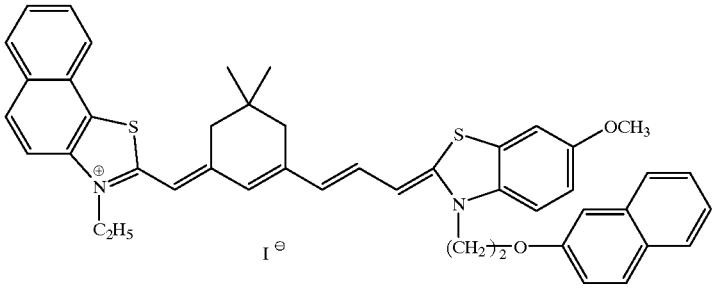

Hardener ①

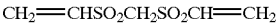

Surfactant ④

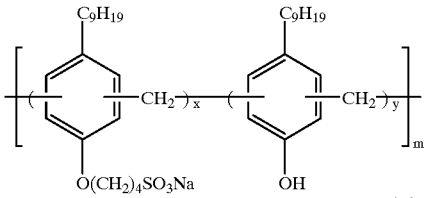

x:y = 4:6
m = 6.8

High-boiling organic solvent ⑤

$C_{28}H_{48.9}C_{17.1}$
(EMPARA 40 (trade name: manufactured by Ajinomoto K.K.))

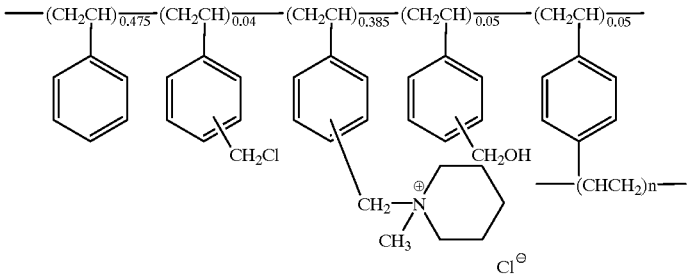

-continued

Surfactant ⑤

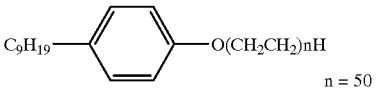

Color-developing agent

Surfactant ⑥

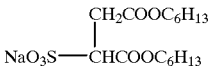

①

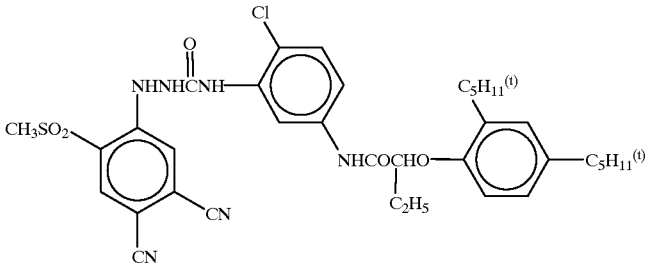

②

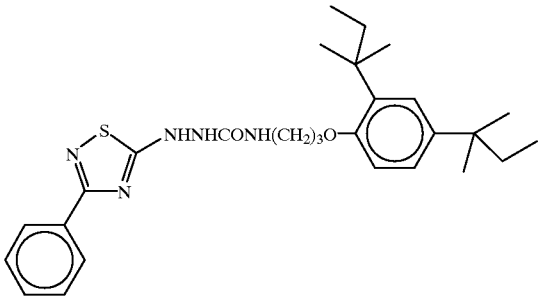

③

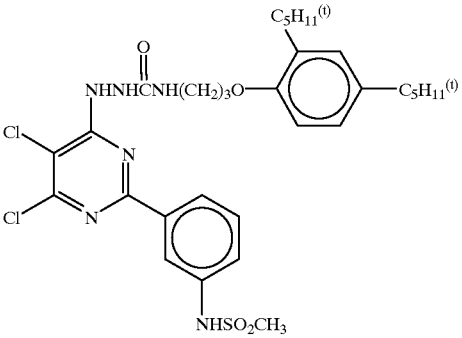

Using the above materials, Light-Sensitive Element shown in Tables 34 was prepared.

TABLE 34

Constitution of Main Materials of Light-Sensitive Element 201

| Number of layer | Name of layer | Additive | Added amount ($mg/m^2$) |
|---|---|---|---|
| Seventh layer | Protective layer | Acid-processed gelatin | 442 |
| | | Reducing agent ② | 47 |
| | | High-boiling solvent ① | 30 |
| | | Colloidal silver grains | 2 |
| | | Matting agent (PMMA resin) | 17 |
| | | Surfactant ① | 16 |
| | | Surfactant ② | 9 |
| | | Surfactant ③ | 2 |
| Sixth layer | Intermediate layer | Lime-processed gelatin | 862 |
| | | Antifoggant ④ | 7 |
| | | Reducing agent ① | 57 |
| | | High-boiling solvent ② | 101 |
| | | High-boiling solvent ⑤ | 9 |
| | | Surfactant ① | 21 |
| | | Surfactant ④ | 21 |
| | | Dispersion of Polymer Latex a | 5 |
| | | Water-soluble polymer ① | 4 |
| | | Calcium nitrate | 6 |
| Fifth layer | Red-light-sensitive layer | Lime-processed gelatin | 452 |
| | | Light-sensitive silver halide emulsion (1) | 301 |
| | | Magenta coupler C-24 | 420 |
| | | Color-developing agent ② | 336 |
| | | Antifoggant ② | 15 |
| | | High-boiling solvent | 444 |
| | | Surfactant ① | 12 |
| | | Water-soluble polymer ① | 10 |

TABLE 34-continued

Constitution of Main Materials of Light-Sensitive Element 201

| Number of layer | Name of layer | Additive | Added amount ($mg/m^2$) |
|---|---|---|---|
| Forth layer | Intermediate Layer | Lime-processed gelatin | 862 |
| | | Antifoggant ④ | 7 |
| | | Reducing agent ① | 57 |
| | | High-boiling solvent ② | 101 |
| | | High-boiling solvent ⑤ | 9 |
| | | Surfactant ① | 21 |
| | | Surfactant ④ | 21 |
| | | Dispersion of Polymer Latex a | 5 |
| | | Water-soluble polymer ① | 4 |
| | | Calcium nitrate | 6 |
| Third layer | Second infrared-light-sensitive layer | Lime-processed gelatin | 373 |
| | | Light-sensitive silver halide emulsion (2) | 106 |
| | | Cyan coupler C-31 | 390 |
| | | Color-developing agent ① | 312 |
| | | Antifoggant ② | 14 |
| | | High-boiling solvent | 412 |
| | | Surfactant ① | 11 |
| | | Water-soluble polymer ① | 11 |
| Second layer | Intermediate layer | Lime-processed gelatin | 862 |
| | | Antifoggant ④ | 7 |
| | | Reducing agent ① | 57 |
| | | High-boiling solvent ② | 101 |
| | | High-boiling solvent ⑤ | 9 |
| | | Surfactant ① | 21 |
| | | Surfactant ④ | 21 |
| | | Water-soluble polymer ② | 25 |
| | | Zinc hydroxide | 750 |
| | | Calcium nitrate | 6 |

TABLE 34-continued

Constitution of Main Materials of Light-Sensitive Element 201

| Number of layer | Name of layer | Additive | Added amount (mg/m$^2$) |
|---|---|---|---|
| First layer | First infrared-light-sensitive layer | Lime-processed gelatin | 587 |
| | | Light-sensitive silver halide emulsion (3) | 311 |
| | | Yellow coupler C-16 | 410 |
| | | Color-developing agent (3) | 328 |
| | | Antifoggant | 15 |
| | | High-boiling solvent | 433 |
| | | Surfactant (1) | 12 |
| | | Water-soluble polymer (2) | 40 |
| | | Hardener (1) | 45 |
| Support (a support made by aluminum-evaporation on a PET of 20 μm and further surface-undercoating with gelatin.) | | | |

Then, in the same manner as in Example 1, light-sensitive materials as shown in Table 36 were prepared, except that various compounds represented by formula (I) or (II) for use in the present invention were added to the first, third, and fifth layers, in an amount of 20 mol %, to the color-developing agent. Further, in the same manner as in Example 1, using the thus-prepared light-sensitive material and the image receiving element R101 as prepared in Example 1, the image output was carried out under heating conditions of 83° C. for 105 sec, with PICTROGRAPHY 3000, trade name, manufactured by Fuji Photo Film Co., Ltd. The resulting outputted images were sharp color images good in color forming property. {The maximum density and the minimum density were measured using a reflection densitometer X-lite 304, trade name, manufactured by X-lite Co.}

TABLE 36

| Light-sensitive material | Coupler | Color-developing agent | Silver-developing reducing agent | Dmin/Dmax | Remarks |
|---|---|---|---|---|---|
| 201 | YC-16 | (3) | — | 0.04/1.12 | Comparative example |
| | MC-24 | (2) | — | 0.05/1.09 | |
| | CC-31 | (1) | — | 0.04/1.17 | |
| 202 | YC-16 | (3) | D-22 | 0.05/1.94 | This invention |
| | MC-24 | (2) | D-22 | 0.06/2.28 | |
| | CC-31 | (1) | D-22 | 0.06/2.37 | |
| 203 | YC-16 | (3) | D-34 | 0.05/1.94 | This invention |
| | MC-24 | (2) | D-34 | 0.06/2.28 | |
| | CC-31 | (1) | D-34 | 0.06/2.37 | |
| 204 | YC-16 | (3) | D-35 | 0.05/1.94 | This invention |
| | MC-24 | (2) | D-35 | 0.06/2.28 | |
| | CC-31 | (1) | D-35 | 0.06/2.37 | |
| 205 | YC-16 | (3) | D-41 | 0.04/1.90 | This invention |
| | MC-24 | (2) | D-41 | 0.05/2.26 | |
| | CC-31 | (1) | D-41 | 0.05/2.32 | |
| 206 | YC-16 | (3) | D-43 | 0.04/1.89 | This invention |
| | MC-24 | (2) | D-43 | 0.05/2.23 | |
| | CC-31 | (1) | D-43 | 0.06/2.37 | |
| 207 | YC-16 | (3) | D-49 | 0.05/1.92 | This invention |
| | MC-24 | (2) | D-49 | 0.06/2.67 | |
| | CC-31 | (1) | D-49 | 0.07/2.42 | |
| 208 | YC-16 | (3) | D-51 | 0.04/1.80 | This invention |
| | MC-24 | (2) | D-51 | 0.04/2.12 | |
| | CC-31 | (1) | D-51 | 0.05/2.20 | |
| 209 | YC-16 | (3) | D-54 | 0.06/1.81 | This invention |
| | MC-24 | (2) | D-54 | 0.07/2.01 | |
| | CC-31 | (1) | D-54 | 0.07/2.16 | |
| 210 | YC-16 | (3) | D-55 | 0.07/1.80 | This invention |
| | MC-24 | (2) | D-55 | 0.08/2.01 | |
| | CC-31 | (1) | D-55 | 0.07/2.08 | |

TABLE 36-continued

| Light-sensitive material | Coupler | Color-developing agent | Silver-developing reducing agent | Dmin/Dmax | Remarks |
|---|---|---|---|---|---|
| 211 | YC-16 | (3) | D-56 | 0.06/1.71 | This invention |
| | MC-24 | (2) | D-56 | 0.08/1.90 | |
| | CC-31 | (1) | D-56 | 0.09/1.98 | |

Having described our invention as related to the present embodiments, it is our intention that the invention not be limited by any of the details of the description, unless otherwise specified, but rather be construed broadly within its spirit and scope as set out in the accompanying claims.

What I claim is:

1. A heat-developable color photographic light-sensitive material having on a base at least a light-sensitive silver halide, a binder, a coupler, and a reducing agent, wherein, as the reducing agent, a co-emulsion comprising at least one silver-developing reducing agent and at least one color-image-forming reducing agent is contained, and the silver-developing reducing agent is at least one compound represented by the following formula (1) or (2):

formula (1)

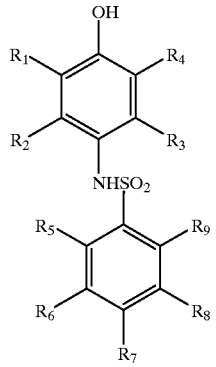

formula (2)

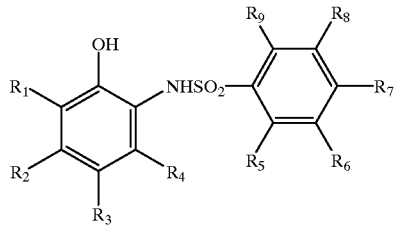

wherein $R_1$ to $R_9$ each represent a hydrogen atom, a halogen atom, a cyano group, or a substituent having 4 or less carbon atoms or an I/O value of 1 or more, with the proviso that, in formula (1), $R_2$ and/or $R_4$, and $R_5$ and/or $R_9$, each represent a halogen atom or a substituent having 4 or less carbon atoms or an I/O value of 1 or more, and that, in formula (2), $R_4$, and $R_5$ and/or $R_9$ each represent a halogen atom or a substituent having 4 or less carbon atoms or an I/O value of 1 or more; or when $R_1$ and $R_2$, $R_3$ and $R_4$, $R_5$ and $R_6$, $R_6$ and $R_7$, $R_7$ and $R_8$, and $R_8$ and $R_9$ each represent a substituent other than a hydrogen atom, each combination of the groups may independently bond together to form a ring, and wherein the coupler forms a diffusion dye by the reaction with an oxidized product of the color-image-forming reducing agent.

2. The light-sensitive material as claimed in claim 1, wherein the heat-developable color photographic light-sensitive material is a diffusion transfer light-sensitive material.

3. The light-sensitive material as claimed in claim 1, wherein, in formulae (1) and (2), the substituent represented by $R_1$ to $R_9$ is a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group.

4. The light-sensitive material as claimed in claim 1, wherein the color-image-forming reducing agent is a compound represented by the following formula (D-I) or (D-II):

formula (D-1)

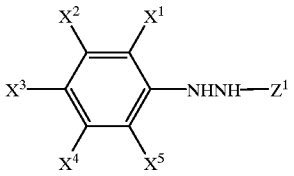

$R^3$—NHNH—$Z^2$ formula (D-II)

wherein $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$, and $X^5$, which may be the same or different, each represent a hydrogen atom or a substituent, with the proviso that the total of Hammett substituent constant σp values of $X^1$, $X^3$, and $X^5$, and Hammett substituent constant σm values of $X^2$ and $X^4$, is from 0.80 to 3.80; and $R^3$ represents a heterocyclic group.

5. The light-sensitive material as claimed in claim 4, wherein the color-image-forming reducing agent is a compound represented by the following formula (D-III) or (D-IV):

formula (D-III)

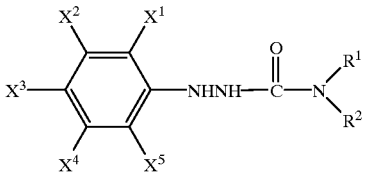

formula (D-IV)

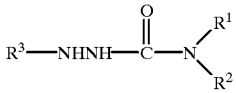

wherein $R^1$ and $R^2$ each represent a hydrogen atom or a substituent; $X^1$, $X^2$, $X^3$, $X^4$, and $X^5$, which may be the same or different, each represent a hydrogen atom or a substituent, with the proviso that the total of Hammett substituent constant σp values of $X^1$, $X^3$, and $X^5$, and Hammett substituent constant σm values of $X^2$ and $X^4$, is from 0.80 to 3.80; and $R^3$ represents a heterocyclic group.

6. The light-sensitive material as claimed in claim 5, wherein the color-image-forming reducing agent is a compound represented by the following formula (D-V), (D-VI), or (D-VII):

formula (D-V)

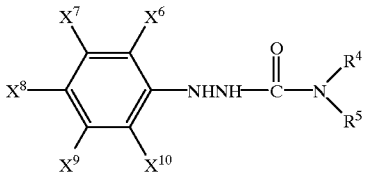

formula (D-VI)

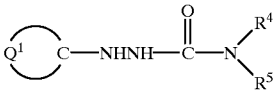

formula (D-VII)

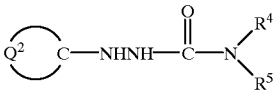

wherein $R^4$ and $R^5$ each represent a hydrogen atom or a substituent; $X^6$, $X^7$, $X^8$, $X^9$, and $X^{10}$, which may be the same or different, each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, with the proviso that the total of Hammett substituent constant σp values of $X^6$, $X^8$, and $X^{10}$, and Hammett substituent constant σm values of $X^7$ and $X^9$, is from 1.20 to 3.80; $Q^1$ represents a group of nonmetallic atoms necessary to form a nitrogen-containing five- to eight-membered heterocycle together with the C; and $Q^2$ represents a group of nonmetal atoms required to form together with C a nitrogen-containing 5- to 8-membered ring fused with a benzene ring or a heterocyclic ring.

7. The light-sensitive material as claimed in claim 1, wherein the coupler is a coupler represented by any one of the following formulae (C-1) to (C-12):

(C-1)

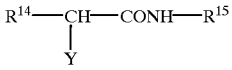

(C-2)

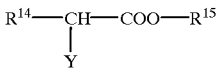

(C-3)

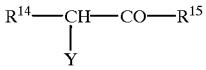

-continued (C-4)

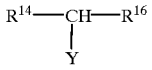

(C-5)

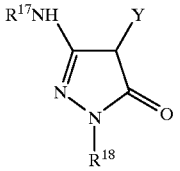

(C-6)

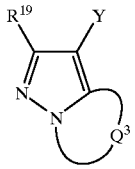

(C-7)

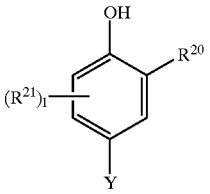

(C-8)

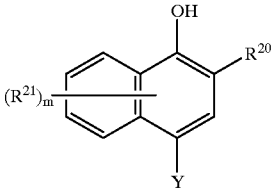

(C-9)

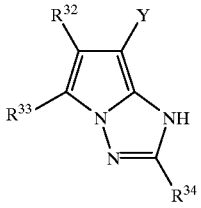

(C-10)

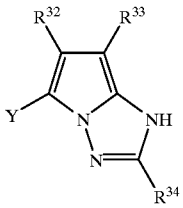

(C-11)

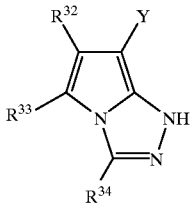

-continued (C-12)

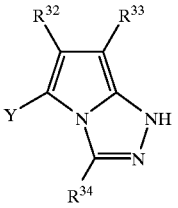

wherein, in formulae (C-1) to (C-4), $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, each of which may optionally be substituted; in formulae (C-1) to (C-3), $R^{15}$ represents an optionally substituted alkyl group, aryl group, or heterocyclic residue; in formula (C-4), $R^{16}$ represents an optionally substituted aryl group or heterocyclic residue; in formulae (C-1) to (C-4), Y is a group that renders the coupler nondiffusible and that is capable of coupling split-off by the coupling reaction with the oxidized product of a developing agent; and, in formulae (C-1) to (C-4), $R^{14}$ and $R^{15}$ together or $R^{14}$ and $R^{16}$ together may bond to form a 5- to 7-membered ring;

in formula (C-5), $R^{17}$ represents an alkyl group, an aryl group, an acyl group, or a carbamoyl group, $R^{18}$ represents a phenyl group, or a phenyl group that is substituted by one or more halogen atoms, alkyl groups, cyano groups, alkoxy groups, alkoxycarbonyl groups, or acylamino groups; and Y has the same meaning as defined above;

in formula (C-6), $R^{19}$ represents a hydrogen atom or a substituent, $Q^3$ represents a group of nonmetal atoms required to form a 5-membered azole ring containing 2 to 4 nitrogen atoms, which azole ring may have a substituent; and Y has the same meaning as defined above;

in formulae (C-7) and (C-8), $R^{20}$ represents a hydrogen atom, or a group selected from the group consisting of $—CONR^{22}R^{23}$, $—SO_2NR^{22}R^{23}$, $—NHCOR^{22}$, $—NHCONR^{22}R^{23}$ and $—NHSO_2NR^{22}R^{23}$, in which $R^{22}$ and $R^{23}$ each represent a hydrogen atom or a substituent; $R^{21}$ represents a substituent, 1 is an integer selected from 0 to 2, m is an integer selected from 0 to 4, and Y has the same meaning as defined above; and in formulas (C-9) to (C-12), $R^{32}$, $R^{33}$, and $R^{34}$ each represent a hydrogen atom or a substituent, and Y has the same meaning as defined above.

8. The light-sensitive material as claimed in claim 7, which contains the compound represented by the above formula (C-6) as a yellow coupler, the compound represented by the above formula (C-6) or (C-7) as a magenta coupler, and the compound represented by any one of the above formulae (C-7) to (C-12) as a cyan coupler.

9. The light-sensitive material as claimed in claim 1, which contains a compound represented by the following formulae W-1 to W-28:

W-1
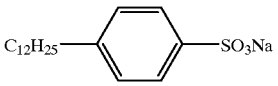
W-2
$C_{12}H_{25}OSO_3Na$
W-3
$C_{14}H_{29}SO_3Na$
W-4
$C_{11}H_{23}CH(OH)—CH_2CH_2SO_3Na$
$C_{11}H_{23}CH{=}CHCH_2SO_3Na$ a mixture of 40/60 (wt)
W-5
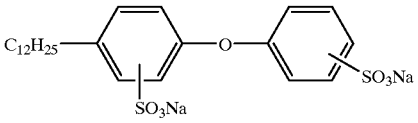
W-6
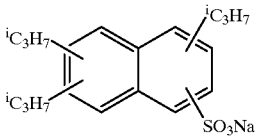
W-7
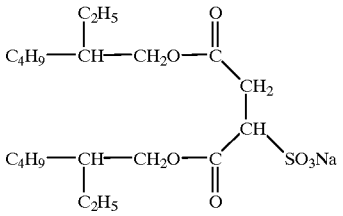
W-8
$C_{11}H_{23}CON(CH_3)CH_2CH_2SO_3Na$
W-9
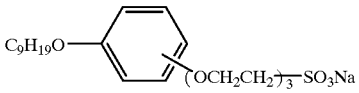
W-10
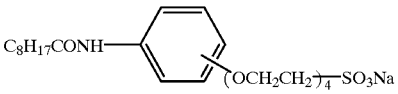
W-11
$C_{12}H_{25}—(O—CH_2CH_2)_3—SO_3Na$
W-12
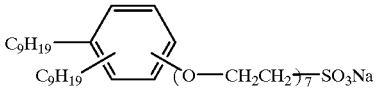
W-13
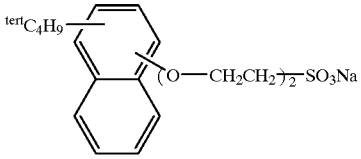
W-14
$C_{17}H_{33}CON(CH_3)—CH_2CH_2—(O—CH_2CH_2)_5—SO_3Na$
W-15
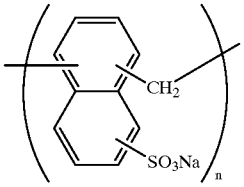
number-average
molecular weight ≈ 1500
W-16
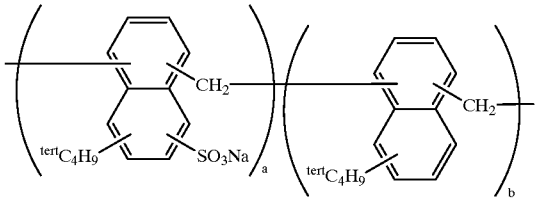
number-average
molecular weight ≈ 1500
a/b ≈ 20/80 (wt)
W-17
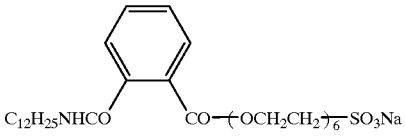
W-18
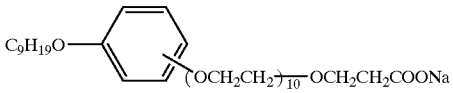
W-19
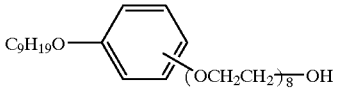
W-20
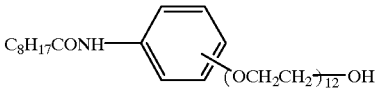
W-21
$C_{12}H_{25}—(O—CH_2CH_2)_{15}—OH$ -continued
W-22
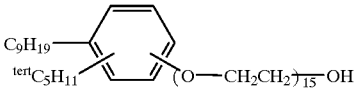
W-23
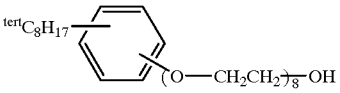
W-24
$C_{17}H_{33}CON(CH_3)—CH_2CH_2—(O—CH_2CH_2)_{14}—OH$
W-25
$H—(OCH_2CH_2)_a—(OCH(CH_3)CH_2)_b—(OCH_2CH_2)_c—OH$
a + c/b = 207/39 (polymerization degree)
-continued
W-26
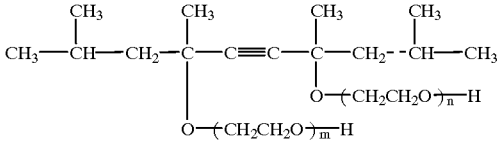
m + n ≈ 10
W-27
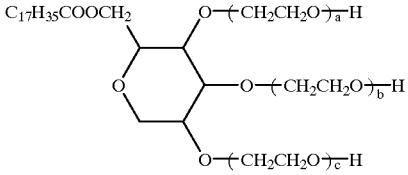
W-28
$C_{11}H_{23}CO—(O—CH_2CH_2)_{12}—H.$
* * * * *